US011560004B2

(12) United States Patent
Nakamura et al.

(10) Patent No.: US 11,560,004 B2
(45) Date of Patent: Jan. 24, 2023

(54) LIQUID EJECTION APPARATUS AND DELIVERY SYSTEM FOR LIQUID EJECTION HEAD

(71) Applicant: SEIKO EPSON CORPORATION, Tokyo (JP)

(72) Inventors: Hiroyuki Nakamura, Shiojiri (JP); Izumi Nozawa, Matsumoto (JP); Yuta Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/316,395

(22) Filed: May 10, 2021

(65) Prior Publication Data

US 2021/0354488 A1 Nov. 18, 2021

(30) Foreign Application Priority Data

May 12, 2020 (JP) ..... JP2020-083974
May 19, 2020 (JP) ..... JP2020-087261

(51) Int. Cl.
*B41J 29/393* (2006.01)

(52) U.S. Cl.
CPC ..... *B41J 29/393* (2013.01)

(58) Field of Classification Search
CPC ..... B41J 29/393
See application file for complete search history.

(56) References Cited

U.S. PATENT DOCUMENTS

2016/0292629 A1 10/2016 Matsuda
2016/0350661 A1 12/2016 Sato et al.
2018/0250938 A1 9/2018 Kawakami et al.

FOREIGN PATENT DOCUMENTS

EP 2202083 A1 * 6/2010 ..... B41J 2/04508
EP 3369575 A1 * 9/2018 ..... B41J 2/045
JP 2013-248860 12/2013
JP 2016-194770 11/2016
JP 2016-224155 12/2016
JP 2018-144304 9/2018

OTHER PUBLICATIONS

Translation of EP 3369575 A1. (Year: 2018).*
Translation of EP 2202083 A1. (Year: 2010).*

* cited by examiner

*Primary Examiner* — Justin Seo
(74) *Attorney, Agent, or Firm* — Workman Nydegger

(57) ABSTRACT

A liquid ejection apparatus includes a liquid ejection head that is detachably attached and ejects a liquid, and a control section that is configured to transmit a delivery request for a new liquid ejection head to a server apparatus via a network.

13 Claims, 25 Drawing Sheets

LIQUID EJECTION APPARATUS AND DELIVERY SYSTEM FOR LIQUID EJECTION HEAD

The present application is based on, and claims priority from JP Application Serial Number 2020-087261, filed May 19, 2020 and JP Application Serial Number 2020-083974, filed May 12, 2020, the disclosures of which are hereby incorporated by reference herein in their entirety.

BACKGROUND

1. Technical Field

The present disclosure relates to a liquid ejection apparatus that ejects a liquid onto a medium and a delivery system for a liquid ejection head.

2. Related Art

An image forming apparatus as an example of a liquid ejection apparatus described in JP-A-2016-224155 includes a replacement time prediction section that predicts a replacement time of a cartridge as an example of a consumable liquid storage body. The replacement time prediction section periodically predicts the replacement time of the cartridge at which a residual amount of a coloring material is equal to or less than a replacement threshold value from the time of ordering a replacement cartridge based on the residual amount of the coloring material and the consumption tendency. The image forming apparatus includes a replacement ordering section that causes the replacement time prediction section to predict the replacement time of the cartridge, and orders a replacement cartridge automatically or by receiving a request from a user when a period up to the predicted replacement time is equal to or less than an ordering threshold value. Consequently, it is possible to prevent the coloring material of the cartridge from being used up before the replacement cartridge is supplied. That is, the liquid ejection apparatus that reduces concern that downtime may occur due to the absence of a replacement cartridge at the user's hand is disclosed.

The liquid ejection apparatus performs recording on a surface of a medium by ejecting a liquid supplied from a liquid storage body to the liquid ejection head included in the liquid ejection apparatus, from a nozzle of the liquid ejection head toward the surface of the medium. Thus, in the liquid ejection apparatus, there is a case where recording cannot be normally performed on the medium by the liquid ejection apparatus not only when the liquid in the liquid storage body is used up before the supply of a replacement liquid storage body but also when a problem related to ejection in the liquid ejection head occurs.

However, in the liquid ejection apparatus described in JP-A-2016-224155, no consideration is given to the occurrence of a problem related to ejection in the liquid ejection head. Thus, when a problem related to the ejection in the liquid ejection head occurs and the liquid ejection apparatus cannot normally perform recording on the medium, downtime occurs in the liquid ejection apparatus due to the absence of a new replacement liquid ejection head at the user's hand.

SUMMARY

According to an aspect of the present disclosure, there is provided a liquid ejection apparatus including a liquid ejection head that is detachably attached and ejects a liquid; and a control section that is configured to transmit a delivery request for a new liquid ejection head to a server apparatus via a network.

According to another aspect of the present disclosure, there is provided a delivery system for a liquid ejection head including the liquid ejection apparatus, and the server apparatus including a reception section that receives the delivery request for the new liquid ejection head transmitted from the control section.

DESCRIPTION OF EXEMPLARY EMBODIMENTS

Figure 1:
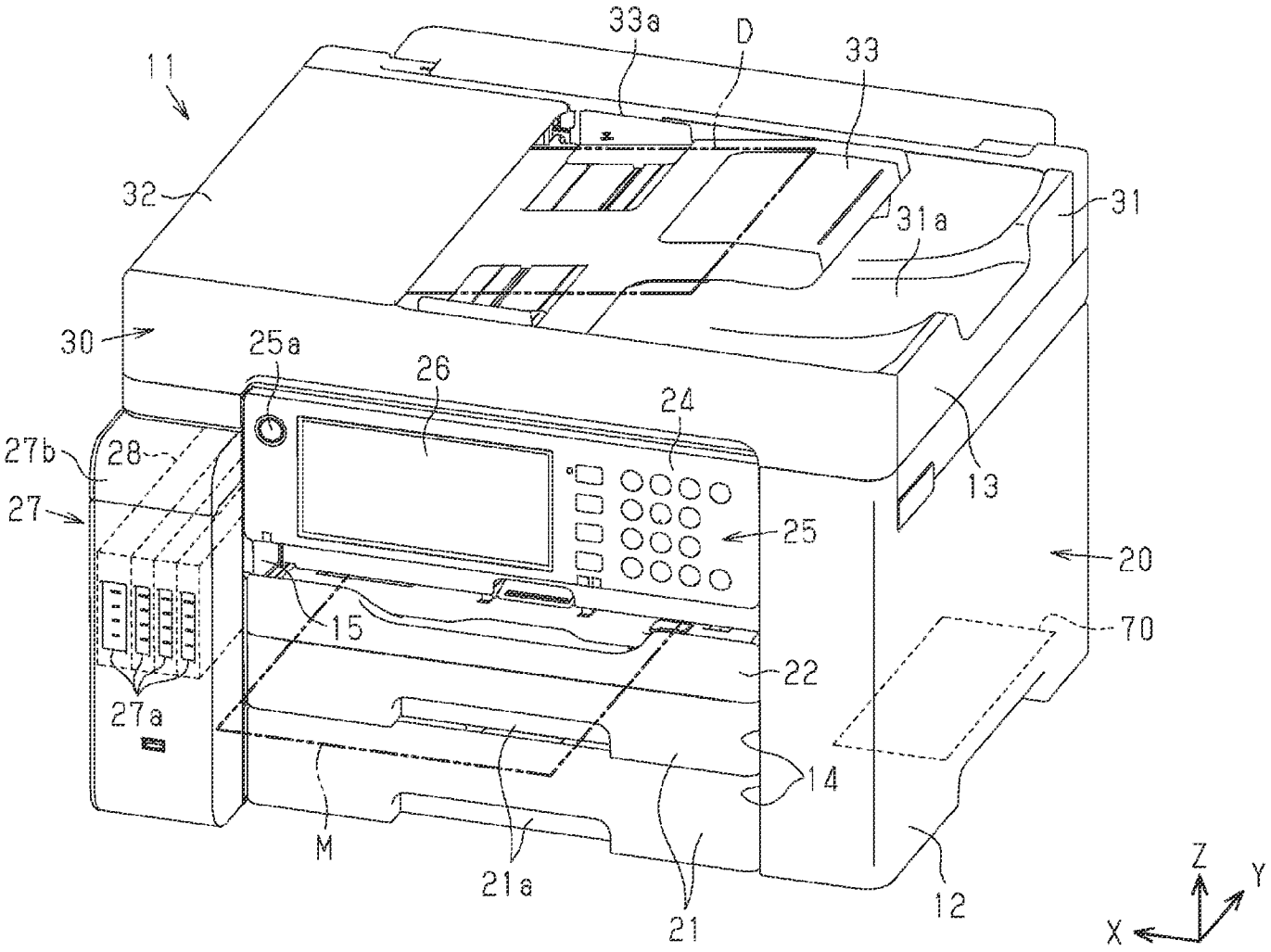
FIG. 1 is a perspective view illustrating a liquid ejection apparatus according to first and second embodiments.

In the drawings, a direction of gravity is indicated by a Z axis when a liquid ejection apparatus is placed on a horizontal plane, and directions along a plane intersecting the Z axis are indicated by an X axis and a Y axis. The X axis, Y axis, and Z axis are preferably orthogonal to each other, and the X axis and Y axis are along the horizontal plane. In the following description, the X axis direction will also be referred to as a width direction X, the Y axis direction will also be referred to as a depth direction Y, a transport direction of a medium during recording will also be referred to as a transport direction Y1, and the Z axis direction will also be referred to as a vertical direction Z. In the present embodiment, since the width direction X is also a scanning direction of a carriage described later, the width direction X will also be referred to as a scanning direction X. A surface on which the operation panel described later is disposed in the Y axis will be referred to as a front surface, and a surface opposite to the front surface will be referred to as a rear surface.

First Embodiment

Configuration of Liquid Ejection Apparatus

As illustrated in FIG. 1, a liquid ejection apparatus 11 includes a rectangular parallelepiped casing 12 and an upper cover 13 provided on the +Z direction side of the casing 12 so as to be openable and closable with, for example, the rear surface side as a rotation axis. The liquid ejection apparatus 11 is a multi-function peripheral as an example, and includes a recording unit 20 that occupies most of the casing 12, and a reading unit 30 formed of an end portion of the casing 12 on the +Z direction side and the upper cover 13. The liquid ejection apparatus 11 includes a control section 70 that controls the recording unit 20 and the reading unit 30. The control section 70 is configured with, for example, a computer, a processing circuit including a memory, and the like, and controls the recording unit 20 and the reading unit 30 according to a program stored in the memory.

A cassette 21 as an example of a medium storage portion is inserted into and detached from a recess 14 provided in a lower front portion of the casing 12. A plurality of media M are stored in the cassette 21. An operated portion 21*a* that is attachable and detachable by a user by hooking a finger is provided at the center of the front surface of each cassette 21.

A discharge port 15 from which the recorded medium M is discharged is open at a position on the +Z direction side of the cassette 21 in the casing 12. An extendable discharge tray 22 is provided between the discharge port 15 and the cassette 21. The discharge tray 22 is used in a state of extending downstream in the transport direction Y1, and the discharged medium M after recording is loaded on the discharge tray 22. An operation panel 24 is provided on the entire surface of the casing 12 at a position on the +Z direction side of the discharge port 15.

The operation panel 24 includes an operation section 25 including a plurality of switches operated when a user gives an instruction to the liquid ejection apparatus 11, and a display section 26 displaying a menu, a message, or the like. The operation section 25 includes a power switch 25*a*, a selection switch, and the like. Here, the display section 26 may be a touch panel, and an operation function of the display section 26 may also serve as a part of the operation section 25. The control section 70 controls the liquid ejection apparatus 11 based on an operation performed by the user by using the operation section 25. The control section 70 displays a menu, a message, or the like on the display section 26 as necessary.

As illustrated in FIG. 1, the upper cover 13 is a platen cover 31 of the reading unit 30 in the present embodiment, and an is provided thereon with an automatic document feeder 32 having a document tray 33 on which a plurality of original documents D are placeable. The reading unit 30 has a sheet feeder type scanner function of feeding and reading the original documents D positioned in the depth direction Y by edge guides 33*a* one by one from the document tray 33, and a flatbed type scanner function of reading the original documents D placed on a platen that is exposed when the platen cover 31 is opened. In the sheet feeder type scanner function, the original documents D fed one by one from the document tray 33 are read by the reading unit 30 and then discharged to the discharge tray 31*a*.

In addition to the ink jet type recording function, the liquid ejection apparatus 11 which is a multi-function peripheral provided with the reading unit 30 has a scanner function in which the reading unit 30 reads the original document D and a copy recording function in which an image of the original document D read by the reading unit 30 is recorded.

As illustrated in FIG. 1, a liquid supply unit 27 is provided at one end on the front surface of the casing 12 on the +X direction side. A plurality of liquid storage bodies 28 each storing a liquid such as ink are accommodated in the liquid supply unit 27. The plurality of liquid storage bodies 28 are ink cartridges that store inks with different colors such as black, cyan, magenta, and yellow. The liquid stored in the liquid storage body 28 is used for the liquid ejection apparatus 11 to eject the liquid onto a medium M and to perform recording. The liquid supply unit 27 has a plurality of window portions 27*a* indicating an amount of the liquid in each liquid storage body 28 on the front surface.

The liquid supply unit 27 has a lid portion 27*b* that can be opened and closed upward. For example, the liquid ejection apparatus 11 has a configuration in which, when the user looks at the window portions 27*a* and liquid amounts decrease, the user opens the lid portion 27*b* to replace the liquid storage bodies 28.

Figure 2:
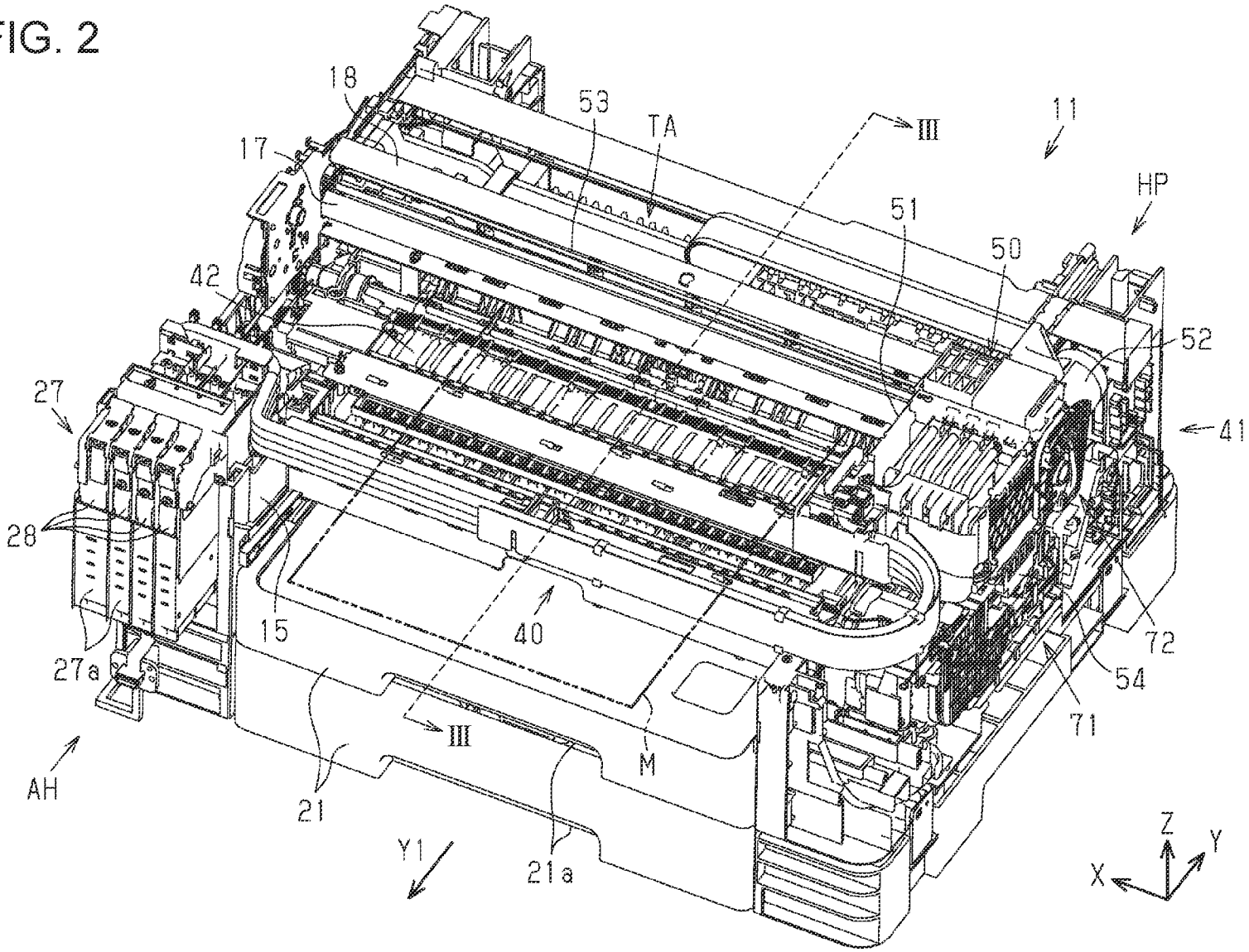
FIG. 2 is a perspective view illustrating a state in which a casing is detached in the liquid ejection apparatus.

As illustrated in FIG. 2, the liquid ejection apparatus 11 has a transport region TA in which the medium M supplied from the cassette 21 is transported at the center thereof in the width direction X. The liquid ejection apparatus 11 includes a transport section 40 that feeds the media M that is a recording target one by one from the cassette 21 into the recording unit 20 included in the liquid ejection apparatus 11 and transports the media M along a path passing through the transport region TA, and a carriage unit 50 that ejects a liquid to perform recording while moving with respect to the medium M in the transport region TA.

The transport section 40 has a feed portion 41 that feeds media M one by one from the cassette 21 at the rear of the liquid ejection apparatus 11. The feed portion 41 has a plurality of intermediate rollers (not illustrated) arranged side by side in the transport direction Y1. The feed portion 41 reverses the medium M fed rearward from the cassette 21 due to rotation of a pickup roller (not illustrated) along outer circumferences of the intermediate rollers, and then transports the medium M through the transport region TA in the transport direction Y1. A support portion 42 that supports the medium M on which recording is performed by the carriage unit 50 is disposed in the transport region TA. The transport section 40 has a plurality of rollers (not illustrated) along the transport path, and transports the medium M in the transport direction Y1 due to rotation of the rollers. The transport section 40 is controlled by the control section 70 illustrated in FIG. 1.

Figure 3:
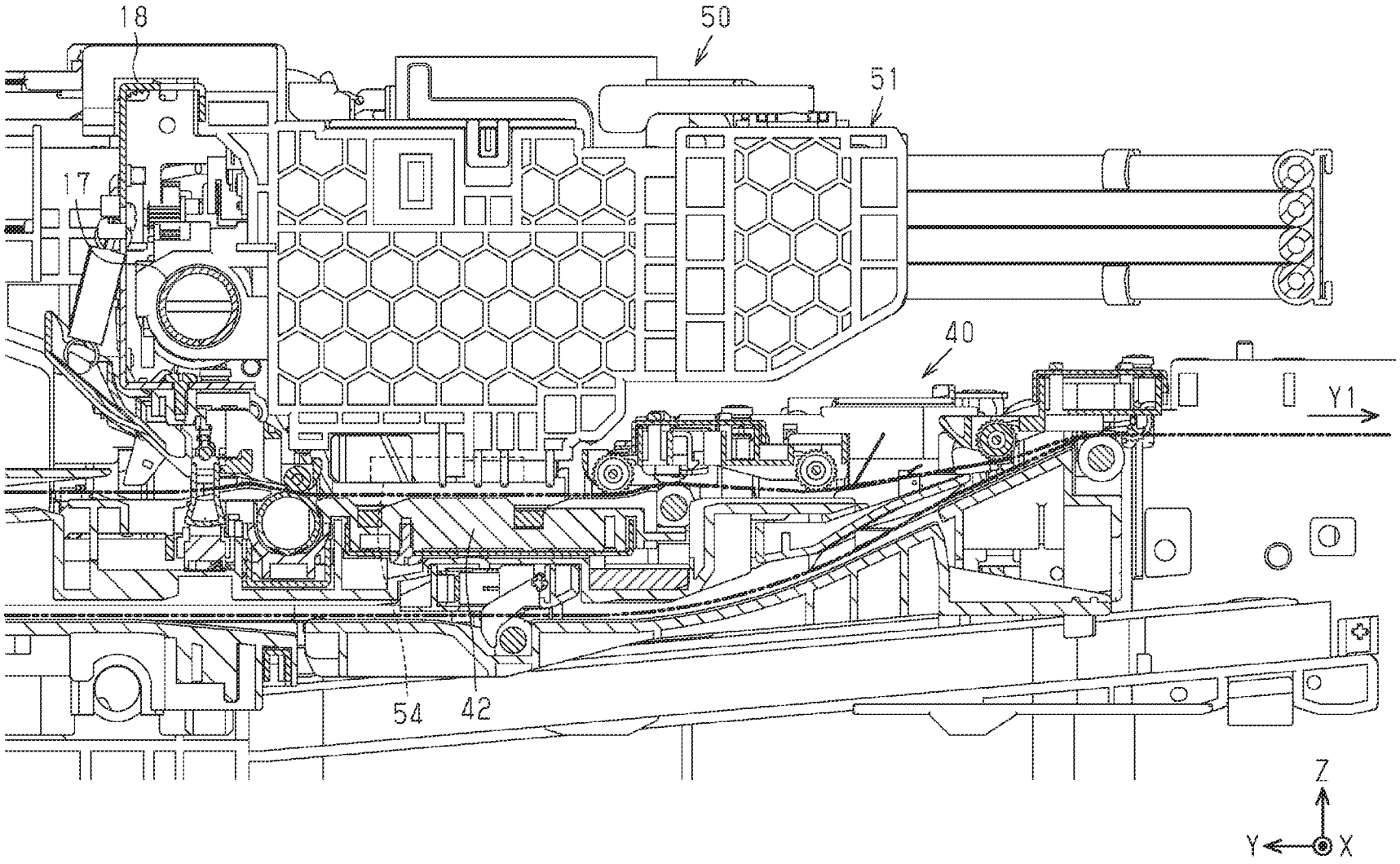
FIG. 3 is a side sectional view illustrating a periphery of a carriage unit broken along the line in FIG. 2.

As illustrated in FIG. 2, the carriage unit 50 includes a carriage 51 and a liquid ejection head 54 mounted on the carriage 51 and ejecting a liquid onto the medium M as illustrated in FIG. 3. The liquid ejection apparatus 11 is configured such that the liquid ejection head 54 ejects the liquid stored in the liquid storage body 28. A carriage motor 52, which is a drive source of the carriage unit 50, is disposed behind one end of a movement path of the carriage unit 50 in the liquid ejection apparatus 11. A drive force of the carriage motor 52 is transmitted to the carriage unit 50 via an endless timing belt 53. The timing belt 53 is wound around a pair of pulleys (not illustrated) and stretched along a first guide member 17 to extend in the scanning direction X. One pulley is connected to an output shaft of the carriage motor 52. The carriage unit 50 and the carriage motor 52 are controlled by the control section 70 illustrated in FIG. 1.

As illustrated in FIG. 3, the carriage unit 50 having the liquid ejection head 54 on a surface thereof on the −Z direction side is guided by each of the first guide member 17 and a second guide member 18, and is thus supported to be reciprocally movable in the scanning direction X intersecting the transport direction Y1 of the medium M. That is, when the carriage motor 52 is driven in forward and reverse directions, the carriage unit 50 having the liquid ejection head 54 is reciprocally moved in the scanning direction X along the first guide member 17 and the second guide member 18 arranged in the vertical direction Z.

As illustrated in FIG. 3, a support portion 42 that supports the medium M is disposed at a position on the −Z direction side facing the movement region of the liquid ejection head 54. An appropriate gap is secured between the medium M supported by the support portion 42 and the liquid ejection head 54. In the process of the carriage unit 50 reciprocally moving in the scanning direction X along the first guide member 17 and the second guide member 18, the liquid is ejected toward the medium M from a nozzle (not illustrated) of the liquid ejection head 54. As a result, an image or the like is printed on the medium M.

The control section 70 illustrated in FIG. 1 controls the liquid ejection head 54 for ejecting the liquid onto the medium M. In order for the control section 70 to control the liquid ejection head 54, the control section 70 and the liquid ejection head 54 are coupled to each other via a flexible flat cable (not illustrated).

In FIG. 2, the carriage unit 50 is located at the home position HP to stand by during non-recording in which recording is not performed on the medium M. As illustrated in FIG. 2, in the present embodiment, a position where the carriage unit 50 is located at the end opposite to the disposition position of the liquid supply unit 27 in the scanning direction X is the home position HP. A position of the end opposite to the home position HP in the scanning direction X is an anti-home position AH of the carriage 51. When recording is performed on the medium M, the carriage 51 is reciprocally moved in a recording region corresponding to a length of the medium M in the scanning direction X within a movable range between the home position HP and the anti-home position AH.

As illustrated in FIG. 2, the above-described liquid storage body 28 mounted on the liquid ejection apparatus 11 can store a liquid supplied to the liquid ejection head 54 illustrated in FIG. 3 in the liquid supply unit 27, and is provided at a position separated from the carriage 51. In the present embodiment, the liquid storage body 28 that supplies the liquid to the carriage unit 50 is disposed at an installation position on the anti-home position AH side opposite to the home position HP of the carriage unit 50.

When the user opens the upper cover 13 illustrated in FIG. 1, the carriage unit 50 illustrated in FIG. 2 is exposed. More specifically, when the carriage unit 50 is located at the home position HP illustrated in FIG. 2 to stand by during non-recording in which recording is not performed on the medium M, the user can access the liquid ejection head 54 illustrated in FIG. 3 mounted on the carriage unit 50 by opening the upper cover 13. Consequently, the user can perform work of detaching the liquid ejection head 54 from the carriage unit 50 and attaching a new liquid ejection head thereto.

Figure 4:
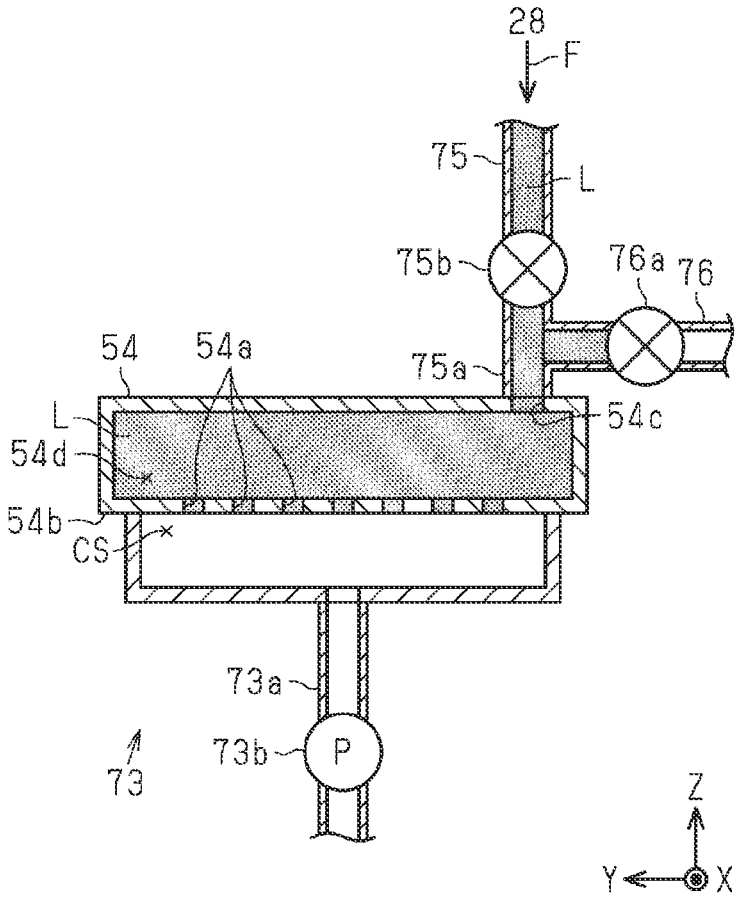
FIG. 4 is a schematic view illustrating a liquid flow path from a liquid storage body to a flow path in a head.

As illustrated in FIG. 2, the liquid ejection apparatus 11 includes a maintenance section 71 that performs cleaning or the like as maintenance of the liquid ejection head 54 at a position directly under the carriage unit 50 that has moved to a position deviated from the transport region TA in which the support portion 42 is disposed in the −X direction. The liquid ejection apparatus 11 includes a gap adjustment mechanism 72 that changes a height position of the liquid ejection head 54 with respect to the support portion 42 to adjust a gap between the liquid ejection head 54 and the medium M according to the type of the medium M. The maintenance section 71 and the gap adjustment mechanism 72 are controlled by the control section 70 illustrated in FIG. 1. Configuration of maintenance section As illustrated in FIG. 4, the liquid ejection head 54 includes a nozzle surface 54*b* having a plurality of nozzles 54*a* ejecting liquids L. As described above, the liquid ejection apparatus 11 includes the maintenance section 71 that performs cleaning or the like of the nozzles 54*a* as maintenance of the liquid ejection head 54 at the position directly under the carriage unit 50 that has moved to the position deviated from the transport region TA in which the support portion 42 is disposed in the −X direction. The maintenance section 71 includes a wiper unit (not illustrated), a flushing unit (not illustrated), and a cap unit (not illustrated). In the present embodiment, the cap unit, the wiper unit, and the flushing unit are located along with the support portion 42 illustrated in FIG. 3 in the scanning direction X at a position in the depth direction Y facing the nozzle surface 54*b* of the liquid ejection head 54. An order in which these three units are arranged is not limited.

As illustrated in FIG. 4, the cap unit has a cap portion 73. The nozzle surface 54*b* of the liquid ejection head 54 faces the cap portion 73 when the carriage unit 50 is further located at the home position HP illustrated in FIG. 2 at the position deviated from the transport region TA in the −X direction. The cap portion 73 is moved between a contact position illustrated in FIG. 4 in contact with the liquid ejection head 54 at the home position HP and a retreat position away from the liquid ejection head 54 in the −Z direction. The cap portion 73 located at the contact position comes into contact with the liquid ejection head 54 so as to surround the nozzles 54*a* and forms a closed space CS surrounding the nozzles 54*a*. That is, the cap portion 73 caps the liquid ejection head 54. The closed space CS formed through the capping suppresses drying of the liquid L in the nozzles 54*a*.

The cap portion 73 is coupled to a suction pump 73*b* via a discharge flow path 73*a*. When the suction pump 73*b* is driven in a state in which the cap portion 73 caps the liquid ejection head 54, a negative pressure is generated in the cap portion 73. The thickened liquid L, air bubbles, and the like are discharged from the nozzles 54*a* due to the action of the negative pressure generated in the cap portion 73. The liquid L being forced to be discharged from the nozzles 54*a* through suction in this way is also referred to as suction cleaning.

The wiper unit (not illustrated) has a wiping member configured to remove the liquid L adhering to the nozzle surface 54*b*. The wiper unit wipes the nozzle surface 54*b* of the liquid ejection head 54 with the wiping member. The term "wiping" is an operation of wiping the nozzle surface 54*b* in order to remove the liquid L or dirt such as dust adhering to the nozzle surface 54*b* of the liquid ejection head 54.

The flushing unit (not illustrated) has a liquid storing portion (not illustrated) that stores the liquid L ejected by the liquid ejection head 54. The term "flushing" is an operation of ejecting the liquid L from the nozzles 54*a* regardless of a recording process for the purpose of preventing and eliminating clogging of the nozzles 54*a* of the liquid ejection head 54. Configuration of liquid flow path of liquid ejection head As illustrated in FIG. 4, the liquid ejection head 54 includes a first in-head flow path 54*d* communicating a supply coupling portion 54*c* with the plurality of nozzles 54*a*. The liquid ejection apparatus 11 includes a first liquid supply flow path 75 as an example of a supply flow path along which the liquid L from the liquid storage body 28 is supplied to the liquid ejection head 54. In the present embodiment, the first liquid supply flow path 75 includes a portion composed of a flexible tube. An upstream end (not illustrated) of the first liquid supply flow path 75 is coupled to the liquid storage body 28.

In the present embodiment, a flow direction F of the liquid L refers to a passing direction of the liquid L from the liquid storage body 28 to the liquid ejection head 54. A downstream refers to the flow direction F side from a reference position, and an upstream refers to a side opposite to the flow direction F from the reference position.

A downstream end 75*a* of the first liquid supply flow path 75 is attachably and detachably coupled to the supply coupling portion 54*c* of the liquid ejection head 54. The downstream end 75*a* may be an end of a flexible tube, and may be a joint that can be easily attached to and detached from the supply coupling portion Mc.

The liquid ejection apparatus 11 includes a first opening/closing valve 75*b* as an example of an opening/closing mechanism capable of opening and closing the first liquid supply flow path 75. That is, the first opening/closing valve 75*b* as an example of an opening/closing mechanism opens and closes the first liquid supply flow path 75 as an example of a supply flow path. The first opening/closing valve 75*b* may be coupled to the liquid ejection head 54 side by a half or more of a total length of the first liquid supply flow path 75 from the viewpoint of reducing a volume of the first liquid supply flow path 75 from the first opening/closing valve 75*b* to the liquid ejection head 54, and may more preferably be coupled to the vicinity of the downstream end 75*a*. When the first opening/closing valve 75*b* is opened, the liquid ejection head 54 and the liquid storage body 28 are communicated with each other. When the first opening/closing valve 75*b* is closed, the liquid ejection head 54 and the liquid storage body 28 are shut off.

The liquid ejection apparatus 11 includes a first atmosphere communication path 76 capable of communicating the first liquid supply flow path 75 with the atmosphere. The first atmosphere communication path 76 is coupled to the downstream of the first opening/closing valve 75*b* in the first liquid supply flow path 75.

The liquid ejection apparatus 11 includes a first atmosphere opening valve 76*a* capable of opening and closing the first atmosphere communication path 76. The first atmosphere opening valve 76*a* is coupled to the first atmosphere communication path 76. When the first atmosphere opening valve 76*a* is opened, the first liquid supply flow path 75 is communicated with the atmosphere. When the first atmosphere opening valve 76*a* is closed, the first liquid supply flow path 75 is shut off from the atmosphere.

In the present embodiment, as described above, the liquid supply unit 27 accommodates the plurality of liquid storage bodies 28 each storing the liquid L such as ink. The plurality of liquid storage bodies 28 store inks with different colors such as black, cyan, magenta, and yellow. That is, in the present embodiment, since there are four types of liquids L used for recording, the liquid ejection head 54 has the first in-head flow path 54*d*, a second in-head flow path (not illustrated), a third in-head flow path (not illustrated), and a fourth in-head flow path (not illustrated) as four in-head flow paths for the four types of liquids L.

The liquid ejection head 54 has the first liquid supply flow path 75, a second liquid supply flow path (not illustrated), a third liquid supply flow path (not illustrated), and a fourth liquid supply flow path (not illustrated) as supply flow paths for the respective in-head flow paths. The liquid ejection head 54 has the first opening/closing valve 75*b*, a second opening/closing valve (not illustrated), a third opening/closing valve (not illustrated), and a fourth opening/closing valve (not illustrated) as opening/closing valves capable of opening and closing the supply flow paths for the respective in-head flow paths. The liquid ejection head 54 has the first atmosphere communication path 76, a second atmosphere communication path (not illustrated), a third atmosphere communication path (not illustrated), and a fourth atmosphere communication path (not illustrated) as atmosphere communication paths for the respective in-head flow paths. The liquid ejection head 54 has the first atmosphere opening valve 76*a*, a second atmosphere opening valve (not illustrated), a third atmosphere opening valve (not illustrated), and a fourth atmosphere opening valve (not illustrated) as atmosphere opening valves capable of opening and closing the atmosphere communication paths for the respective in-head flow paths.

In the present embodiment, since the flow paths of the four types of liquids from the liquid storage bodies 28 to the in-head flow paths of the liquid ejection head 54 have the same configuration, a flow path of one type of liquid L will be described. Therefore, the description of the flow paths of the other liquids L will be omitted.

Liquid Ejection Head Replacement Flow

In the present embodiment, the liquid ejection head 54 that ejects the liquid L is detachably attached by a user. That is, the liquid ejection apparatus 11 has a configuration in which the liquid ejection head 54 can be replaced by the user. The liquid ejection head replacement flow includes an operation of removing a liquid in the liquid ejection head 54 illustrated in FIG. 5, a step of checking whether or not the liquid ejection head 54 has been replaced, an operation of filling the liquid ejection head 54 with a liquid illustrated in FIG. 6, and a maintenance step of the liquid ejection head 54 illustrated in FIG. 7.

The control section 70 may display a replacement procedure of the liquid ejection head 54 on the display section 26 as one of the liquid ejection head replacement flows. That is, the control section 70 may be able to perform the liquid ejection head replacement flow that is a flow for attaching a new liquid ejection head 54 requested and delivered according to a delivery flow described later. In the present embodiment, the operation of removing a liquid in the liquid ejection head 54 and the operation of filling the new liquid ejection head 54 with a liquid are automatically performed by the control section 70. Thus, the control section 70 may display a progress status of the liquid ejection head replacement flow on the display section 26, and may also display a message for prompting the user to perform replacement with the new liquid ejection head on the display section 26 at a timing at which the operation of removing a liquid in the liquid ejection head 54 is completed. When the liquid ejection apparatus 11 does not include the display section 26, or when a display area of the display section 26 is small, the user may use an application program or the like in a PC or a mobile terminal to display a progress status of the liquid ejection head replacement procedure or the liquid ejection head replacement flow on a screen of the PC or the mobile terminal.

First, with reference to a flowchart of FIG. 5, a description will be made of an example of the operation of removing a liquid in the liquid ejection head 54, performed by the control section 70 before the user replaces the liquid ejection head 54.

Figure 5:
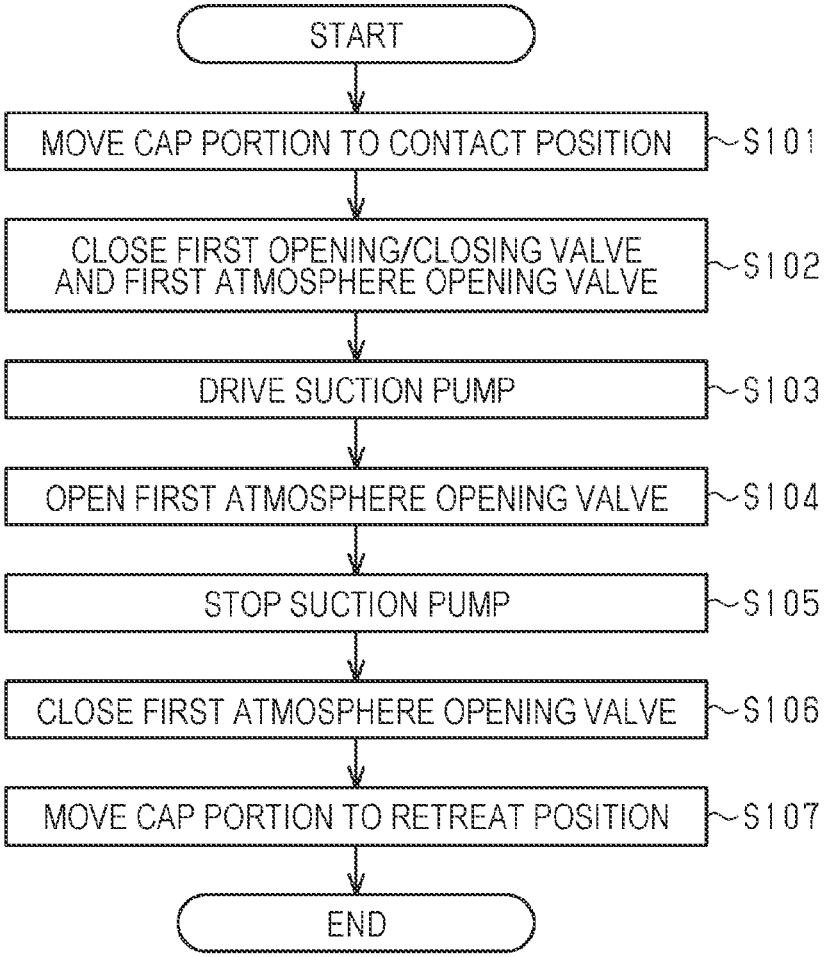
FIG. 5 is a flowchart illustrating a liquid discharge process executed by a control section.

As illustrated in FIG. 5, the control section 70 controls the constituents of the liquid ejection apparatus 11 to perform the operation of removing a liquid in the liquid ejection head 54 by executing a discharge process described below. It is assumed that the first atmosphere opening valve 76*a* is opened at the start of the liquid removal operation.

When the operation of removing a liquid in the liquid ejection head 54 is performed, the carriage unit 50 is located at the home position HP illustrated in FIG. 2. That is, the nozzle surface 54*b* of the liquid ejection head 54 faces the cap portion 73.

In step S101, the control section 70 controls the movement mechanism of the cap unit to move the cap portion 73 from the retreat position to the contact position illustrated in FIG. 4. When the cap portion 73 is located at the contact position, the cap portion 73 comes into contact with the liquid ejection head 54. Consequently, the closed space CS is formed in the portion where the plurality of nozzles 54*a* are opened. When the cap portion 73 is located at the contact position at the start of the liquid removal operation, step S101 may be skipped.

In step S102, the control section 70 closes the first opening/closing valve 75*b* and the first atmosphere opening valve 76*a*. That is, step S102 is a step in which the first opening/closing valve 75*b* as an example of an opening/closing mechanism closes the first liquid supply flow path 75 as an example of a supply flow path, and the first atmosphere opening valve 76*a* closes the first atmosphere communication path 76.

In step S103, the control section 70 drives the suction pump 73*b*. Consequently, the suction pump 73*b* sucks the liquid L in the closed space CS and discharges the liquid L to a waste liquid storage portion (not illustrated). The control section 70 stands by while driving the suction pump 73*b* until a first specified time, which is an example of a predetermined time, elapses. When the first specified time elapses, the control section 70 proceeds to a process in step S104. The first specified time mentioned here is, for example, the time required for the pressure in the closed space CS to drop from −50 kPa to −95 kPa by driving the suction pump 73*b*.

In step S104, the control section 70 opens the first atmosphere opening valve 76*a*. In step S104, the control section 70 stands by while driving the suction pump 73*b* until the specified time elapses after the first atmosphere opening valve 76*a* is opened. That is, the liquid ejection apparatus 11 continues suction with the suction pump 73*b* even after the first atmosphere opening valve 76*a* is opened. When the specified time has elapsed, the control section 70 proceeds to step S105. The specified time mentioned here is, for example, the time required to discharge the liquid L from the first opening/closing valve 75*b* to the nozzles 54*a*. Driving of the suction pump 73*b* may be stopped at the same time as opening the first atmosphere opening valve 76*a*, or may be stopped before opening the first atmosphere opening valve 76*a*.

In step S105, the control section 70 stops the suction pump 73*b*. The processes in steps S101 to S105 correspond to a discharge operation of discharging the liquid L in the liquid ejection head 54.

In step S106, the control section 70 closes the first atmosphere opening valve 76*a*. That is, the liquid ejection apparatus 11 closes the first atmosphere opening valve 76*a* after the discharge operation is finished.

In step S107, the control section 70 controls the movement mechanism of the cap unit such that the cap portion 73 is moved from the contact position illustrated in FIG. 4 to the retreat position. Consequently, the liquid removal operation is finished.

As described above, the liquid ejection apparatus 11 performs suction for a predetermined time with the suction pump 73*b* in a state in which the first opening/closing valve 75*b* and the first atmosphere opening valve 76*a* are closed, and then opens the first atmosphere opening valve 76*a*, prior to detaching the liquid ejection head 54 from the downstream end 75*a* of the first liquid supply flow path 75. Consequently, the liquid ejection apparatus 11 executes the discharge operation of discharging the liquid L in the liquid ejection head 54. As a result, the liquid L in the liquid ejection head 54 is hardly left, and thus the user can detach the liquid ejection head 54 from the liquid ejection apparatus 11.

In the present embodiment, the closing operation for the first opening/closing valve 75*b* and the opening/closing operation for the first atmosphere opening valve 76*a* are automatically performed by the control section 70, but may be manually performed by the user. In this case, it is desirable that the control section 70 displays a step of the liquid removal operation on the display section 26, and performs display for prompting a closing operation for the first opening/closing valve 75*b* and an opening operation and a closing operation for the first atmosphere opening valve 76*a* on the display section 26 at the time of a step in which an opening/closing operation for each valve is required.

The routine illustrated in FIG. 5 is a routine related to a discharge operation in which the liquid ejection apparatus 11 discharges one type of liquid from the liquid ejection head 54. In the present embodiment, as described above, the liquid supply unit 27 included in the liquid ejection apparatus 11 stores a plurality of liquid storage bodies 28 respectively storing a plurality of types of liquids L. The liquids L stored in the plurality of liquid storage bodies 28 are respectively supplied to the in-head flow paths of the liquid ejection head 54. Thus, the liquid ejection apparatus 11 similarly executes the discharge operation of discharging all the liquids L supplied to the liquid ejection head 54. As a result, all the liquids L in the liquid ejection head 54 are hardly left, and thus the user can detach the used liquid ejection head 54 from the carriage unit 50 included in the liquid ejection apparatus 11. The user can attach a new unused liquid ejection head 54 to the carriage unit 50 included in the liquid ejection apparatus 11.

Next, with reference to a flowchart of FIG. 6, a description will be made of an example of an operation of filling the new liquid ejection head 54 with a liquid, performed by the control section 70 after the user replaces the liquid ejection head 54.

Figure 6:
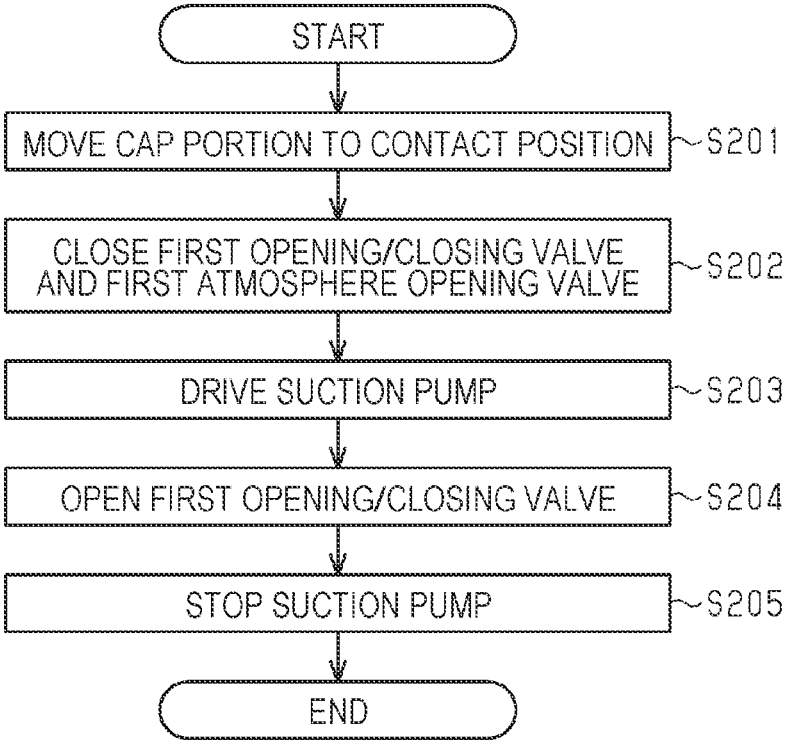
FIG. 6 is a flowchart illustrating a liquid resupply process executed by the control section.

As illustrated in FIG. 6, the control section 70 controls the constituents of the liquid ejection apparatus 11 to perform the operation of filling the liquid ejection head 54 with a liquid by executing a resupply process.

In step S201, the control section 70 controls the movement mechanism of the cap unit such that the cap portion 73 is moved from the retreat position to the contact position illustrated in FIG. 4. When the cap portion 73 is located at the contact position, the cap portion 73 comes into contact with the liquid ejection head 54. Consequently, the closed space CS in which the openings of the plurality of nozzles 54*a* are communicated with each other is formed.

In step S202, the control section 70 closes the first opening/closing valve 75*b* and the first atmosphere opening valve 76*a*. When the liquid filling operation is performed following the liquid removal operation for the liquid ejection head 54, this step is unnecessary because the first opening/closing valve 75*b* and the first atmosphere opening valve 76*a* are already closed.

In step S203, the control section 70 drives the suction pump 73*b*. Consequently, the suction pump 73*b* sucks the liquid L in the closed space CS and discharges the liquid L to a waste liquid storage portion (not illustrated). The control section 70 stands by while driving the suction pump 73*b* until a second specified time elapses. When the second specified time elapses, the control section 70 proceeds to a process in step S204. Here, the second specified time is, for example, the time required for the pressure in the closed space CS to drop from −50 kPa to −95 kPa by driving the suction pump 73*b*.

In step S204, the control section 70 opens the first opening/closing valve 75*b*. In step S204, the control section 70 stands by while driving the suction pump 73*b* until the specified time elapses after the first opening/closing valve 75*b* is opened. That is, the liquid ejection apparatus 11 continues suction by the suction pump 73*b* even after the first opening/closing valve 75*b* is opened. When the specified time has elapsed, the control section 70 proceeds to step S205. The specified time mentioned here is, for example, the time required to perform filling with the liquid L from the first opening/closing valve 75*b* to the nozzles 54*a*. Driving of the suction pump 73*b* may be stopped at the same time as opening the first opening/closing valve 75*b*, or may be stopped before opening the first opening/closing valve 75*b*.

In step S205, the control section 70 stops the suction pump 73*b*. The processes in steps S201 to S205 correspond to the resupply operation of supplying the liquid L to the liquid ejection head 54. Consequently, the liquid filling operation is finished.

As described above, in the liquid ejection apparatus 11 closes the first opening/closing valve 75*b* and the first atmosphere opening valve 76*a* after the user detaches the liquid ejection head 54 and couples the new liquid ejection head 54 to the downstream end 75*a* of the first liquid supply flow path 75. In this state, the liquid ejection apparatus 11 sucks the liquid with the suction pump 73*b* for a predetermined time, and then opens the first opening/closing valve 75*b*. Consequently, the liquid ejection apparatus 11 executes the resupply operation of supplying the liquid L into the liquid ejection head 54.

In the present embodiment, the opening/closing operation for the first opening/closing valve 75*b* and the closing operation for the first atmosphere opening valve 76*a* are automatically performed by the control section 70, but may be manually performed by the user. In this case, it is desirable that the control section 70 displays a step of the liquid filling operation on the display section 26, and performs display for prompting an opening operation and a closing operation for the first opening/closing valve 75*b* and a closing operation for the first atmosphere opening valve 76*a* on the display section 26 at the time of a step in which an opening/closing operation for each valve is required.

The routine illustrated in FIG. 6 is a routine related to the liquid filling operation in which the liquid ejection apparatus 11 fills the liquid ejection head 54 with one type of liquid. In the present embodiment, as described above, the liquid supply unit 27 included in the liquid ejection apparatus 11 stores a plurality of liquid storage bodies 28 respectively storing a plurality of types of liquids L. The liquids L stored in the plurality of liquid storage bodies 28 are respectively supplied to the in-head flow paths of the liquid ejection head 54. Thus, the liquid ejection apparatus 11 similarly executes the liquid filling operation of performing filling with all the liquids L supplied to the liquid ejection head 54.

After the liquid filling operation, it is desirable that an operation of discharging the liquid L in the cap portion 73 or an operation of cleaning the nozzle surface 54*b* is performed as maintenance of the liquid ejection head 54. Thus, the liquid ejection head replacement flow includes a maintenance step in which the maintenance section 71 performs maintenance of the liquid ejection head 54. There are two types of maintenance such as automatic maintenance and manual maintenance. Maintenance that is automatically performed by the control section 70 based on information from each constituent of the liquid ejection apparatus 11 without any intervention of a user's operation is referred to as the automatic maintenance. Maintenance performed by the control section 70 in response to the user's start instruction from the operation section 25 is referred to as the manual maintenance.

In the manual maintenance, the control section 70 starts a maintenance flow on the display section 26. For example, first, the control section 70 allows the user to press a button for starting the manual maintenance. When the manual maintenance is finished, the control section 70 may display, on the display section 26, a method of starting nozzle check printing following the manual maintenance. The nozzle check printing is a process in which the control section 70 causes the liquid ejection apparatus 11 to print a specific test pattern on the medium M in order for the user to check the presence or absence of defective ejection in the nozzles 54*a* of the liquid ejection head 54. When the nozzle check printing is finished, the control section 70 displays a selection screen including "recovered" and "not recovered" from a problem related to ejection on the display section 26, and allows the user to select either of the two. The control section 70 performs a process corresponding to the result selected by the user. When the user selects "not recovered", the control section 70 may display, on the display section 26, a selection screen regarding whether or not the maintenance flow is started again on the display section 26.

Also in the automatic maintenance, the maintenance flow may be automatically executed. For example, when the automatic maintenance is finished, the control section 70 automatically performs the nozzle check printing. When the nozzle check printing is finished, the control section 70 may display a selection screen including "recovered" and "not recovered" from a problem related to ejection on the display section 26, and allow the user to select either of the two. The control section 70 may perform a process corresponding to the result selected by the user.

Figure 7:
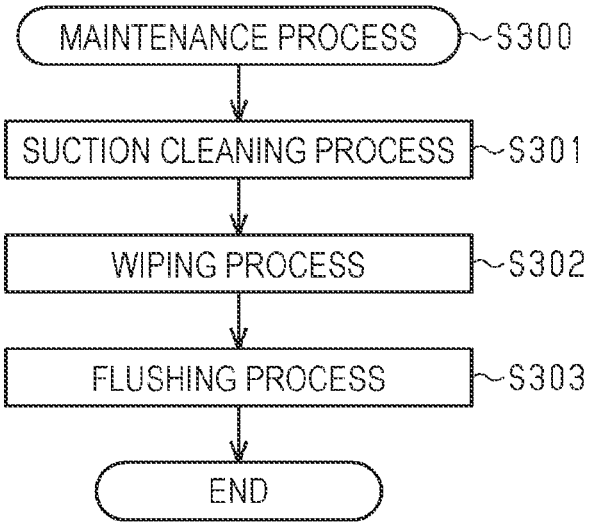
FIG. 7 is a flowchart illustrating a maintenance process executed by the control section.

In both the automatic maintenance and the manual maintenance, processes in the flowchart of FIG. 7 are performed by the control section 70. In the present embodiment, the automatic maintenance is performed after the liquid filling operation. A subroutine of the maintenance step for the liquid ejection head 54 will be described with reference to the flowchart of FIG. 7.

In step S301, the control section 70 executes suction cleaning. The suction cleaning is an operation of sucking air bubbles or foreign substances in the nozzle 54*a* together with the liquid L from the nozzle 54*a*. The control section 70 performs suction with the suction pump 73*b* for a predetermined time in which the carriage unit 50 is moved to the home position HP and the cap portion 73 is located at the contact position. When the suction is finished, the control section 70 moves the cap portion 73 to the retreat position.

When the suction cleaning is executed, the liquid L discharged from the nozzle 54*a* may adhere to the nozzle surface 54*b* of the liquid ejection head 54. Thus, wiping may be executed after the suction cleaning is executed. Consequently, the liquid L adhering to the nozzle surface 54*b* through the suction cleaning can be removed through the wiping.

In step S302, the control section 70 executes the wiping after performing the suction cleaning. The control section 70 moves the carriage unit 50 to a wiping position and executes the wiping. When the wiping is executed by the wiping member, foreign substances, air bubbles, or the like adhering to the liquid ejection head 54 may be pushed into the nozzle 54*a*. In this case, there is concern that the meniscus in the nozzle 54*a* may be destroyed, or defective ejection of the nozzle 54*a* may occur. Thus, after the wiper unit executes the wiping, the control section 70 may cause the flushing unit to execute flushing.

In step S303, the control section 70 moves the carriage unit 50 to a flushing position and causes the flushing unit to perform flushing. Consequently, foreign substances mixed in the nozzle 54*a* can be discharged, or the meniscus in the nozzle 54*a* can be adjusted.

Figure 8:
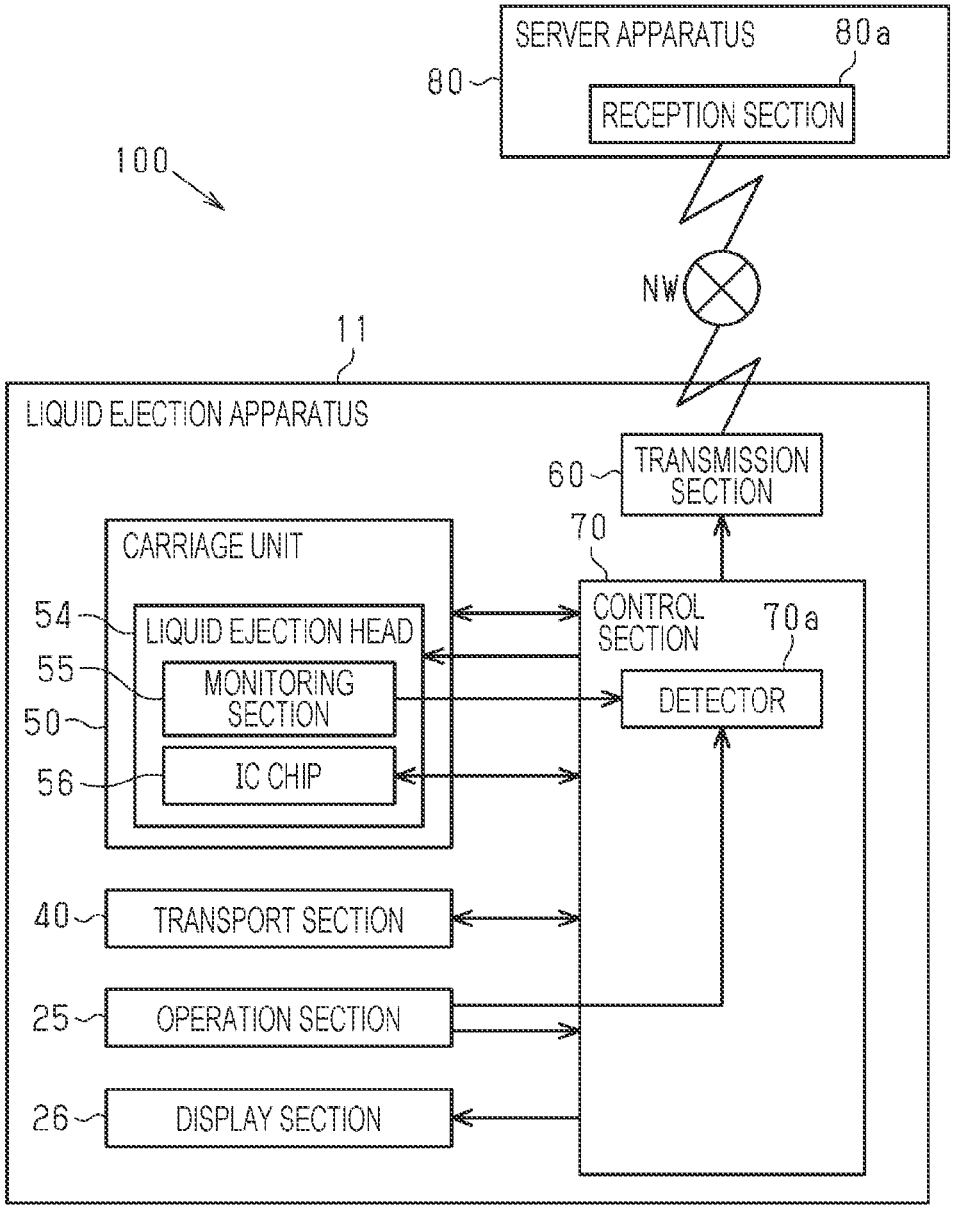
FIG. 8 is a block diagram illustrating a delivery system for a liquid ejection head.

In the present embodiment, after the liquid ejection head 54 is replaced and the liquid filling operation is performed, the suction cleaning, the wiping, and the flushing are performed as maintenance of the liquid ejection head 54, but only the suction cleaning may be performed. When the liquid filling operation includes the suction cleaning function, the control section 70 does not have to perform the suction cleaning after the liquid filling operation. Detector that detects defective ejection As illustrated in FIG. 8, in the present embodiment, the carriage unit 50 included in the liquid ejection apparatus 11 has a monitoring section 55 that monitors an ejection state in the liquid ejection head 54.

The monitoring section 55 may employ various monitoring methods. In the present embodiment, a method of acquiring residual vibration information of a liquid chamber in the liquid ejection head 54 is employed. As an example, in the liquid ejection head 54 having a piezoelectric element (not illustrated), the monitoring section 55 outputs a drive signal for changing a volume of the liquid chamber within a range in which the liquid L is not ejected from the nozzle 54*a* illustrated in FIG. 4 to the piezoelectric element, and monitors an ejection state of the liquid L at each nozzle by acquiring the residual vibration information of the liquid chamber detected by the piezoelectric element.

As a monitoring method, other methods may be employed. For example, a method may be employed in which the liquid L ejected from the nozzle 54*a* illustrated in FIG. 4 of the liquid ejection head 54 is irradiated with light from a light source to generate scattered light, and it is determined whether or not ejection is normal by acquiring a value of an output voltage from a light receiving element that receives the scattered light. A method may be employed in which the liquid L ejected from each nozzle 54*a* of the liquid ejection head 54 is ejected onto an electrostatic sensor, and it is determined whether or not ejection from each nozzle 54*a* is normal by acquiring a value of a capacitance from a capacitance detector of the electrostatic sensor. A method may be employed in which nozzle check printing is executed in response to a user's instruction from the operation section 25 or by the control section 70 periodically, the user determines whether or not ejection is normal based on a printing result of the nozzle check printing, the determination result is input by the operation section 25, and the control section 70 acquires the determination result from the operation section 25.

In the present embodiment, the control section 70 includes a detector 70*a* having a function of detecting defective ejection of the liquid ejection head 54. The monitoring section 55 monitors whether or not defective ejection has occurred in the liquid ejection head 54 at all times, and notifies the detector 70*a* of a monitoring result. The control section 70 executes the automatic maintenance of the liquid ejection head 54 by the maintenance section 71 illustrated in FIG. 2 in accordance with the result of which the detector 70*a* is notified from the monitoring section 55. That is, the control section 70 performs the automatic maintenance that causes the maintenance section 71 to automatically perform maintenance when the detector 70*a* detects defective ejection.

The detector 70*a* detects a problem related to ejection of the liquid ejection head 54. In the present embodiment, the detector 70*a* also detects a maintenance status of the liquid ejection head 54 executed by the maintenance section 71. When the detector 70*a* detects that the automatic maintenance has been repeatedly executed a predetermined number of times or more by the control section 70, it is determined that the liquid ejection head 54 has a problem related to ejection. More specifically, in the present embodiment, when it is detected that an operation of executing the automatic maintenance in accordance with a result of which a notification is sent from the monitoring section 55 after the whole of one print job is finished has been repeatedly executed a plurality of times, the detector 70*a* determines that a problem related to ejection has occurred. That is, the detector 70*a* detects that the automatic maintenance has been repeatedly executed a predetermined number of times or more as a problem related to ejection.

The detector 70*a* also determines that the liquid ejection head 54 has a problem related to ejection when it is detected that the manual maintenance has been repeatedly executed a predetermined number of times or more by the user. More specifically, in the present embodiment, when it is detected that an operation of the user executing the manual maintenance after the whole of one print job is finished has been repeatedly executed a plurality of times, the detector 70*a* determines that a problem related to ejection has occurred. That is, the detector 70*a* detects that the maintenance has been repeatedly executed by the user a predetermined number of times or more as a problem related to ejection.

In the present embodiment, when the user finds that the liquid ejection head 54 has a problem related to ejection, the user can operate a menu displayed on the display section 26 by using the operation section 25, to input the occurrence of a problem related to ejection from the operation section 25 as an example of an input section. That is, the liquid ejection apparatus 11 includes an input section that allows the user to input the occurrence of a problem related to ejection. The detector 70*a* determines that the liquid ejection head 54 has a problem related to ejection even when the user inputs the occurrence of the problem related to ejection by using the operation section 25.

Configuration of Delivery System

As illustrated in FIG. 8, the liquid ejection apparatus 11 includes a transmission section 60 that is controlled by the control section 70 to transmit a signal. The transmission section 60 is coupled to a network NW in a wireless or wired manner.

The control section 70 is configured to acquire model information regarding the liquid ejection head 54 and ejection-related problem history information of the liquid ejection head 54. The model information and the ejection-related problem history information are stored in an IC chip 56 included in the liquid ejection head 54. As will be described in detail later, the ejection-related problem history information is the number of times for which the automatic maintenance is repeatedly executed and the number of times for which the manual maintenance is repeatedly executed by the user. The control section 70 is electrically coupled to the IC chip 56 of the liquid ejection head 54 attached to the carriage unit 50.

The liquid ejection apparatus 11 configures a part of a delivery system 100. That is, the delivery system 100 includes the liquid ejection apparatus 11 and a server apparatus 80 on the network NW. The server apparatus 80 includes a reception section 80*a* that receives information transmitted from the transmission section 60 of the liquid ejection apparatus 11. The delivery system 100 may have a plurality of liquid ejection apparatuses 11, and the plurality of liquid ejection apparatuses 11 may be coupled to the server apparatus 80. Each liquid ejection apparatus 11 is communicably coupled to the server apparatus 80 via the network NW.

The liquid ejection head 54 in which a problem related to ejection has occurred needs to be replaced. When the detector 70*a* detects a problem related to ejection, the control section 70 may cause the transmission section 60 to transmit a delivery request for a new liquid ejection head to the server apparatus 80 via the network NW. The server apparatus 80 may cause the reception section 80*a* to receive the delivery request for the new liquid ejection head transmitted from the control section 70 via the network NW. That is, the server apparatus 80 has the reception section 80*a* that receives the delivery request for the new liquid ejection head transmitted from the control section 70.

The delivery system 100 delivers a new replacement liquid ejection head 54 to replace the liquid ejection head 54 that needs to be replaced in the liquid ejection apparatus 11 to a user using the liquid ejection apparatus 11. In this case, the control section 70 may cause the transmission section 60 to transmit a delivery request for a new liquid storage body to the server apparatus 80 via the network NW. That is, the server apparatus 80 may prepare for delivery of the new liquid storage body when receiving a request signal for the delivery of the new replacement liquid storage body transmitted from the liquid ejection apparatus 11.

Even when the control section 70 does not detect a problem related to ejection, the delivery system 100 may deliver the replacement liquid ejection head 54 to the user using the liquid ejection apparatus 11 in response to the user's instruction from the operation section 25. The delivery system 100 may deliver the new liquid storage body 28 to the user using the liquid ejection apparatus 11 in response to the user's instruction from the operation section 25.

Ejection-related problem determination process

With reference to a flowchart of FIG. 9, a description will be made of an example of control executed by the control section 70 in the "ejection-related problem determination process" for the liquid ejection head 54. The present routine is executed at a timing immediately after power of the liquid ejection apparatus 11 is turned on by operating the power switch 25*a* and an initialization operation for the liquid ejection apparatus 11 is performed, or is executed at a timing at which the liquid ejection head 54 is attached to the carriage unit 50 in a state in which the power is turned on.

Figure 11:
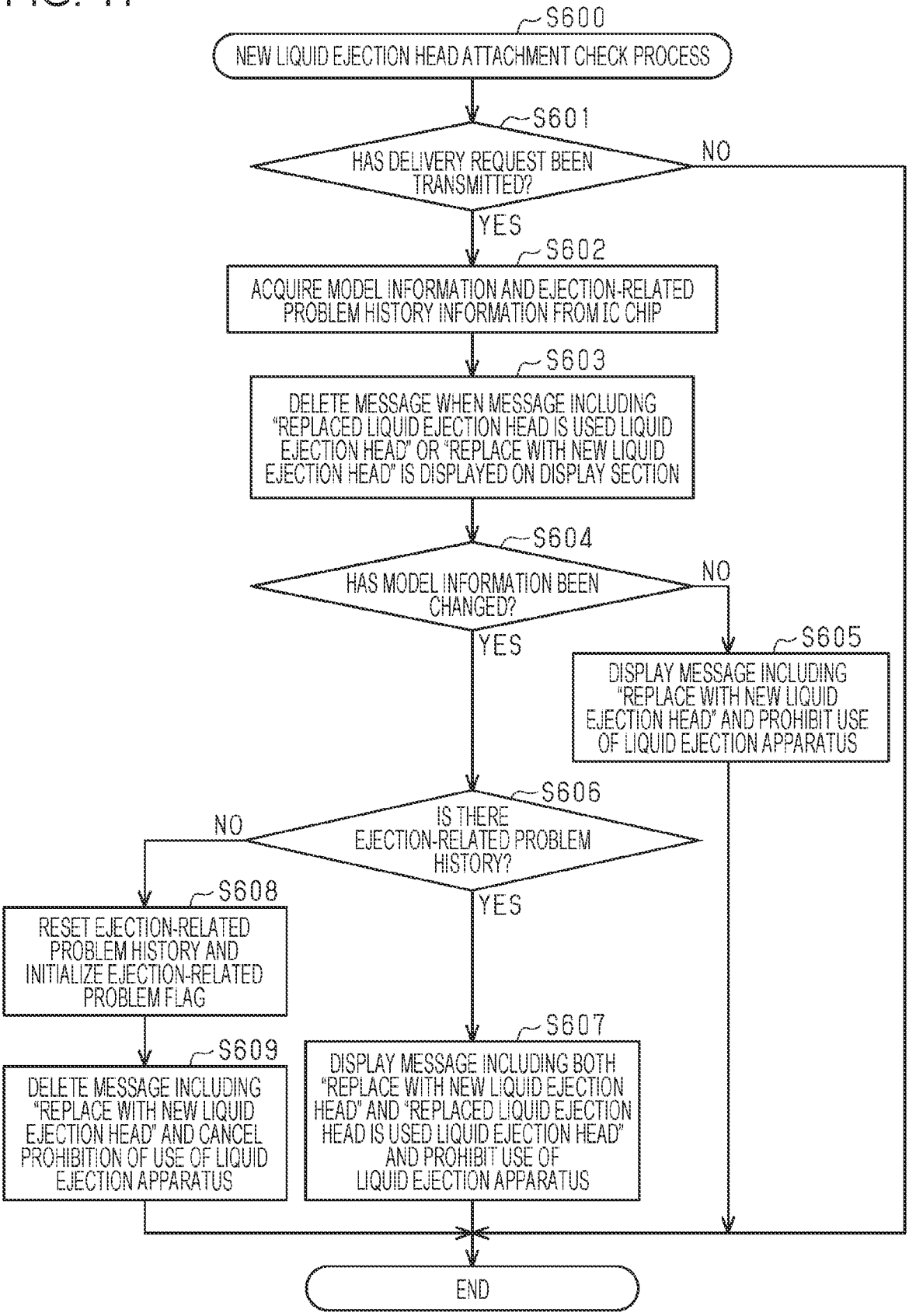
FIG. 11 is a flowchart illustrating a new liquid ejection head attachment check process.

In step S600, the control section 70 executes a subroutine of a "new liquid ejection head attachment check process" illustrated in FIG. 11. The subroutine of the "new liquid ejection head attachment check process" will be described later.

In step S401, the control section 70 determines whether or not ejection of the liquid ejection head 54 is determined as being normal. More specifically, the control section 70 determines whether or not a flag of "problem occurrence related to ejection" described later is set. In the liquid ejection head 54, when a problem related to ejection has already occurred, the power switch 25*a* may be temporarily turned off, and then the power switch 25*a* may be turned on again. Thus, the determination in this step S401 is required at the timing at which the power is turned on. That is, at the timing at which the power is turned on, the detector 70*a* of the control section 70 may determine that a problem related to ejection has already occurred. When the ejection of the liquid ejection head 54 is normal, a determination result in step S401 is YES, and the process proceeds to step S402. When the ejection of the liquid ejection head 54 is determined as not being normal, a determination result in step S401 is NO, and the process proceeds to step S407 described later.

In step S402, the control section 70 determines whether or not defective ejection of the liquid ejection head 54 is detected by the detector 70*a*. When defective ejection is detected, a determination result in step S402 is YES, and the process proceeds to step S403. When defective ejection is not detected, the determination result in step S402 is NO, and the process proceeds to step S408.

In step S403, the control section 70 causes the maintenance section 71 to start maintenance of the liquid ejection head 54 at a timing at which a print job is finished. The maintenance executed in this step is automatic maintenance performed automatically without any intervention of the user.

In step S300, the control section 70 executes the subroutine of the maintenance process illustrated in FIG. 7.

In step S404, the control section 70 adds 1 to the number of times for which the automatic maintenance is repeatedly executed at a timing at which the automatic maintenance is finished. The control section 70 has, for example, a rewritable memory therein, and reads a plurality of pieces of information in the IC chip 56 of the liquid ejection head 54 attached to the liquid ejection apparatus 11 and stores the information into the memory to share the information with the IC chip 56. The IC chip 56 stores, for example, the model information and the ejection-related problem history of the liquid ejection head 54. The model information is a model number, a serial number, or the like of the liquid ejection head 54, and is used for the control section 70 to identify the liquid ejection head 54. The control section 70 can determine whether or not the attached liquid ejection head 54 can be used in the liquid ejection apparatus 11 without any problem based on the model information. The ejection-related problem history is the number of times for which the automatic maintenance is repeatedly performed, the number of times for which the manual maintenance is repeatedly performed, and the like in the attached liquid ejection head 54.

When the automatic maintenance is performed for the first time in this step S404 after the new liquid ejection head 54 is attached to the liquid ejection apparatus 11, the numerical value "zero" stored in the IC chip 56 as the number of times for which the automatic maintenance is repeatedly executed is rewritten to 1. The control section 70 shares the numerical value in the internal memory and the numerical value in the IC chip 56 with the number of times for which the automatic maintenance is repeatedly executed as 1.

In the next print job after the automatic maintenance is performed, when the detector 70*a* does not detect defective ejection and the automatic maintenance is not performed, the numerical value "1" stored in the IC chip 56 as the number of times for which the automatic maintenance is repeatedly executed is rewritten to "zero". The control section 70 shares the numerical value in the internal memory and the numerical value in the IC chip 56 with the number of times for which the automatic maintenance is repeatedly executed as "zero". Thus, even when the liquid ejection head 54 has undergone the automatic maintenance in this step S404, the numerical value stored in the IC chip 56 may be "zero" as the number of times for which the automatic maintenance has been repeatedly performed. In the following description, the number of times for which the automatic maintenance is repeatedly performed will be referred to as the number of times of the automatic maintenance.

In step S405, the detector 70*a* of the control section 70 determines whether or not the number of times of the automatic maintenance has reached a first specified number of times N1. That is, the detector 70*a* detects that the automatic maintenance has been repeatedly executed a predetermined number of times or more as a problem related to ejection. When the number of times of the automatic maintenance has reached the first specified number of times N1, a determination result in step S405 is YES, and the process proceeds to step S406. When the number of times of the automatic maintenance has not reached the first specified number of times N1, a determination result in step S405 is NO, and the process proceeds to step S402. The first specified number of times N1 differs depending on the type of the liquid ejection head 54 and thus is not limited, but is, for example, three. The first specified number of times N1 may be more or less than three. In a case where the first specified number of times N1 is three, the determination result in step S405 is YES when the number of times of the automatic maintenance has reached three, and the process proceeds to step S406.

In step S406, the detector 70*a* of the control section 70 determines that the liquid ejection head 54 has a problem related to ejection. The control section 70 sets a flag of "problem occurrence related to ejection" in the rewritable memory therein. For example, a numerical value of a portion storing the presence or absence of "problem occurrence related to ejection" is rewritten from "zero" to 1. The control section 70 may also perform writing in the IC chip 56 of the liquid ejection head 54, and rewrite the numerical value of the portion storing the presence or absence of "problem occurrence related to ejection" from "zero" to 1, to share information between the internal memory of the control section 70 and the IC chip 56.

Then, in step S500, as the details will be described later, the control section 70 executes a subroutine of a check flow including a delivery request for a new liquid ejection head. That is, when the detector 70*a* detects a problem related to ejection in the liquid ejection head 54, the control section 70 starts a check flow including a delivery request for a new liquid ejection head.

In the present embodiment, instead of starting the above check flow, the control section 70 may automatically transmit a delivery request for a new liquid ejection head to the server apparatus 80 without starting the check flow when the detector 70*a* detects a problem related to ejection in the liquid ejection head 54.

Figure 9:
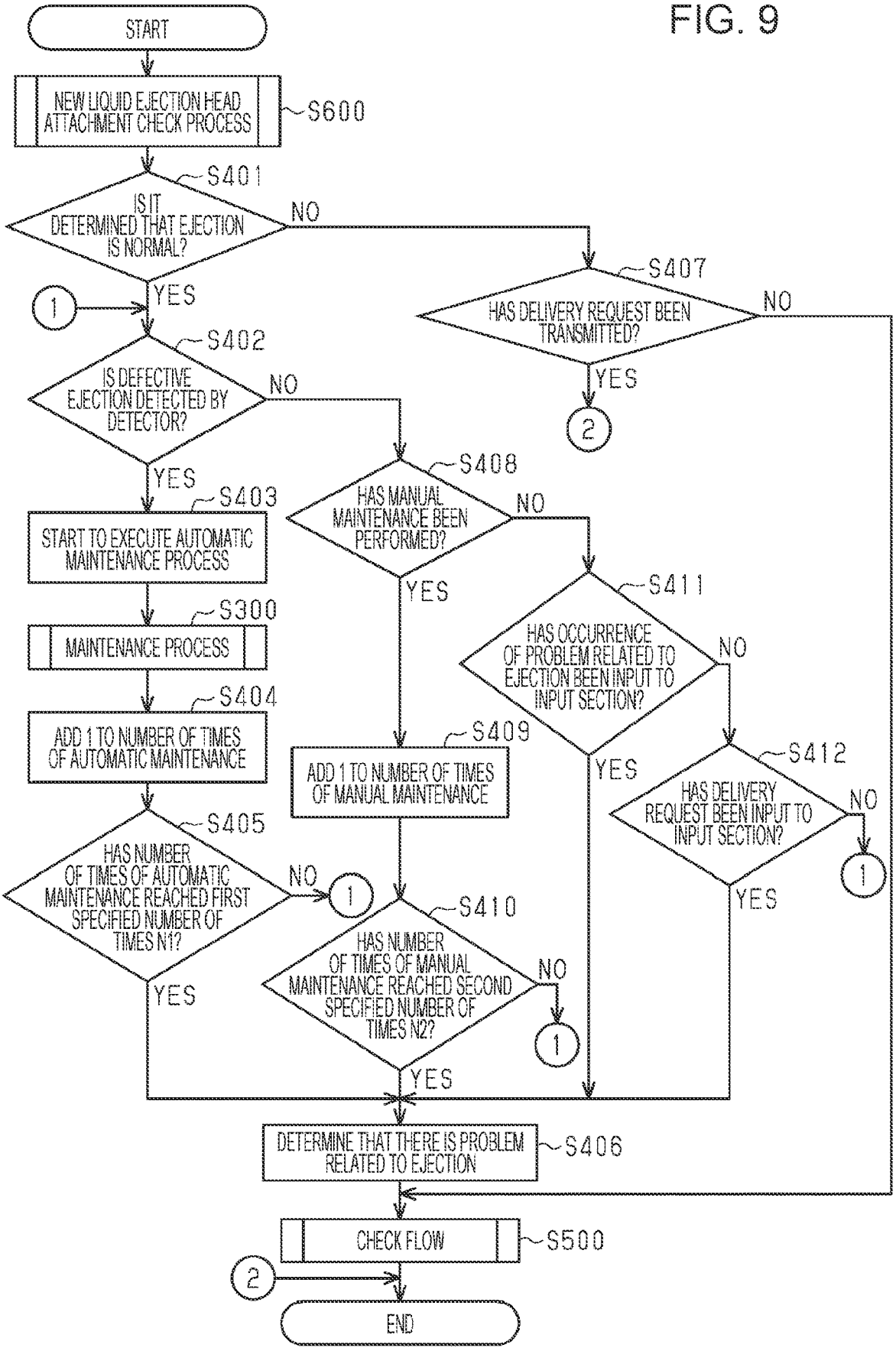
FIG. 9 is a flowchart illustrating an ejection-related problem determination process.

When the subroutine of the above check flow is finished, the control section 70 finishes the present flow illustrated in FIG. 9.

As described above, when the ejection of the liquid ejection head 54 is determined as not being normal in step S401, a determination result in step S401 is NO, and the process proceeds to step S407.

In step S407, the control section 70 determines whether or not the delivery request for the new liquid ejection head has been transmitted. When the delivery request for the new liquid ejection head has been transmitted, a determination result in step S407 is YES, and the control section 70 finishes the present flow illustrated in FIG. 9. That is, when the delivery request for the new liquid ejection head has already been transmitted, the control section 70 does not need to perform the check flow including the delivery flow. For example, when the power switch 25*a* is temporarily turned off and the power switch 25*a* is turned on again after the delivery request for the new liquid ejection head is transmitted, the control section 70 has transmitted the delivery request for the new liquid ejection head. When the control section 70 has not transmitted the delivery request for the new liquid ejection head, a determination result in step S412 is NO, and the process proceeds to step S500. For example, when the check flow is started by the control section 70, and the power switch 25*a* is temporarily turned off and the power switch 25*a* is turned on again before the delivery request for the new liquid ejection head is transmitted, the control section 70 has not transmitted the delivery request for the new liquid ejection head. In this case, the delivery request for the new liquid ejection head needs to be transmitted. That is, the control section 70 restarts the check flow including the delivery request for the new liquid ejection head.

As described above, when the defective ejection is not detected in step S402, the determination result in step S402 is NO, and the control section 70 proceeds to a process in step S408.

In step S408, the control section 70 determines whether or not manual maintenance of the liquid ejection head 54 has been performed by the user. When the manual maintenance of the liquid ejection head 54 has been performed by the user, a determination result in step S408 is YES, and the process proceeds to step S409. When the manual maintenance of the liquid ejection head 54 has not been performed by the user, the determination result in step S408 is NO, and the process proceeds to step S411.

In step S409, the control section 70 adds 1 to the number of times for which the manual maintenance has been repeatedly performed at a timing at which the manual maintenance is finished. When the manual maintenance is performed for the first time in this step S409 after the new liquid ejection head 54 is attached to the liquid ejection apparatus 11, the numerical value "zero" stored in the IC chip 56 as the number of times for which the manual maintenance is repeatedly executed is rewritten to 1. The control section 70 shares the numerical value in the internal memory and the numerical value in the IC chip 56 with the number of times of the manual maintenance as 1.

In the first print job after the manual maintenance is performed by the user, when the manual maintenance is not performed, the numerical value "1" stored in the IC chip 56 as the number of times for which the manual maintenance is repeatedly performed is rewritten to "zero". The control section 70 shares the numerical value in the internal memory and the numerical value in the IC chip 56 with the number of times for which the manual maintenance is repeatedly performed as "zero". Even in a case where the manual maintenance has been performed in this step S409 after the new liquid ejection head 54 is attached to the liquid ejection apparatus 11, when the manual maintenance has not been performed after the previous print job, the numerical value stored in the IC chip 56 is "zero" as the number of times for which the manual maintenance has been repeatedly performed. In the following description, the number of times for which the manual maintenance is repeatedly performed will be referred to as the number of times of the manual maintenance.

In step S410, the detector 70*a* of the control section 70 determines whether or not the number of times of the manual maintenance has reached a second specified number of times N2. That is, the detector 70*a* detects that the manual maintenance has been repeatedly executed a predetermined number of times or more as a problem related to ejection. When the number of times of the manual maintenance has reached the second specified number of times N2, a determination result in step S410 is YES, and the process proceeds to step S406. When the number of times of the manual maintenance has not reached the second specified number of times N2, the determination result in step S410 is NO, and the process proceeds to step S402. The second specified number of times N2 differs depending on the type of the liquid ejection head 54 and thus is not limited, but is, for example, three. The second specified number of times N2 may be more or less than three. The second specified number of times N2 may be the same value as the first specified number of times N1 or may be a value different from the first specified number of times N1. In a case where the second specified number of times N2 is three, when the number of times of the manual maintenance times has reached three, the determination result in step S410 is YES, and the process proceeds to step S406.

In the present embodiment, the detector 70*a* counts the number of times of the automatic maintenance and the number of times of the manual maintenance separately, but the detector 70*a* may determine whether or not a sum of the number of times of the automatic maintenance and the number of times of the manual maintenance has reached a specified number of times. The control section 70 may determine whether or not a problem related to ejection has occurred based on a determination result of whether or not the sum of the number of times of the automatic maintenance and the number of times of the manual maintenance has reached the specified number of times. In this case, when the automatic maintenance is executed after the previous print job and the manual maintenance is executed after the next print job, or when the manual maintenance is executed after the previous print job and the automatic maintenance is executed after the next print job, the detector 70*a* may determine that maintenance has been repeatedly executed.

As described above, when the manual maintenance of the liquid ejection head 54 has not been performed by the user in step S408, the determination result in step S408 is NO, and the control section 70 proceeds to a process in step S411.

In step S411, the control section 70 determines whether or not the user has input the occurrence of the problem related to ejection by using the operation section 25 as an example of an input section. When the user has input the occurrence of the problem related to ejection to the operation section 25, a determination result in step S411 is YES, and the process proceeds to step S406. That is, when the occurrence of the problem related to ejection of the liquid ejection head 54 has been input by using the operation section 25, the control section 70 starts a check flow including a delivery request for a new liquid ejection head. When the user has not input the occurrence of the problem related to ejection to the operation section 25, the determination result in step S411 is NO, and the process proceeds to step S412.

In step S412, the control section 70 determines whether or not the user has input a delivery request for a new liquid ejection head by using the operation section 25 as an example of an input section. When the user has input the delivery request for the new liquid ejection head to the operation section 25, a determination result in step S412 is YES, and the process proceeds to step S406. That is, even when the user has input the delivery request for the new liquid ejection head by using the operation section 25, this is included in the input of the occurrence of the problem related to ejection to the operation section 25, performed by the user. When the user has not input the delivery request for the new liquid ejection head to the operation section 25, the determination result in step S412 is NO, and the process proceeds to step S402.

Check Flow

First, an outline of the check flow illustrated in FIG. 10 will be described.

When the control section 70 determines that a problem related to ejection has occurred, the occurrence of the problem may be determined by the detector 70*a* detecting a state of the liquid ejection apparatus 11 and by a user inputting the occurrence of the problem by using operation section 25. When the user inputs the occurrence of a problem related to ejection in step S411 in FIG. 9, or when the user inputs a delivery request for a new liquid ejection head in step S412 in FIG. 9, the control section 70 determines that a problem related to ejection has occurred by the user inputting the occurrence of the problem related to ejection by using operation section 25.

The user may input the occurrence of a problem related to ejection or a delivery request for a new liquid ejection head to the operation section 25 without knowing that the liquid ejection head 54 can be manually maintained in the liquid ejection apparatus 11. Thus, it is desirable that the control section 70 starts a check flow according to a maintenance execution status for the liquid ejection head 54 in the liquid ejection apparatus 11. Consequently, the control section 70 starts the check flow according to the maintenance execution status for the liquid ejection head 54 before the user inputs the occurrence of a problem or the delivery request by using the operation section 25 as an example of an input section.

More specifically, in the present embodiment, when the user inputs the occurrence of a problem related to ejection or the delivery request for a new liquid ejection head to the operation section 25, in a case where the number of times of the manual maintenance is equal to or larger than the third specified number of times N3, the control section 70 proceeds to the delivery flow. When the user inputs the occurrence of a problem related to ejection or the delivery request for a new liquid ejection head to the operation section 25, in a case where the number of times of the manual maintenance is smaller than the third specified number of times N3, the control section 70 performs the automatic maintenance, and then the control section 70 proceeds to the delivery flow when a recovery from the problem related to ejection is not made through the automatic maintenance.

When the user inputs the occurrence of a problem related to ejection or a delivery request for a new liquid ejection head to the operation section 25 without knowing that the liquid ejection head 54 can be manually maintained in the liquid ejection apparatus 11, a recovery from the problem related to ejection may be made through the automatic maintenance. For example, in a case where the user inputs the occurrence of the problem related to ejection to the operation section 25 without knowing that the liquid ejection head 54 can be manually maintained in the liquid ejection apparatus 11, when a recovery from the problem is made through maintenance, a new liquid ejection head 54 does not need to be delivered. That is, the control section 70 does not need to proceed to the delivery flow. Thus, the control section 70 causes the maintenance section 71 to execute maintenance one or more times.

In the delivery flow, it is possible to request delivery of consumables at the same time. The control section 70 transmits a delivery request for a new liquid ejection head to the server apparatus 80, and also transmits a delivery request for a new liquid storage body to the server apparatus 80.

In the present embodiment, the control section 70 starts a check flow on the display section 26 of the liquid ejection apparatus 11. Alternatively, the control section 70 may start the check flow on a PC screen coupled thereto via the network NW, or may start the check flow on both the PC screen and the display section 26 of the liquid ejection apparatus 11.

Next, with reference to a flowchart of FIG. 10, control executed by the control section 70 in each step will be described in order for a subroutine of the check flow.

In step S501, the control section 70 determines whether or not the occurrence of a problem related to ejection or a delivery request has been input to the operation section 25 as an example of an input section. When the occurrence of a problem related to ejection or a delivery request has been input to the operation section 25, and the control section 70 proceeds to the check flow, a determination result in step S501 is YES, and the process proceeds to step S502. When the occurrence of a problem related to ejection or a delivery request has not been input to the operation section 25, that is, the number of times of the automatic maintenance has reached the first specified number of times N1, or the number of times of maintenance performed by the user has reached the second specified number of times N2, and the control section 70 proceeds to the check flow, the determination result in step S501 is NO, and the process proceeds to step S503.

In step S502, the detector 70*a* of the control section 70 determines whether or not the number of times of the manual maintenance has reached a third specified number of times N3. That is, the detector 70*a* detects that the manual maintenance has been repeatedly executed a predetermined number of times or more as a problem related to ejection. When the number of times of the manual maintenance has reached the third specified number of times N3, a determination result in step S502 is YES, and the process proceeds to step S503. When the number of times of the manual maintenance has not reached the third specified number of times N3, the determination result in step S502 is NO, and the process proceeds to step S511. The third specified number of times N3 differs depending on the type of the liquid ejection head 54 and thus is not limited, but is, for example, two. The third specified number of times N3 may be more or less than two. The third specified number of times N3 may be the same value as the first specified number of times N1 or the second specified number of times N2, or may be a value different from the first specified number of times N1 or the second specified number of times N2. In a case where the third specified number of times N3 is two, the determination result of step S502 is YES when the number of times of the manual maintenance has reached two, and the process proceeds to step S503. When the number of times of the manual maintenance is "zero" or one, the determination result in step S502 is NO, and the process proceeds to step S511.

The control section 70 may set step S502 as a step of checking, with the user, whether or not the manual maintenance or nozzle check printing has been performed, by using the display section 26. That is, the control section 70 may check, with the user, whether or not the manual maintenance or nozzle check printing has been performed by using the display section 26, and when "performed" is selected by using the operation section 25, the process may proceed to the delivery flow in step S503, and when "not performed" is selected, the process may proceed to step S511.

In step S503, the control section 70 displays a check screen regarding whether or not the new liquid ejection head 54 is to be delivered on the display section 26. For example, the control section 70 displays a message including "a problem related to ejection has been detected; do you want to request delivery of a new liquid ejection head?" on the display section 26, and requests the user to select and input "YES" or "NO" by using the operation section 25. When the user inputs "YES" by using the operation section 25, the control section 70 starts the delivery flow in step S503.

In step S504, the control section 70 determines whether or not a delivery request for a new liquid ejection head has been selected by using the operation section 25. When the delivery request for the new liquid ejection head has been selected, a determination result in step S504 is YES, and the process proceeds to step S505. When the delivery request for the new liquid ejection head has not been selected, the determination result in step S504 is NO, and the process proceeds to step S509. When the user has already requested delivery of the new liquid ejection head, there may be a flow in which the control section 70 displays the fact on the display section 26 such that the user cannot request the delivery of the new liquid ejection head.

In step S505, as illustrated in FIG. 8, the control section 70 causes the transmission section 60 to transmit the delivery request for the new liquid ejection head to the server apparatus 80 via the network NW. The server apparatus 80 receives a transmission content from the transmission section 60 with the reception section 80*a*, and receives the delivery request for the new liquid ejection head. The control section 70 displays a message including "replace with a new liquid ejection head" on the display section 26, and prohibits use of the liquid ejection apparatus 11. For example, in the present embodiment, when the delivery request for the new liquid ejection head is transmitted and the control section 70 finishes the delivery flow in step S508 described later, the liquid ejection apparatus 11 does not accept any operation other than an operation on the power switch 25*a* from the operation section 25 and an operation related to a use prohibition cancellation process. That is, the control section 70 prohibits the use of the liquid ejection apparatus 11 when the delivery request for the new liquid ejection head is transmitted.

In step S506, the control section 70 displays, on the display section 26, a check screen regarding whether or not to a new liquid storage body 28 for the liquid storage body 28 of the liquid ejection apparatus 11 is to be delivered. For example, the control section 70 displays a message including "do you want to request delivery of all new liquid storage bodies at the same time as the delivery of the new liquid ejection head?" on the display section 26, and requests the user to select and input "YES" or "NO" by using the operation section 25. The control section 70 determines whether or not the delivery request for all the new liquid storage bodies has been selected by the operation section 25. When the delivery request for all new liquid storage bodies is selected, a determination result in step S506 is YES, and the process proceeds to step S507. When the delivery request for all the new liquid storage bodies is not selected, the determination result in step S506 is NO, and the process proceeds to step S509. The control section 70 may proceed to step S509 after executing step S505 without performing the process in step S506.

There is a case where nozzle check printing may be executed in the liquid ejection apparatus 11, and the user may check a result of the nozzle check printing to determine which liquid storage body 28 a problem has occurred in a nozzle ejecting the liquid L supplied from. For example, when defective ejection has occurred in the yellow ink, there may be a problem with the yellow ink. In this case, it is desirable that a new liquid storage body 28 for the liquid storage body 28 storing the yellow ink in which the defective ejection has occurred is delivered. That is, in step S506, the control section 70 may display, on the display section 26, a screen for selecting for which liquid storage body 28 a new liquid storage body 28 is to be delivered among the liquid storage bodies 28 of the liquid ejection apparatus 11, and the control section 70 may allow the user to select for which liquid storage body 28 the new liquid storage body 28 is to be delivered.

In step S507, as illustrated in FIG. 8, the control section 70 causes the transmission section 60 to transmit a delivery request for the new liquid storage body to the server apparatus 80 via the network NW. When the detector 70*a* detects a problem related to ejection, the control section 70 may transmit a delivery request for a new liquid storage body in addition to the delivery request for the new liquid ejection head. The server apparatus 80 receives the transmission content from the transmission section 60 by using the reception section 80*a*, and receives the delivery request for the new liquid storage body.

As in the present embodiment, the control section 70 may transmit a delivery request for all new liquid storage bodies to the server apparatus 80, or may transmit a delivery request for a new liquid storage body for the liquid storage body 28 selected by the user to the server apparatus 80.

In step S508, the control section 70 finishes the delivery flow. For example, when delivery of the new liquid ejection head 54 and all the new liquid storage bodies 28 has been requested, the control section 70 displays, on the display section 26, a message including "delivery of the new liquid ejection head and all the new liquid storage bodies has been requested", and finishes the delivery flow. The control section 70 finishes the subroutine of the check flow.

In step S509, the control section 70 determines whether or not there is the liquid storage body 28 of which a residual amount is less than a predetermined threshold value among the liquid storage bodies 28 included in the liquid ejection apparatus 11. For example, the liquid ejection apparatus 11 has a plurality of liquid residual amount sensors (not illustrated) each detecting a residual amount of the liquid L in each liquid storage body 28 in the liquid supply unit 27, and the liquid residual amount sensor including a light projecting element and a light receiving element detects a residual amount of the liquid L based on an intensity of reflected light that changes according to the residual amount of the liquid L stored in each liquid storage body 28. The control section 70 determines whether or not there is a liquid storage body 28 of which a residual amount of the liquid L stored in the liquid storage body 28 is less than a predetermined threshold value based on a signal that is input from the liquid residual amount sensor. For example, the threshold value is a value determined based on the number of days until the liquid storage body 28 arrives and an amount of the liquid L consumed in the liquid ejection apparatus 11 in a day. When there is the liquid storage body 28 of which the residual amount is less than the predetermined threshold value, a determination result in step S509 is YES, and the process proceeds to step S510. When there is no liquid storage body 28 of which the residual amount is less than the predetermined threshold value, the determination result in step S509 is NO, and the process proceeds to step S508.

In step S510, the control section 70 causes the transmission section 60 to transmit a delivery request for a new liquid storage body to the server apparatus 80 via the network NW with respect to the liquid storage body 28 of which the residual amount is less than the predetermined threshold value. When the detector 70*a* detects a problem, the control section 70 may transmit a delivery request for a new liquid storage body 28 corresponding to the liquid storage body 28 of which the residual amount is less than the predetermined threshold value in addition to the delivery request for the new liquid ejection head. That is, when a delivery request for a new liquid ejection head is made, in a case where there is a liquid storage body 28 of which the residual amount is less than the predetermined threshold value among the plurality of liquid storage bodies 28 storing the liquids L to be supplied to the liquid ejection head 54, the control section 70 transmits the delivery request for the new liquid storage body in addition to the delivery request for the new liquid ejection head.

When the user has already requested the delivery of the new liquid storage body, the delivery request for the new liquid storage body does not need to be made. When there are a plurality of liquid storage bodies 28 in which residual amounts are less than the predetermined threshold value, the control section 70 may automatically a delivery request for new liquid storage bodies corresponding to the plurality of liquid storage bodies 28 to the server apparatus 80.

In step S508, the control section 70 finishes the delivery flow. For example, when delivery of a new liquid ejection head 54 and a new liquid storage body 28 for the yellow ink has been requested, the control section 70 displays, on the display section 26, a message including "delivery of a new liquid ejection head and a new liquid storage body for the yellow ink has been requested", and finishes the delivery flow. The control section 70 finishes the subroutine of the check flow.

As described above, when the number of times of the manual maintenance has not reached the third specified number of times N3, the determination result in step S502 is NO, and the control section 70 proceeds to a process in step S511.

In step S511, the control section 70 causes the maintenance section 71 to start executing the automatic maintenance of the liquid ejection head 54. In step S511, the control section 70 may proceed to a flow for executing the manual maintenance. The manual maintenance may be started by the user operating the operation section 25.

In step S300, the control section 70 executes the above-described maintenance subroutine illustrated in FIG. 7.

In step S512, the control section 70 causes the carriage unit 50 to execute nozzle check printing. The purpose of the nozzle check printing after the automatic maintenance is to allow the user to check whether or not a recovery from a problem related to ejection has been made through the automatic maintenance when the number of times of the manual maintenance performed by the user is small.

In step S513, the control section 70 displays a selection screen including "recovered" and "not recovered" from the problem related to ejection on the display section 26. The user looks at a result of the nozzle check printing and selects either "recovered" or "not recovered".

In step S514, the control section 70 determines whether or not "recovered" is selected by using the operation section 25. When "recovered" is selected, a determination result in step S514 is YES, and the control section 70 finishes the subroutine of the check flow. When "recovered" is not selected, that is, when "not recovered" is selected, the determination result in step S514 is NO, and the process proceeds to the delivery flow in step S503. The control section 70 displays a check screen regarding whether or not the new liquid ejection head 54 is to be delivered on the display section 26.

When "not recovered" is selected in step S514, the control section 70 may proceed to step S511 and perform the automatic maintenance process again. In this case, in a case where "not recovered" is selected even when the automatic maintenance process is repeatedly executed a predetermined number of times, the control section 70 proceeds to the delivery flow in step S503.

In step S513, the control section 70 displays the selection screen including "recovered" and "not recovered" from the problem related to ejection on the display section 26, and, in step S514, the control section 70 determines whether or not "recovered" is selected by using the operation section 25. Alternatively, the detector 70*a* may automatically detect defective ejection. The control section 70 may determine whether or not a recovery from the problem related to ejection has been made according to a detection result. When it is determined that the recovery has been made, the control section 70 finishes the subroutine of the check flow. When it is determined that the recovery has not been made, the process proceeds to the delivery flow of step S503.

New Liquid Ejection Head Attachment Check Process

Next, with reference to a flowchart of FIG. 11, a description will be made of a subroutine of the "new liquid ejection head attachment check process" that is first executed by the control section 70 in the "ejection-related problem determination process" illustrated in FIG. 9.

In step S601, the control section 70 determines whether or not the delivery request for the new liquid ejection head has been transmitted. When the delivery request for the new liquid ejection head has been transmitted, a determination result in step S601 is YES, and the process proceeds to step S602. When the delivery request for the new liquid ejection head has not been transmitted, or when the new liquid ejection head 54 delivered due to the delivery request has been attached and the delivered new liquid ejection head 54 has already begun to be used, the determination result in step S601 is NO, and the control section 70 finishes the present subroutine.

In step S602, the control section 70 acquires the model information of the liquid ejection head 54 included in the carriage unit 50 and the ejection-related problem history information from the IC chip 56 of the liquid ejection head 54.

In step S603, when a message including "the replaced liquid ejection head is a used liquid ejection head" or "replace with a new liquid ejection head" on the display section 26 is displayed, the control section 70 deletes the message. This message will be described in step S605 described later and step S607 described later.

In step S604, the control section 70 determines whether or not the model information of the liquid ejection head 54 has been changed. As described above, the control section 70 identifies the liquid ejection head 54 based on the model information. That is, the control section 70 can check whether or not the liquid ejection head 54 has been replaced based on the model information. When the model information of the liquid ejection head 54 has been changed, a determination result in step S604 is YES, and the process proceeds to step S606. When the model information of the liquid ejection head 54 has not been changed, the determination result in step S604 is NO, and the process proceeds to step S605. When the liquid ejection head 54 is mounted on the liquid ejection apparatus 11 for the first time, the process proceeds to step S606.

In step S605, the control section 70 displays a message including "replace with a new liquid ejection head" on the display section 26, and prohibits the use of the liquid ejection apparatus 11. For example, the liquid ejection apparatus 11 does not accept any operation other than an operation on the power switch 25*a* from the operation section 25 and an operation related to a use prohibition cancellation process. The control section 70 finishes the present subroutine while the use of the liquid ejection apparatus 11 is prohibited.

When the power switch 25*a* is temporarily turned off and is then turned on again by the user operating the operation section 25 in a state in which the liquid ejection apparatus 11 prohibits the use of the liquid ejection apparatus 11, the control section 70 performs an operation of initializing the liquid ejection apparatus 11, and then executes the "ejection-related problem determination process" illustrated in FIG. 9. Thus, the control section 70 immediately proceeds to the present routine that is a first process in the "ejection-related problem determination process". The control section 70 displays the message including "replace with a new liquid ejection head" again on the display section 26, and does not accept any operation other than an operation on the power switch 25*a* from the operation section 25 and an operation related to a use prohibition cancellation process described later. That is, the control section 70 prohibits the use of the liquid ejection apparatus 11 when the delivery request for the new liquid ejection head is transmitted.

In the liquid ejection apparatus 11, in a state in which the liquid ejection apparatus 11 prohibits the use of the liquid ejection apparatus 11, the user can perform an operation related to the use prohibition cancellation process by using the operation section 25. For example, in the present embodiment, in a state in which the liquid ejection apparatus 11 prohibits the use of the liquid ejection apparatus 11, the control section 70 allows only a menu for managing the operation of the liquid ejection apparatus 11 to be operable on the display section 26. Consequently, the user can select "apparatus use prohibition cancellation" from the menu by operating the operation section 25. In a state in which the liquid ejection apparatus 11 prohibits the use of the liquid ejection apparatus 11, when the user performs an operation of canceling the prohibition by using the operation section 25, the control section 70 cancels the prohibition of the use of the liquid ejection apparatus 11 while displaying the message including "replaces with a new liquid ejection head" on the display section 26. That is, the control section 70 cancels the prohibition of the use of the liquid ejection apparatus 11 after transmission of the delivery request for the new liquid ejection head on condition of the request from the user.

In step S605, after the control section 70 displays the message including "replace with a new liquid ejection head" on the display section 26, the control section 70 may allow the user to select whether to prohibit the use of the liquid ejection apparatus 11 or to continue the use of the liquid ejection apparatus 11 by using the operation section 25.

As described above, in step S604, when the model information of the liquid ejection head 54 has been changed, the determination result in step S604 is YES, and the control section 70 proceeds to a process in step S606.

In step S606, the control section 70 determines whether or not the liquid ejection head 54 has an ejection-related problem history. When the model information of the liquid ejection head 54 is changed, in a case where the liquid ejection head 54 has the ejection-related problem history, the control section 70 determines that the liquid ejection head 54 has been replaced with another used liquid ejection head 54 having a problem related to ejection. When the liquid ejection head 54 has the ejection-related problem history, a determination result in step S606 is YES, and the process proceeds to step S607. When the liquid ejection head 54 has no ejection-related problem history, the determination result in step S606 is NO, and the process proceeds to step S608.

In step S607, the control section 70 displays a message including both "replace with a new liquid ejection head" and "the replaced liquid ejection head is a used liquid ejection head" on the display section 26, and prohibits the use of the liquid ejection apparatus 11. Even when the power switch 25*a* of the operation section 25 is temporarily turned off and is then turned on again by the user, the message is displayed again on the display section 26. The control section 70 finishes the present subroutine while the use of the liquid ejection apparatus 11 is prohibited.

In step S607, when the number of times of the automatic maintenance of the attached liquid ejection head 54 has not reached the first specified number of times N1 and the number of times of the manual maintenance has not reached the second specified number of times N2, the control section 70 may cancel the prohibition of the use of the liquid ejection apparatus 11 such that the liquid ejection apparatus 11 can be used, and finish the present subroutine.

As described above, in step S606, when the liquid ejection head 54 has no ejection-related problem history, the determination result in step S606 is NO, and the process proceeds to step S608.

In step S608, the control section 70 resets the ejection-related problem history stored in the control section 70, and initializes the ejection-related problem flag. For example, the control section 70 rewrites a numerical value of a portion that stores the presence or absence of "problem occurrence related to ejection" from 1 to "zero". That is, when the model information of the liquid ejection head 54 is changed and the liquid ejection head 54 has no ejection-related problem history, the control section 70 determines that the liquid ejection head 54 has been replaced with a new liquid ejection head 54.

In step S609, the control section 70 deletes the message including "replace with a new liquid ejection head" displayed on the display section 26, and cancels the prohibition of the use of the liquid ejection apparatus 11. The control section 70 finishes the present subroutine.

An operation of the present embodiment will be described.

In the liquid ejection apparatus 11, when the power switch 25*a* is turned on by the user, the control section 70 starts the flow illustrated in FIG. 9 at a timing immediately after the initialization operation is performed, and first executes the "new liquid ejection head attachment check process" illustrated in FIG. 11.

The control section 70 shares the model information written in the IC chip 56 of the liquid ejection head 54 and the ejection-related problem history with the information in the memory in the control section 70. The control section 70 checks, based on the model information, whether or not the liquid ejection head 54 has been replaced with another liquid ejection head 54 and also checks compatibility with the liquid ejection apparatus 11. The control section 70 checks whether or not the liquid ejection head 54 has been replaced with a new liquid ejection head 54 based on the ejection-related problem history.

When a problem related to ejection has occurred in the liquid ejection head 54 attached to the liquid ejection apparatus 11, the control section 70 checks whether or not the liquid ejection head 54 has been replaced with another liquid ejection head 54. Consequently, printing can be performed with the liquid ejection head 54 different from the liquid ejection head 54 in which the problem related to ejection has occurred. That is, in the liquid ejection apparatus 11, there is less concern that defective ejection may occur.

The control section 70 checks the compatibility, and thus the control section 70 can prevent the liquid ejection apparatus 11 from performing printing when the incompatible liquid ejection head 54 is attached. For example, when it is found after sending that a liquid ejection head 54 having a certain serial number causes a problem in a case of being attached to a specific liquid ejection apparatus, in a case where the liquid ejection head 54 having the serial number that may cause the problem is attached to the corresponding liquid ejection apparatus, the control section 70 can prohibit the use of the liquid ejection apparatus 11.

The ejection-related problem history is checked, and thus it is possible to prevent the liquid ejection head 54 from being replaced with the liquid ejection head 54 having a problem related to ejection when the liquid ejection head 54 is replaced with another liquid ejection head 54. That is, since the control section 70 can check whether or not the liquid ejection head 54 has been replaced with the new liquid ejection head 54, there is less concern that defective ejection may occur in the liquid ejection apparatus 11. For example, when the liquid ejection head 54 is erroneously replaced by the user with the liquid ejection head 54 that has previously been determined as having a problem related to ejection, the control section 70 can detect the fact. In this case, the control section 70 can prohibit the use of the liquid ejection apparatus 11.

The control section 70 finishes the attachment check process for the liquid ejection head 54. In this state, the liquid ejection apparatus 11 can perform recording on the medium M. Even in a case where the use of the liquid ejection apparatus 11 is prohibited, when the control section 70 determines that the attached liquid ejection head 54 can be used based on the model information written on the IC chip 56 and the ejection-related problem history, the control section 70 may cancel the prohibition of the use of the liquid ejection apparatus 11.

As illustrated in FIG. 9, when the attachment check process for the new liquid ejection head 54 is finished, in a case where the control section 70 determines that a problem related to ejection has occurred in step S401, and a delivery request has not been transmitted in step S407, the control section 70 immediately starts the check flow. That is, when the power switch 25*a* is turned on by the user, in a case where the problem related to ejection has occurred but the delivery request has not been transmitted, the control section 70 can immediately start the check flow including the delivery request.

When the liquid ejection apparatus 11 performs recording on the medium M, the liquid L is ejected from the nozzle 54*a* of the liquid ejection head 54 toward the medium M. The liquid ejection apparatus 11 alternately repeats a transport operation in which the medium M is transported to the next recording position and a recording operation in which the liquid L is ejected from the nozzle 54*a* of the liquid ejection head 54 while the carriage unit 50 is being moved in the scanning direction X at the next recording position, and thus characters, images, or the like are recorded on the medium M.

The liquid ejection apparatus 11 performs recording on the medium M, and thus the operation of ejecting the liquid L from the nozzle 54*a* of the liquid ejection head 54 is repeated. As illustrated in FIG. 4, in the liquid ejection apparatus 11, when recording is not performed, the cap portion 73 comes into contact with the liquid ejection head 54 to form the closed space CS surrounding the nozzles 54*a*. However, the liquid L in the liquid ejection head 54 is always in contact with air at the opening of the nozzle 54*a*, and thus water in the liquid L evaporates little by little. Thus, the liquid L in the portion that is always in contact with air at the opening of the nozzle 54*a* may be thickened. That is, the opening of the nozzle 54*a* may be clogged with the thickened liquid L, and thus defective ejection in which the liquid L is not ejected may occur.

As illustrated in FIG. 8, the monitoring section 55 constantly monitors whether or not defective ejection has occurred in the liquid ejection head 54, and notifies the detector 70*a* of a monitoring result. Then, in step S402 and step S403 in FIG. 9, the control section 70 automatically maintains the liquid ejection head 54 with the maintenance section 71 according to the result of which the monitoring section 55 notifies the detector 70*a*. The liquid L that has clogged the opening of the nozzle Ma due to thickening is discharged from the opening of the nozzle Ma through maintenance. Thus, it is possible to reduce concern that defective ejection may occur in printing after the automatic maintenance is executed.

When the detector 70*a* detects that the automatic maintenance has been repeatedly executed a predetermined number of times or more in step S405 in FIG. 9, the control section 70 determines in step S406 that a problem related to ejection has occurred. That is, the detector 70*a* detects that the automatic maintenance has been repeatedly executed a predetermined number of times or more as a problem related to ejection. Consequently, in a case where the detector 70*a* detects a problem and there is defective ejection that is not solved even when the automatic maintenance is repeatedly executed a predetermined number of times or more, the control section 70 determines that a problem related to ejection has occurred. Therefore, the control section 70 can start a check flow including a delivery request for a new replacement liquid ejection head.

In the liquid ejection head 54, even when the state of defective ejection continues, there is a case where the automatic maintenance may not be repeatedly executed a predetermined number of times or more by the control section 70. For example, when the residual vibration information of the liquid chamber is near a detection threshold value, even for the same defective ejection, there is a case where the defective ejection may or may not be detected, so that the automatic maintenance may not be repeatedly executed a predetermined number of times or more. In such a case, the user notices the defective ejection by checking a printing result of printed matter, and the manual maintenance that is maintenance performed by the user is executed.

When the detector 70*a* detects that the manual maintenance has been repeatedly executed a predetermined number of times or more in step S410 in FIG. 9, the control section 70 determines in step S406 that a problem related to ejection has occurred. That is, the detector 70*a* detects that the maintenance has been repeatedly executed by the user a predetermined number of times or more as a problem related to ejection. Consequently, in a case where there is defective ejection that is not solved even when the manual maintenance is repeatedly executed a predetermined number of times or more, the control section 70 determines that a problem related to ejection has occurred. Therefore, the control section 70 can start a check flow including a delivery request for a new replacement liquid ejection head.

The liquid ejection apparatus 11 includes the operation section 25 as an example of an input section to which the user can input the occurrence of a problem related to ejection. The user can input the occurrence of a problem related to ejection to the operation section 25 without waiting for the automatic maintenance to be repeatedly executed a predetermined number of times or more or the manual maintenance to be repeatedly executed a predetermined number of times or more. In step S411 in FIG. 9, when the user inputs the occurrence of a problem related to ejection to the operation section 25, the control section 70 determines that the problem related to ejection has occurred in step S406. Therefore, the control section 70 can start a check flow including a delivery request for a new replacement liquid ejection head.

The liquid ejection apparatus 11 includes the operation section 25 to which the user can input a delivery request for a new liquid ejection head. The user can input a delivery request for a new liquid ejection head to the operation section 25 without waiting for the automatic maintenance to be repeatedly executed a predetermined number of times or more or the manual maintenance to be repeatedly executed a predetermined number of times or more. When a delivery request is input to the operation section 25 in step S412 in FIG. 9, the control section 70 determines that a problem related to ejection has occurred in step S406, and thus the control section 70 can start a check flow including a delivery request for a new replacement liquid ejection head.

Figure 10:
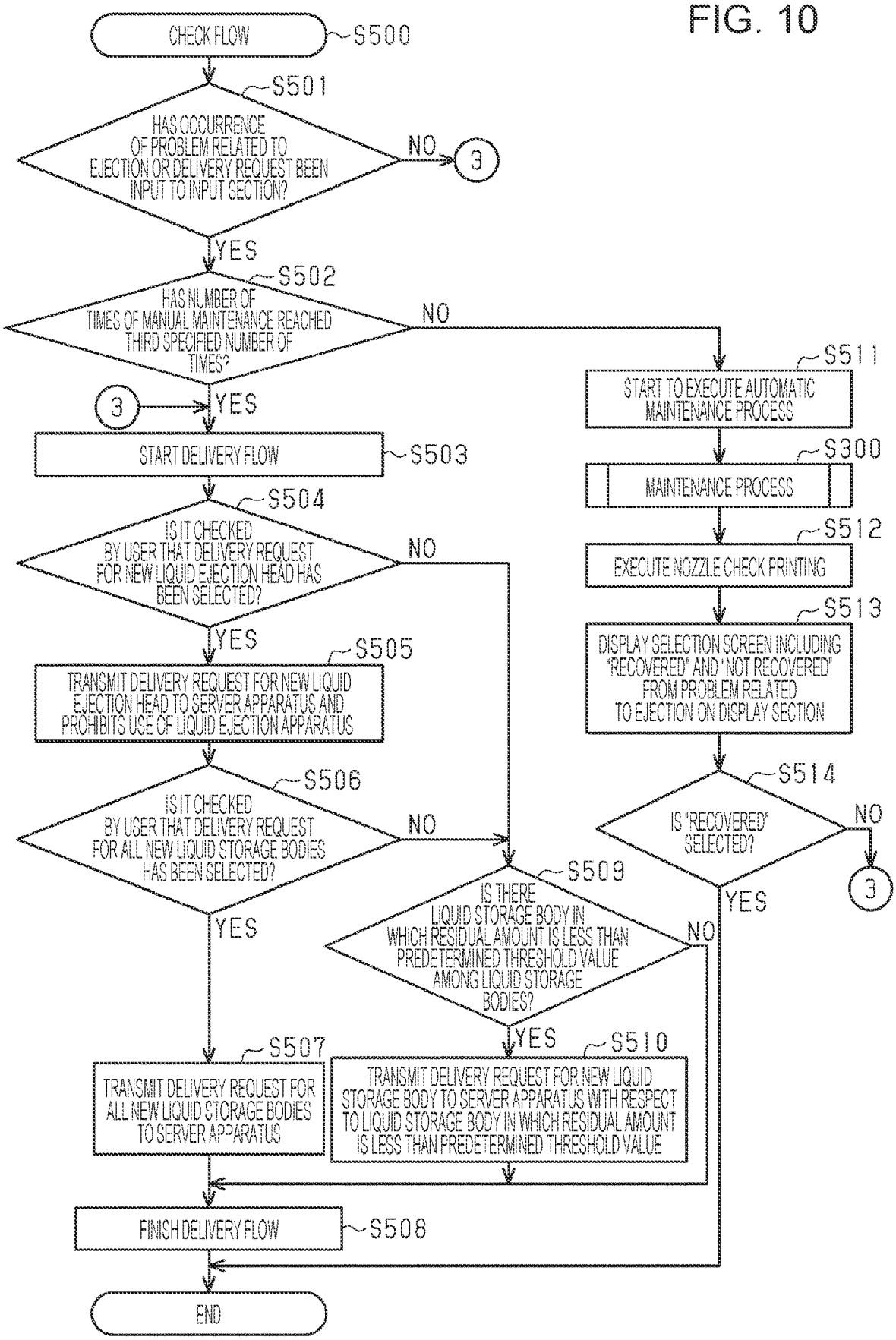
FIG. 10 is a flowchart illustrating a check flow according to the first embodiment.

When the control section 70 determines in step S406 in FIG. 9 that the problem related to ejection has occurred in the liquid ejection apparatus 11, the control section 70 starts the check flow illustrated in FIG. 10.

As illustrated in FIG. 10, in steps S501 to S503, in a case where the occurrence of a problem related to ejection or a delivery request is input to the operation section 25, the control section 70 starts to execute the automatic maintenance in step S511 when the manual maintenance has not been repeatedly executed a predetermined number of times or more. In other words, when the manual maintenance is not repeatedly executed a predetermined number of times or more immediately before the occurrence of the problem related to ejection or the delivery request is input, the automatic maintenance is executed. That is, when the user inputs the occurrence of the problem related to ejection or the delivery request to the operation section 25 as an example of an input section, the control section 70 causes the maintenance section 71 to execute the maintenance one or more times. Consequently, when a recovery from the problem is made through the maintenance, it is not necessary for the control section 70 to start the check flow including the delivery request for a new replacement liquid ejection head.

In a case where the user inputs the occurrence of the problem related to ejection or the delivery request, when the manual maintenance has already been repeatedly executed a predetermined number of times or more, the problem cannot be solved through the maintenance, and thus the control section 70 can immediately start a check flow including the delivery request for a new replacement liquid ejection head.

That is, when the user inputs the occurrence of the problem related to ejection or the delivery request, the control section 70 can execute a check flow in a case where a maintenance execution status before the input or a status of a result of executing automatic maintenance after the input.

The control section 70 starts the check flow in step S503, and checks the user's selection of the delivery request for the new liquid ejection head and transmits the delivery request for the new liquid ejection head to the server apparatus 80 in steps S504 and S505. The control section 70 prohibits the use of the liquid ejection apparatus 11. Consequently, it is possible to prevent printing from being continued in the liquid ejection head 54 having a problem related to ejection.

In steps S506 and S507, the control section 70 checks whether the user has selected a delivery request for new liquid storage bodies for all the liquid storage bodies 28, and transmits the delivery request for all new liquid storage bodies to the server apparatus 80 when the delivery request for the new liquid storage bodies for all the liquid storage bodies 28 has been selected. In a case where the delivery request for the new liquid storage bodies for all the liquid storage bodies 28 has not been selected, in steps S509 and S510, when there is the liquid storage body 28 of which a residual amount is less than a predetermined threshold value among the liquid storage bodies 28, the control section 70 transmits a delivery request for a new liquid storage body corresponding to the liquid storage body 28 of which the residual amount is less than the predetermined threshold value to the server apparatus 80.

Consequently, the user can request delivery of both the liquid ejection head 54 and the liquid L, which may be a cause of the problem related to ejection, and the user can also request delivery of a new liquid storage body in accordance with a delivery timing of a new liquid ejection head.

As illustrated in FIG. 8, the liquid ejection apparatus 11 includes the liquid ejection head 54 that is detachably attached and ejects the liquid L, and the control section 70 that can transmit a delivery request for a new liquid ejection head to the server apparatus 80 via the network NW. Consequently, the user can request delivery of a new replacement liquid ejection head when needed.

The liquid ejection apparatus 11 further includes the detector 70*a* detecting a problem related to ejection. Consequently, the user can request delivery of a new replacement liquid ejection head when a problem related to ejection has occurred.

In the liquid ejection apparatus 11 illustrated in FIG. 8, the control section 70 can automatically transmit a delivery request when the detector 70*a* detects a problem. Consequently, the user can save the time and effort to request delivery.

As illustrated in FIG. 8, the delivery system 100 for the liquid ejection apparatus includes the liquid ejection apparatus 11 and the server apparatus 80 having the reception section 80*a* receiving a delivery request for a new liquid ejection head transmitted from the control section 70. Consequently, the user can replace the liquid ejection head with a new liquid ejection head 54 when a problem has occurred in the liquid ejection head 54.

In step S505 illustrated in FIG. 10, the control section 70 prohibits the use of the liquid ejection apparatus 11 after transmitting the delivery request for the new liquid ejection head to the server apparatus 80. Consequently, it is possible to prevent printing from being continued by the defective liquid ejection head 54, but downtime of the liquid ejection apparatus 11 has occurred until the new liquid ejection head 54 is delivered. However, even when the liquid ejection head 54 has a problem related to ejection, the user may want to print printed matter. In the present embodiment, on condition of a request from the user, the control section 70 cancels the prohibition of the use of the liquid ejection apparatus 11 after transmitting the delivery request for the new liquid ejection head. Consequently, even when the liquid ejection head 54 has a problem related to ejection, printing can be continued until a new liquid ejection head 54 arrives, depending on the user's request.

When the new liquid ejection head 54 is delivered to the user, the user starts work of replacing the liquid ejection head 54 having the problem with the delivered new liquid ejection head 54.

First, the user causes the control section 70 to execute an operation of removing a liquid in the liquid ejection head 54 before the liquid ejection head 54 having the problem and attached to the liquid ejection apparatus 11 is detached from the liquid ejection apparatus 11. For example, the user operates the operation section 25 to cause the control section 70 to display the liquid ejection head replacement flow on the display section 26. The user presses a button on the operation section 25 for which an instruction is given on the display section 26 as a button for starting the liquid removal operation, and thus causes the control section 70 to execute the liquid removal operation illustrated in FIG. 5. That is, the control section 70 starts the liquid ejection head replacement flow that is a flow for detaching the attached liquid ejection head 54 having the problem from the liquid ejection apparatus 11 and attaching the delivered new liquid ejection head 54, and first allows the user to press the button for executing the liquid removal operation.

As illustrated in FIG. 5, the liquid removal operation that is first performed in the liquid ejection head replacement flow includes a step of closing the supply flow path through which the liquid L is supplied to the liquid ejection head 54 with the opening/closing mechanism. In the present embodiment, this step is a closing step of closing the first liquid supply flow path 75 with the first opening/closing valve 75*b*. In step S102, the control section 70 executes this step. It is possible to suppress leakage of the liquid L when the liquid ejection head 54 having a problem and attached to the liquid ejection apparatus 11 is detached from the liquid ejection apparatus 11 by closing the supply flow path through which the liquid L is supplied to the liquid ejection head 54.

When the control section 70 finishes the liquid removal operation illustrated in FIG. 5, the user detaches the liquid ejection head 54 having a problem and attached to the liquid ejection apparatus 11 from the liquid ejection apparatus 11, and executes work of attaching the delivered new liquid ejection head 54 to the liquid ejection apparatus 11. For example, the control section 70 displays, on the display section 26, a state in which the liquid removal operation illustrated in FIG. 5 has been finished, and displays a message for prompting the user of perform work of detaching the attached liquid ejection head 54 having a problem from the liquid ejection apparatus 11 and attaching the delivered new liquid ejection head 54 on the display section 26.

The user exposes the carriage unit 50 by opening the upper cover 13 illustrated in FIG. 1. Since the carriage unit 50 is located at the home position HP illustrated in FIG. 2 during non-recording in which recording is not performed on the medium M, the user can access the liquid ejection head 54 illustrated in FIG. 3 mounted on the carriage unit 50 when the upper cover 13 is opened. The user executes the work of detaching the liquid ejection head 54 from the carriage unit 50 and the work of attaching the delivered new liquid ejection head 54, closes the upper cover 13, and finishes the work of replacing the liquid ejection head 54. That is, the user can perform the detachment work and the attachment work for the liquid ejection head 54 without detaching the casing 12 from the liquid ejection apparatus 11.

In the present embodiment, in step S107 corresponding to the liquid removal operation illustrated in FIG. 5, the control section 70 moves the cap portion 73 to the retreat position away from the liquid ejection head 54 in the −Z direction. Consequently, the user can detach the liquid ejection head 54 in a state in which the cap portion 73 does not come into contact with the liquid ejection head 54.

When the delivered new liquid ejection head 54 is attached to the liquid ejection apparatus 11 by the user and the control section 70 checks that the upper cover 13 has been closed by a cover opening/closing sensor (not illustrated), the control section 70 executes the "ejection-related problem determination process" illustrated in FIG. 9. As described above, the present routine is executed at a timing immediately after power of the liquid ejection apparatus 11 is turned on by operating the power switch 25*a* and an initialization operation for the liquid ejection apparatus 11 is performed, or is executed at a timing at which the liquid ejection head 54 is attached to the carriage unit 50 in a state in which the power is turned on.

As the first process in the "ejection-related problem determination process" illustrated in FIG. 9, the control section 70 executes the "new liquid ejection head attachment check process" illustrated in FIG. 11. When the delivered new liquid ejection head 54 is attached, the ejection-related problem history is reset, the ejection-related problem flag is initialized, the message displayed on the display section 26 is deleted, and, when the use of the liquid ejection apparatus 11 is prohibited, the prohibition is canceled. The control section 70 executes the determination processes in steps S402, S408, S411, and S412 in FIG. 9 in parallel. That is, the liquid ejection apparatus 11 is in a state in which monitoring of defective ejection using the monitoring section 55 and detection of the user's operation on the operation section 25 are executed in parallel.

When the user finishes the replacement work for the new liquid ejection head, the user presses a button on the operation section 25 for which an instruction is given on the display section 26 as a button for finishing the replacement work, and thus notifies the control section 70 of finishing of the replacement work. When a delivery request for a new liquid storage body is transmitted in addition to a delivery request for a new liquid ejection head, the user performs replacement with both the new liquid ejection head 54 and the new liquid storage body 28, and then the user presses the button for finishing the replacement work, and thus notifies the control section 70 of finishing of the replacement work. Consequently, both the liquid ejection head 54 and the liquid L that may be a cause of a problem related to ejection can be replaced.

When the control section 70 is notified of finishing of the replacement work through the user's operation, the control section 70 executes the liquid filling operation illustrated in FIG. 6. In the present embodiment, in step S201 corresponding to the liquid filling operation illustrated in FIG. 6, the control section 70 moves the cap portion 73 at the retreat position to the contact position illustrated in FIG. 4. Consequently, the liquid ejection head 54 can be capped by the cap portion 73 as soon as the liquid ejection head 54 is attached.

Following the liquid filling operation, the control section 70 automatically executes a maintenance step of performing maintenance with the maintenance section 71. Finally, the control section 70 displays, on the display section 26, a state in which the liquid ejection head replacement flow displayed on the display section 26 has been finished, and finishes the liquid ejection head replacement flow. Consequently, the user can start printing immediately after the liquid ejection head replacement flow.

As described above, when the liquid ejection head replacement flow is finished, the liquid ejection apparatus 11 executes monitoring of defective ejection of the new liquid ejection head 54 after the replacement using the monitoring section 55 and detection of the user's operation on the operation section 25 after the replacement in parallel, by using the control section 70. Thus, even when a problem related to ejection has occurred again in the liquid ejection apparatus 11, the user can request delivery of a new replacement liquid ejection head.

The effects of the present embodiment will be described.

(1) The liquid ejection apparatus 11 includes the liquid ejection head 54 that is detachably attached and ejects the liquid L, and the control section 70 that can transmit a delivery request for a new liquid ejection head to the server apparatus 80 via the network NW. Thus, a user can request delivery of a new replacement liquid ejection head when needed. Consequently, it is possible to reduce downtime caused by the absence of a new replacement liquid ejection head 54 at the user's hand when a problem has occurred in the liquid ejection head 54 in the liquid ejection apparatus 11.

(2) The liquid ejection apparatus 11 further includes the detector 70*a* detecting a problem related to ejection. Thus, it is possible to request delivery of a new replacement liquid ejection head when a problem related to ejection has occurred. Consequently, it is possible to reduce downtime caused by the absence of a new replacement liquid ejection head 54 at the user's hand when a problem has occurred in the liquid ejection head 54 in the liquid ejection apparatus 11.

(3) The control section 70 automatically transmits a delivery request when the detector 70*a* detects a problem related to ejection. Thus, it is possible to save the user's time and effort to request delivery. Consequently, it is possible to reduce downtime caused by the absence of a new replacement liquid ejection head 54 at the user's hand when a problem has occurred in the liquid ejection head 54 in the liquid ejection apparatus 11.

(4) When the detector 70*a* detects a problem related to ejection, the control section 70 starts a check flow including a delivery request for a new liquid ejection head. Thus, when a problem has occurred in the liquid ejection head 54, it is possible to request delivery of a new replacement liquid ejection head. Consequently, it is possible to reduce downtime caused by the absence of a new replacement liquid ejection head 54 at the user's hand when a problem has occurred in the liquid ejection head 54 in the liquid ejection apparatus 11.

(5) The detector 70*a* detects that automatic maintenance has been repeatedly executed a predetermined number of times or more as a problem related to ejection. Thus, when there is defective ejection that is not solved even when the automatic maintenance has been repeatedly executed a predetermined number of times or more, it is possible to request delivery of a new replacement liquid ejection head. Consequently, it is possible to reduce downtime caused by the absence of a new replacement liquid ejection head 54 at the user's hand when a problem has occurred in the liquid ejection head 54 in the liquid ejection apparatus 11.

(6) The detector 70*a* detects that maintenance has been repeatedly executed a predetermined number of times or more by the user as a problem related to ejection. Thus, in a case where a problem that is not solved has occurred even when the maintenance has been repeatedly executed a predetermined number of times or more by the user, it is possible to request delivery of a new replacement liquid ejection head. Even when a problem that is not detected by the monitoring section 55 has occurred in the liquid ejection head 54, the detector 70*a* determines that a problem related to ejection has occurred, and can thus request delivery of a new replacement liquid ejection head. Consequently, it is possible to reduce downtime caused by the absence of a new replacement liquid ejection head 54 at the user's hand when a problem has occurred in the liquid ejection head 54 in the liquid ejection apparatus 11.

(7) The liquid ejection apparatus 11 further includes the operation section 25 as an example of an input section to which the user can input the occurrence of a problem related to ejection. Thus, when the user determines that the liquid ejection head 54 has a problem, the liquid ejection apparatus 11 can take appropriate measures. Consequently, it is possible to reduce downtime caused by the absence of a new replacement liquid ejection head 54 at the user's hand when a problem has occurred in the liquid ejection head 54 in the liquid ejection apparatus 11.

(8) When the user inputs the occurrence of a problem related to ejection to the operation section 25 as an example of an input section, the control section 70 causes the maintenance section 71 to perform the maintenance one or more times. Thus, when the user inputs the occurrence of a problem related to ejection, it is possible to recheck whether or not a recovery from the problem can be made through the maintenance. Consequently, when a recovery from the problem is made through the maintenance, since the user can continue to use the attached liquid ejection head 54, in the liquid ejection apparatus 11, it is possible to reduce downtime caused by the absence of a new replacement liquid ejection head 54 at the user's hand.

(9) When the user inputs the occurrence of a problem related to ejection to the operation section 25 as an example of an input section, the control section 70 starts a check flow including a delivery request for a new liquid ejection head. Thus, when the user inputs the occurrence of a problem related to ejection, it is possible to take measures according to a status at that time. Consequently, it is possible to reduce downtime caused by the absence of a new replacement liquid ejection head 54 at the user's hand when a problem has occurred in the liquid ejection head 54 in the liquid ejection apparatus 11.

(10) The control section 70 starts a check flow according to an execution status of maintenance before the input is performed by the operation section 25 as an example of an input section. Thus, when the user inputs the occurrence of a problem related to ejection, it is possible to take measures according to the execution status of the maintenance before that. Consequently, it is possible to reduce downtime caused by the absence of a new replacement liquid ejection head 54 at the user's hand when a problem has occurred in the liquid ejection head 54 in the liquid ejection apparatus 11.

(11) The control section 70 prohibits the use of the liquid ejection apparatus 11 when a delivery request for a new liquid ejection head is transmitted. Consequently, in the liquid ejection apparatus 11, it is possible to prevent printing from being continued in the liquid ejection head 54 having a problem related to ejection.

(12) On condition of a request from the user, the control section 70 cancels the prohibition of the use of the liquid ejection apparatus 11 after transmitting a delivery request for a new liquid ejection head. Thus, even when the liquid ejection head 54 has a problem, printing can be continued until a new liquid ejection head 54 arrives, depending on the user's request. Consequently, it is possible to reduce downtime caused by the absence of a new replacement liquid ejection head 54 at the user's hand when a problem has occurred in the liquid ejection head 54 in the liquid ejection apparatus 11.

(13) The control section 70 can carry out a liquid ejection head replacement flow that is a flow for attaching the delivered new liquid ejection head 54, and the liquid ejection head replacement flow includes a maintenance step of performing maintenance with the maintenance section 71. Thus, printing can be started immediately after the liquid ejection head replacement flow. Consequently, it is possible to reduce downtime caused by the absence of a new replacement liquid ejection head 54 at the user's hand when a problem has occurred in the liquid ejection head 54 in the liquid ejection apparatus 11.

(14) The liquid ejection apparatus 11 includes the first liquid supply flow path 75 as an example of a supply flow path through which the liquid L is supplied from the liquid storage body 28 to the liquid ejection head 54, and the first opening/closing valve 75*b* as an example of an opening/closing mechanism opens and closes the first liquid supply flow path 75, and the liquid ejection head replacement flow includes a closing step of closing the first liquid supply flow path 75 with the first opening/closing valve 75*b*. Consequently, in the liquid ejection apparatus 11, it is possible to suppress liquid leakage when the liquid ejection head 54 is replaced.

(15) The liquid ejection head 54 is configured to eject the liquid L stored in the liquid storage body 28, and the control section 70 can transmit a delivery request for a new liquid storage body in addition to a delivery request for a new liquid ejection head when the detector 70*a* detects a problem related to the ejection. Thus, it is possible to request delivery of both the liquid ejection head 54 and the liquid L that may be a cause of the problem related to ejection.

(16) When a delivery request for a new liquid ejection head is made, in a case where there is a liquid storage body 28 of which a residual amount is less than a predetermined threshold value among the plurality of liquid storage bodies 28 storing the liquids L to be supplied to the liquid ejection head 54, the control section 70 transmits a delivery request for a new liquid storage body in addition to a delivery request for a new liquid ejection head. Consequently, it is possible to request delivery of a new liquid storage body corresponding to a liquid storage body having a small residual amount in accordance with a delivery timing of the new liquid ejection head.

(17) The delivery system 100 for the liquid ejection apparatus 11 includes the liquid ejection apparatus 11 and the server apparatus 80 having the reception section 80*a* receiving a delivery request for a new liquid ejection head transmitted from the control section 70. Thus, when a problem has occurred in the liquid ejection head 54, the liquid ejection head 54 can be replaced with a new liquid ejection head 54. Consequently, it is possible to reduce downtime caused by the absence of a new replacement liquid ejection head 54 at the user's hand when a problem has occurred in the liquid ejection head 54 in the liquid ejection apparatus 11.

Second Embodiment

Hereinafter, a liquid ejection apparatus 11 according to a second embodiment will be described with reference to the drawings. In the first embodiment, a user replaces the liquid storage body 28. The second embodiment is different from the first embodiment in that the liquid storage body 28 is fixed to the liquid ejection apparatus 11, and the user replenishes the liquid storage body 28 with a liquid such as ink from a refill container through a supply port of the liquid storage body 28. The second embodiment is substantially the same as the first embodiment except for the above content, and thus an overlapping description will not be repeated by giving the same reference numeral to the same constituent.

Configuration of Liquid Ejection Apparatus

As illustrated in FIG. 1, the liquid supply unit 27 has the lid portion 27*b* that can be opened and closed upward. The plurality of liquid storage bodies 28 accommodated in the liquid supply unit 27 have supply ports (not illustrated) through which replenishment with the liquid L can be performed thereon. When the user opens the lid portion 27*b*, the supply port is exposed. For example, the liquid ejection apparatus 11 has a configuration in which, when the user looks at the window portions 27*a* and liquid amounts decrease, the user opens the lid portion 27*b* and replenishes the liquid storage bodies 28 with liquids such as ink from a plurality of refill containers (not illustrated) through the supply ports. The plurality of refill containers are, for example, ink bottles storing inks with different colors such as black, cyan, magenta, and yellow. The liquid ejection head 54 is configured to eject the liquid L stored in the liquid storage body 28 that can be replenished with the liquid L in the refill container.

Configuration of Delivery System

As illustrated in FIG. 8, the delivery system 100 delivers a replacement liquid ejection head 54 replacing the liquid ejection head 54 that needs to be replaced in the liquid ejection apparatus 11, to a user using the liquid ejection apparatus 11. In this case, the control section 70 may transmit a delivery request for a new replenishment refill container to the transmission section 60 via the network NW. That is, the server apparatus 80 may prepare for delivery of the new refill container when receiving a request signal for the delivery of the new replenishment refill container transmitted from the liquid ejection apparatus 11.

Even when the control section 70 does not detect a problem related to ejection, the delivery system 100 may deliver the replacement liquid ejection head 54 to the user using the liquid ejection apparatus 11 in response to the user's instruction from the operation section 25. The delivery system 100 may deliver the new replenishment refill container to the user using the liquid ejection apparatus 11 in response to the user's instruction from the operation section 25.

Check Flow

In the present embodiment, when there is a liquid storage body 28 of which a residual amount is less than a predetermined threshold value among the liquid storage bodies 28, the control section 70 transmits a delivery request for a new refill container to the server apparatus 80 with respect to the liquid storage body 28 of which residual amount is less than the predetermined threshold value.

With reference to a flowchart of FIG. 12, only steps in which the process performed by the control section 70 is different from that in the first embodiment will be described with respect to the subroutine of the check flow.

In step S506*a*, the control section 70 displays, on the display section 26, a check screen regarding whether or not a new refill container for the liquid storage body 28 of the liquid ejection apparatus 11 is to be delivered. For example, the control section 70 displays, on the display section 26, a message including "do you request delivery of new refill containers for all liquid storage bodies along with delivery of a new liquid ejection head?", and requests the user to select and input "YES" or "NO" by using the operation section 25. The control section 70 determines whether or not a delivery request for new refill containers for all the liquid storage bodies 28 has been selected by using the operation section 25. When the delivery request for new refill containers for all the liquid storage bodies 28 has been selected, a determination result in step S506*a* is YES, and the process proceeds to step S507*a*. When the delivery request for new refill containers for all the liquid storage bodies 28 has not been selected, the determination result in step S506*a* is NO, and the process proceeds to step S509. The control section 70 may proceed to step S509 after executing step S505 without performing the process in step S506*a*.

There is a case where nozzle check printing may be executed in the liquid ejection apparatus 11, and the user may check a result of the nozzle check printing to determine which liquid storage body 28 a problem has occurred in a nozzle ejecting a liquid supplied from. For example, when defective ejection has occurred in the yellow ink, there may be a problem with the yellow ink. In this case, it is desirable that a new refill container for the liquid storage body 28 storing the yellow ink in which the defective ejection has occurred is delivered. That is, in step S506*a*, the control section 70 may display, on the display section 26, a screen for selecting which new refill container is to be delivered among the liquid storage bodies 28 of the liquid ejection apparatus 11, and the control section 70 may allow the user to select which new refill container is to be delivered.

In step S507*a*, as illustrated in FIG. 8, the control section 70 causes the transmission section 60 to transmit a delivery request for a new refill container for the liquid storage body 28 to the server apparatus 80 via the network NW. When the detector 70*a* detects a problem related to ejection, the control section 70 may transmit a delivery request for a new refill container in addition to a delivery request for a new liquid ejection head. The server apparatus 80 receives the transmission content from the transmission section 60 by using the reception section 80*a*, and receives the delivery request for the new refill container for the liquid storage body 28.

As in the present embodiment, the control section 70 may transmit a delivery request for new refill containers for all the liquid storage bodies 28 to the server apparatus 80, or may transmit a delivery request for only a new refill container for the liquid storage body 28 selected by the user to the server apparatus 80.

In step S508, the control section 70 finishes the delivery flow. For example, when delivery of the new liquid ejection head 54 and the new refill containers for all the liquid storage bodies 28 has been requested, the control section 70 displays, on the display section 26, a message including "delivery of the new liquid ejection head and the new refill containers for all the liquid storage bodies has been requested", and finishes the delivery flow. The control section 70 finishes the subroutine of the check flow.

In step S509, the control section 70 determines whether or not there is the liquid storage body 28 of which a residual amount is less than a predetermined threshold value among the liquid storage bodies 28 included in the liquid ejection apparatus 11. For example, the liquid ejection apparatus 11 has a plurality of liquid residual amount sensors (not illustrated) each detecting a residual amount of the liquid L in each liquid storage body 28 in the liquid supply unit 27, and the liquid residual amount sensor including a light projecting element and a light receiving element detects a residual amount of the liquid L based on an intensity of reflected light that changes according to the residual amount of the liquid L stored in each liquid storage body 28. The control section 70 determines whether or not there is a liquid storage body 28 of which a residual amount of the liquid L stored in the liquid storage body 28 is less than a predetermined threshold value based on a signal that is input from the liquid residual amount sensor. For example, the threshold value is a value determined based on the number of days until the liquid storage body 28 arrives and an amount of the liquid L consumed in the liquid ejection apparatus 11 in a day. When there is the liquid storage body 28 of which the residual amount is less than the predetermined threshold value, a determination result in step S509 is YES, and the process proceeds to step S510*a*. When there is no liquid storage body 28 of which the residual amount is less than the predetermined threshold value, the determination result in step S509 is NO, and the process proceeds to step S508.

In step S510*a*, the control section 70 causes the transmission section 60 to transmit a delivery request for a new refill container for the liquid storage body 28 of which the residual amount is less than a predetermined threshold value to the server apparatus 80 via the network NW. When the detector 70*a* detects a problem, the control section 70 may transmit a delivery request for a new refill container corresponding to the liquid storage body 28 of which the residual amount is less than the predetermined threshold value, in addition to the delivery request for the new liquid ejection head. That is, when a delivery request for a new liquid ejection head is made, in a case where there is a liquid storage body 28 of which the residual amount is less than the predetermined threshold value among the plurality of liquid storage bodies 28 storing the liquids L to be supplied to the liquid ejection head 54, the control section 70 transmits the delivery request for the new refill container in addition to the delivery request for the new liquid ejection head. The server apparatus 80 receives the transmission content from the transmission section 60 by using the reception section 80*a*, and receives the delivery request for the new refill container.

When the user has already requested the delivery of the new refill container, the delivery request for the new refill container does not need to be made. When there are a plurality of liquid storage bodies 28 in which residual amounts are less than the predetermined threshold value, the control section 70 may automatically a delivery request for new refill containers corresponding to the plurality of liquid storage bodies 28 to the server apparatus 80.

In step S508, the control section 70 finishes the delivery flow. For example, when a new liquid ejection head 54 and a new refill container for the yellow ink are requested to be delivered, the control section 70 displays, on the display section 26, a message including "delivery of a new liquid ejection head and a new refill container for the yellow ink has been requested", and finishes the delivery flow. The control section 70 finishes the subroutine of the check flow.

An operation of the present embodiment will be described.

Also in the operation of the second embodiment, the description overlapping with the operation of the first embodiment will not be repeated.

Figure 12:
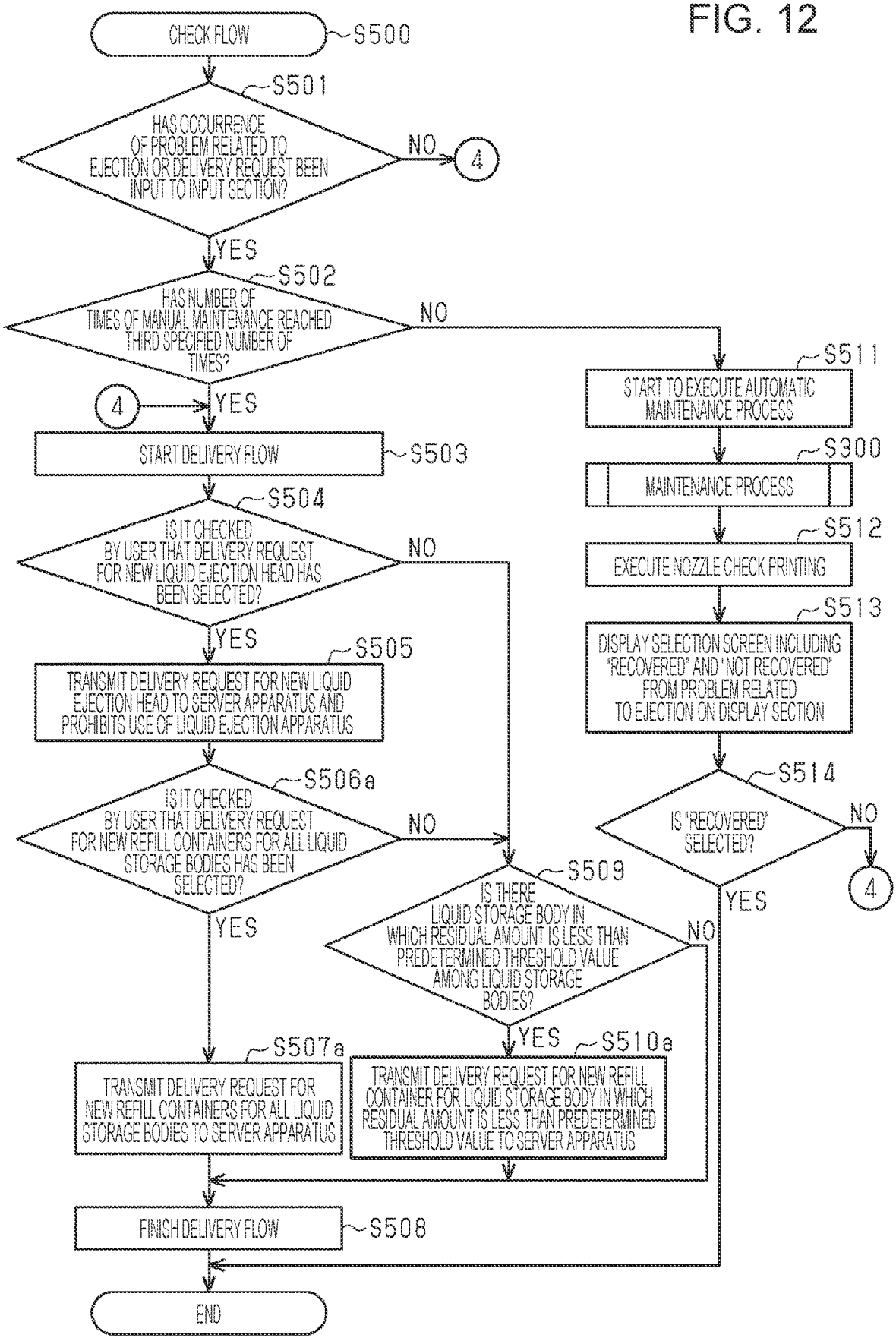
FIG. 12 is a flowchart illustrating a check flow according to the second embodiment.

As illustrated in FIG. 12, in steps S506*a* and S507*a*, the control section 70 checks whether the user has selected a delivery request for all new refill containers, and transmits the delivery request for the new refill containers to the server apparatus 80 when the delivery request for the new refill containers for all the liquid storage bodies 28 has been selected. When the delivery request for the new refill container for all the liquid storage bodies 28 has not been selected, in steps S509 and S510*a*, when there is the liquid storage body 28 of which a residual amount is less than a predetermined threshold value among the liquid storage bodies 28, the control section 70 transmits a delivery request for a new refill container corresponding to the liquid storage body 28 of which the residual amount is less than the predetermined threshold value to the server apparatus 80.

Consequently, the user can request delivery of both the liquid ejection head 54 and the liquid L, which may be a cause of the problem related to ejection, and the user can also request delivery of a new refill container in accordance with a delivery timing of a new liquid ejection head.

When the user finishes the replacement work for the new liquid ejection head, the user presses a button on the operation section 25 for which an instruction is given on the display section 26 as a button for finishing the replacement work, and thus notifies the control section 70 of finishing of the replacement work. When a delivery request for a new refill container is transmitted in addition to a delivery request for a new liquid ejection head, the user performs replacement work for the new liquid ejection head and work of pouring a liquid from the new refill container into the liquid storage body 28. Thereafter, the user presses the button for finishing the replacement work, and thus notifies the control section 70 of finishing of the replacement work.

Consequently, the user can replace both the liquid ejection head 54 and the liquid L that may be a cause of a problem related to ejection.

The effects of the present embodiment will be described.

In the liquid ejection apparatus 11, the same effects as (1) to (14) in the first embodiment can be achieved.

(15) The liquid ejection head 54 is configured to eject the liquid L stored in the liquid storage body 28, and the control section 70 can transmit a delivery request for a new refill container in addition to a delivery request for a new liquid ejection head when the detector 70*a* detects a problem related to the ejection. Consequently, when a problem has occurred in the liquid ejection head 54 in the liquid ejection apparatus 11, it is possible to reduce downtime caused by the absence of a new replacement liquid ejection head 54 at the user's hand and also to request delivery of both the liquid ejection head 54 and the liquid L that may be a cause of the problem related to ejection.

(16) When a delivery request for a new liquid ejection head is made, in a case where there is a liquid storage body 28 of which a residual amount is less than a predetermined threshold value among the plurality of liquid storage bodies 28 storing the liquids L to be supplied to the liquid ejection head 54, the control section 70 transmits a delivery request for a new refill container in addition to a delivery request for a new liquid ejection head. Consequently, it is possible to request delivery of a new refill container corresponding to a liquid storage body having a small residual amount in accordance with a delivery timing of the new liquid ejection head.

In the delivery system 100 for the liquid ejection head, the same effect as (17) in the first embodiment can be achieved.

The present embodiment may be modified and implemented as follows. The present embodiment and the following modification examples may be implemented in combination with each other within a technically consistent scope.

The liquid ejection apparatus 11 is not limited to the off-carriage type as in the present embodiment in which the replaceable liquid storage body 28 is provided in a location different from the carriage unit 50, and may be of the on-carriage type in which the replaceable liquid storage body 28 is provided in the carriage unit 50. When the liquid ejection apparatus 11 is of the on-carriage type, the liquid ejection head 54 may be replaced without providing the first opening/closing valve 75*b*, the first atmosphere communication path 76, and the first atmosphere opening valve 76*a*. Even when the liquid ejection apparatus 11 is of the off-carriage type, the first atmosphere communication path 76 and the first atmosphere opening valve 76*a* does not need to be provided, and the first opening/closing valve 75*b* may be replaced with a pressure regulating valve that is opened when a downstream thereof has a predetermined negative pressure.

When the liquid ejection apparatus 11 is of the off-carriage type as in the present embodiment, the liquid ejection head 54 may configure a head unit integrally with a reservoir that reserves the liquid L supplied to the liquid ejection head 54. Even when the liquid ejection apparatus 11 is of the on-carriage type, the liquid ejection head 54 may configure a head unit integrally with a reservoir that reserves the liquid L supplied to the liquid ejection head 54 in order to continuously supply the liquid from the liquid storage body 28 to the liquid ejection head 54. When the head unit is configured integrally with the reservoir, delivery is performed in units of the head unit. In this case, a new liquid ejection head unit of which a reservoir is filled with the liquid L may be delivered. The new liquid ejection head unit to be delivered is already filled with the liquid L. Thus, it is not necessary to perform an operation of filling the liquid ejection head 54 with a liquid after the liquid ejection head unit is replaced. A user can use the liquid ejection apparatus 11 immediately after replacing the liquid ejection head unit.

The liquid storage body 28 may be provided outside the casing 12.

Although there are four types of liquids L used in the liquid ejection apparatus 11 of the present embodiment, any number of liquids L may be used in the liquid ejection apparatus 11. The liquid L used in the liquid ejection apparatus 11 may be one type.

In the present embodiment, the liquid ejection head 54 has the monitoring section 55, but the monitoring section 55 may be provided in a location other than the liquid ejection head 54. In the present embodiment, in order to employ a method of acquiring residual vibration information of the liquid chamber in the liquid ejection head 54 and determining whether or not ejection is normal, the liquid ejection head 54 has a monitoring section 55. However, when the liquid ejection apparatus 11 employs another monitoring method, it is desirable that the monitoring section 55 is provided in a location suitable for the monitoring method.

In the present embodiment, the automatic maintenance is executed in accordance with a result of which a notification is sent from the monitoring section 55 after one print job is finished, but, when one print job is finished, the control section 70 may display a message on the display section 26 and allow a user to perform the manual maintenance by using the operation section 25 in accordance with a result of which a notification is sent from the monitoring section 55.

In the present embodiment, after one print job is finished, the automatic maintenance is executed in accordance with a result of which a notification is sent from the monitoring section 55, but the automatic maintenance may be executed in accordance with a result of which a notification is sent from the monitoring section 55 every time one page of one print job is printed. In this case, when the detector 70*a* detects that an operation of performing the automatic maintenance after finishing of printing of one page of one print job has been repeatedly executed a plurality of times, it may be determined that a problem related to ejection has occurred.

Even when maintenance has not been repeatedly executed a predetermined number of times or more, in a case where the detector 70*a* detects that an operation of performing maintenance within a predetermined period has been executed a predetermined number of times or more, the detector 70*a* may determine that a problem related to ejection has occurred. Even when the maintenance has not been repeatedly executed a predetermined number of times or more, in a case where the maintenance has been performed a predetermined number of times or more most recently, there is a high probability that the liquid ejection head 54 may have a problem. For example, when the detector 70*a* detects that an operation of performing maintenance during 24 hours has been executed a predetermined number of times or more, the detector 70*a* may determine that a problem related to ejection has occurred.

The above predetermined period does not need to be time. For example, the predetermined period may be a period from when the power switch 25*a* is turned on until the power switch 25*a* is turned off. When the detector 70*a* detects that an operation of executing maintenance has been executed a predetermined number of times or more within the most recently printed predetermined number of sheets, the detector 70*a* may determine that a problem related to ejection has occurred.

The liquid ejection head 54 does not need to include the IC chip 56 or a storage section in place of the IC chip 56. In this case, the ejection-related problem history information is stored only in the memory of the control section 70. In a case where the liquid ejection head replacement flow is executed, the control section 70 unconditionally may determine that the new liquid ejection head 54 is attached when the liquid ejection head 54 is attached, reset the ejection-related problem history information stored in the memory of the control section 70, and initialize the ejection-related problem flag.

The IC chip 56 included in the liquid ejection head 54 may be an IC chip that can only be read. In this case, only the model information is stored in the IC chip 56. Based on the model information, the control section 70 can determine whether or not the liquid ejection head 54 is a new liquid ejection head 54 when the liquid ejection head 54 is attached.

The ejection-related problem history information does not need to be stored in the memory of the IC chip 56 or the control section 70. It may be determined whether or not a problem related to ejection is determined as having occurred depending on whether or not the automatic maintenance or the manual maintenance is performed immediately before the problem related to ejection occurs. There may be a configuration in which the number of times of the automatic maintenance or the manual maintenance is stored only in the memory of the control section 70, and the number of times of the automatic maintenance or the manual maintenance is reset when the power switch 25*a* is turned off.

The ejection-related problem history information stored in the IC chip 56 may be only information regarding the presence or absence of the occurrence of a problem related to ejection. For example, "zero" is written in the ejection-related problem history information of the new liquid ejection head 54, and, when the detector 70*a* detects a problem related to ejection, the control section 70 may rewrite "zero" in the ejection-related problem history information in the IC chip 56 of the attached liquid ejection head 54 to 1. In step S606 in FIG. 11, the control section 70 may determine whether or not the liquid ejection head 54 has a problem related to ejection based on the ejection-related problem history information in the IC chip 56.

The ejection-related problem history information may include other information. For example, the ejection-related problem history information may include the number of times of inputting the occurrence of a problem related to ejection. When the number of times of inputting the occurrence of a problem related to ejection exceeds a specified number of times, the liquid ejection apparatus 11 may not accept cancellation of prohibition of use.

The maintenance history information stored in the IC chip 56 or the memory of the control section 70 as the ejection-related problem history information may include information regarding the date and time at which the maintenance was performed or information regarding the number of printed sheets after the liquid ejection head 54 was used when the maintenance was performed.

In a case where a user has input the occurrence of a problem related to ejection or a delivery request for a new liquid ejection head, when maintenance has not been performed before the input, the control section 70 may automatically perform the maintenance flow, and allow the user to select "recovered" or "not recovered" at the end of the maintenance flow. That is, in step S502 in FIG. 10, the control section 70 may check whether or not maintenance has been performed before the input, and proceed to step S511 when the determination result is NO. When "not recovered" is selected in step S514, the control section 70 may proceed to the delivery flow in step S503.

In a case where a user has input the occurrence of a problem related to ejection or a delivery request for a new liquid ejection head, when maintenance has not been performed before the input, the process may proceed to the maintenance flow in the check flow. That is, in step S502 in FIG. 10, the control section 70 checks whether or not maintenance has been performed before the input, and, when the determination result is NO, in step S511, the control section 70 may start the maintenance flow as manual maintenance. When the maintenance flow is executed to the end, "recovered" or "not recovered" may be selected. When "not recovered" is selected, the control section 70 may proceed to the delivery flow in step S503.

In a case where a user has input the occurrence of a problem related to ejection or a delivery request for a new liquid ejection head, the control section 70 may check, with the user, whether or not maintenance has been performed, proceed to the maintenance flow when the maintenance has not been performed, and allow the user to select "recovered" or "not recovered" at the end of the maintenance flow. When "not recovered" is selected, the control section 70 may proceed to the delivery flow. The control section 70 may set step S502 in FIG. 10 as a step of checking, with the user, whether or not maintenance has been performed before the input. This maintenance may be automatic maintenance or manual maintenance.

When the new liquid ejection head 54 is delivered, the liquid storage body 28 for initial filling or a refill container may be delivered together.

After a delivery request for a new liquid ejection head is made, the control section 70 may give a notification for prompting replacement with the new liquid ejection head until the replacement of the liquid ejection head 54 is completed.

After a delivery request for a new liquid ejection head is made, the control section 70 may give a notification for prompting replacement with the new liquid ejection head only when some operation is performed by the user by using the operation section 25.

The liquid ejection apparatus 11 or the server apparatus 80 may store a period from detection of a problem in the liquid ejection head 54 to replacement with the new liquid ejection head 54. Since correct printing cannot be performed during this period, services such as refunds, gifts, and plan content changes corresponding to the stored period may be returned to the user.

Even in a case where a problem in the liquid ejection head 54 is detected, when the user does not select to perform replacement with a new liquid ejection head, services such as refunds, gifts, and plan content changes corresponding to the same may be returned to the user.

For recycling of the liquid ejection head 54, a system for collecting the replaced old liquid ejection head 54 may be built. For example, the user puts the old liquid ejection head 54 in a box in which the new liquid ejection head 54 was packed and returns the box. For example, when a collection box for the old liquid ejection head 54 is pre-delivered to the user, the user puts the old liquid ejection head 54 in the box in advance, and the new liquid ejection head 54 is delivered, a delivery trader collects the box. For example, the user takes the old liquid ejection head 54 to a nearest consumer electronics retail store.

A specified number of times of maintenance performed by the user, for immediately proceeding to the delivery flow, may differ when the occurrence of a problem related to ejection is input to the input section and when a delivery request is input to the input section.

A predetermined threshold value for a residual amount of the liquid storage body 28 may differ for each user or for each liquid ejection apparatus used by the user depending on the number of days until a new liquid storage body 28 or a new refill container arrives at the user, the frequency with which the liquid L is used in the liquid ejection apparatus 11, and the like. When the liquid ejection apparatus 11 includes a plurality of types of liquid storage bodies 28, the predetermined threshold value may differ for each liquid storage body 28.

When the user has requested delivery, the control section 70 may proceed to the delivery flow regardless of the number of times of maintenance. That is, the control section 70 may immediately proceed to the delivery flow without performing automatic maintenance.

When the user determines that a recovery from the problem related to ejection has been made a little from the results of the automatic maintenance and the nozzle check printing in steps S511 to S513 in FIG. 12, a flow is configured such that the user causes the control section 70 to perform the automatic maintenance again. A recovery from defective ejection may be made through a plurality of number of times of automatic maintenance.

Even when a delivery request for a new liquid ejection head from the user is not selected in the delivery flow, a flow may be configured such that the control section 70 transmits a delivery request for all new liquid storage bodies or new refill containers from the user to the server apparatus 80.

The liquid ejection apparatus 11 may be provided with a mode in which almost all the liquids L in the liquid ejection apparatus 11 from the liquid storage bodies 28 to the liquid ejection head 54 are discharged from the liquid flow paths in the liquid ejection apparatus 11. When a cause of a problem related to ejection is the liquid L, the mode is executed, and thus most of the liquid L that is the cause of the problem related to ejection is discharged from the liquid flow path in the liquid ejection apparatus 11. Thereafter, since a new liquid storage body 28 is attached or the liquid storage body 28 is replenished with the liquid L from a new refill container such that the new liquid L flows into the liquid flow path in the liquid ejection apparatus 11, the control section 70 can make a recovery from a problem related to ejection in the liquid ejection apparatus 11.

Third Embodiment

Hereinafter, a delivery system including a liquid ejection apparatus and a liquid ejection apparatus according to a third embodiment will be described with reference to the drawings. The liquid ejection apparatus is, for example, an ink jet printer that ejects ink that is an example of a liquid, to performing printing on a medium such as paper.

Figure 13:
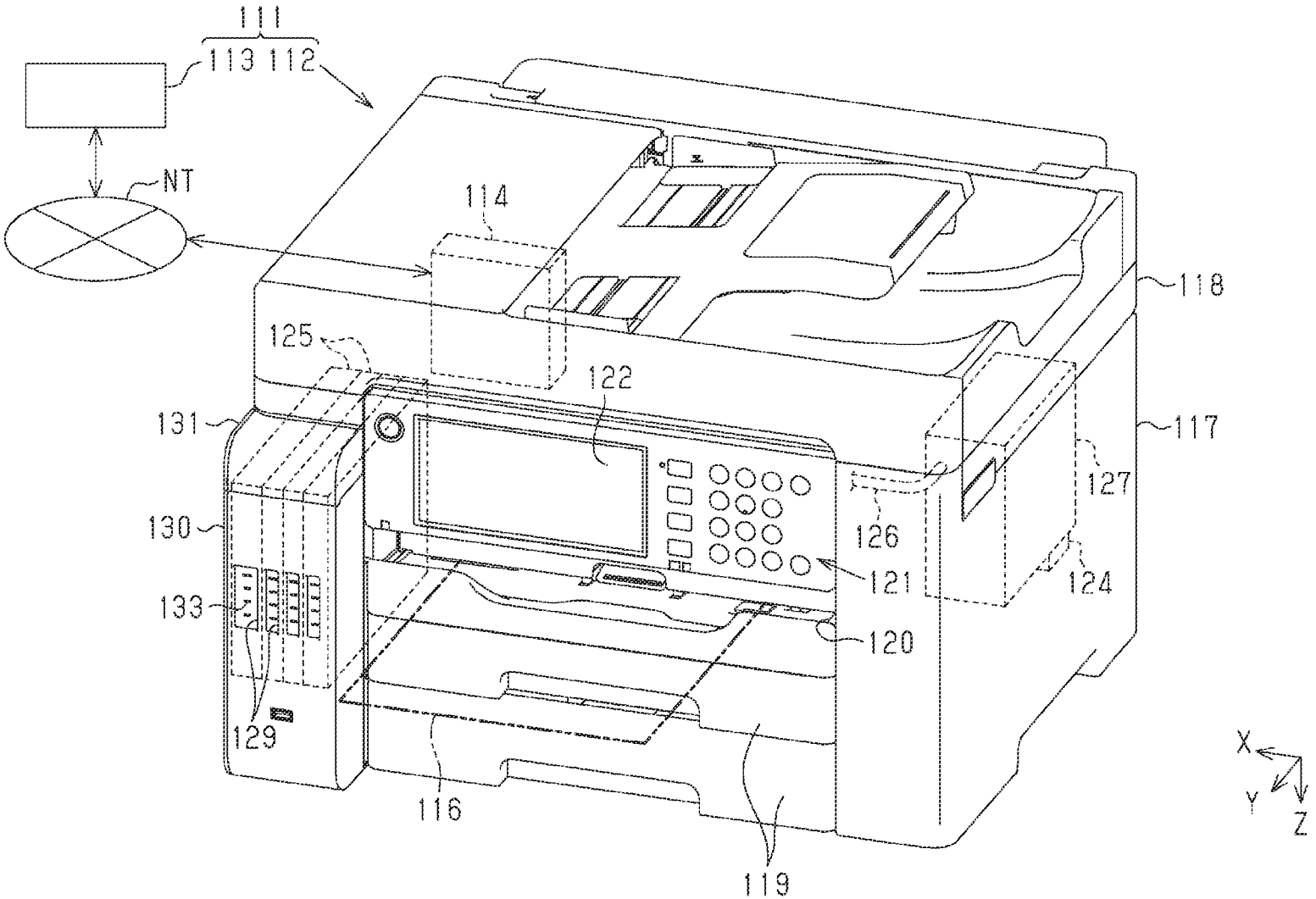
FIG. 13 is a schematic view illustrating a delivery system according to a third embodiment.

As illustrated in FIG. 13, a delivery system 111 includes a liquid ejection apparatus 112 that ejects a liquid to perform printing, and a server 113 that can communicate with the liquid ejection apparatus 112. The delivery system 111 may include a plurality of liquid ejection apparatuses 112 coupled to a single server 113.

The liquid ejection apparatus 112 includes a control section 114 capable of communicating with the server 113 via a network NT. The control section 114 is configured with, for example, a computer, a processing circuit including a memory, and the like, and executes various processes executed by the liquid ejection apparatus 112 according to a program stored in the memory.

In the drawings, a direction of gravity is indicated by a Z axis when the liquid ejection apparatus 112 is placed on a horizontal plane, and directions along the horizontal plane are indicated by an X axis and a Y axis. The X axis, Y axis, and Z axis are orthogonal to each other.

The liquid ejection apparatus 112 may include a printing unit 117 performing printing on a medium 116 and a reading unit 118 reading an image of an original document (not illustrated). The liquid ejection apparatus 112 may include a medium storage section 119 capable of storing a plurality of media 116, and a discharge section 120 from which the printed medium 116 is discharged. The liquid ejection apparatus 112 may include an operation section 121 configured with buttons and the like for performing various operations on the liquid ejection apparatus 112, and a display section 122 displaying information. The display section 122 may be a touch panel.

The liquid ejection apparatus 112 includes a liquid ejection head 124 that ejects a liquid onto the medium 116 to perform printing, and a liquid storage body 125 that stores the liquid to be supplied to the liquid ejection head 124. The liquid ejection apparatus 112 may include a liquid supply flow path 126 through which a liquid is supplied from the liquid storage body 125 to the liquid ejection head 124, and a carriage 127 that movably holds the liquid ejection head 124. A part of the liquid supply flow path 126 may be configured with, for example, a tube that is deformed following the carriage 127 that is being moved.

The liquid ejection apparatus 112 may include a casing 130 provided with a window portion 129 that exposes a part of the liquid storage body 125 to the outside, and a casing cover 131 provided above the liquid storage body 125. The casing cover 131 is movably provided at a closing position illustrated in FIG. 13 and an opening position illustrated in FIG. 14.

The liquid ejection apparatus 112 may include a plurality of liquid storage bodies 125 fixed in the casing 130. The casing 130 of the present embodiment stores four liquid storage bodies 125, and the casing 130 is provided with four window portions 129 corresponding to the respective liquid storage body 125. When the liquid storage body 125 is made of, for example, a transparent or translucent resin, a liquid level of the stored liquid is visible from the window portion 129. The liquid storage body 125 may be provided with a scale 133 at a position exposed from the window portion 129.

Figure 14:
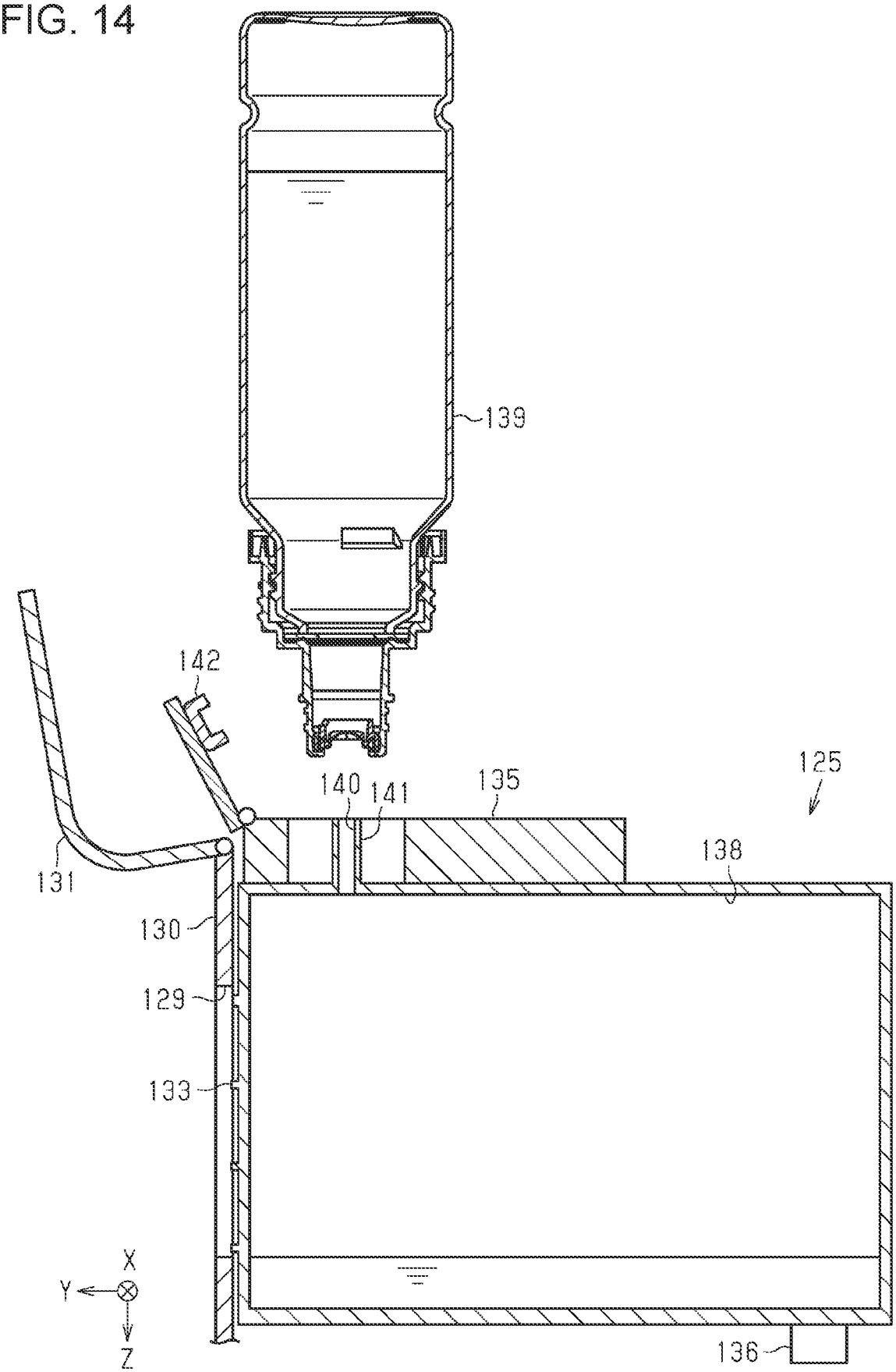
FIG. 14 is a schematic sectional view of a liquid storage body and a refill container.

As illustrated in FIG. 14, the liquid ejection apparatus 112 has a holding portion 135 that holds a plurality of liquid storage bodies 125 in a state of being arranged in the X axis direction, and a residual amount detector 136 that detects an amount of the liquid stored in the liquid storage body 125. As the residual amount detector 136, for example, a reflection type optical sensor, a transmission type optical sensor, an electrode pin, or a capacitance sensor may be used.

The liquid storage body 125 has a storage chamber 138 storing the liquid and a pour 140 used for refilling the storage chamber 138 with the liquid from the refill container 139. The liquid storage body 125 may have a tubular portion 141 through which the pour 140 is opened. The holding portion 135 of the present embodiment includes a plug 142 that closes the pour 140. The plug 142 is movably provided between a closing position illustrated in FIG. 15 at which the pour 140 is closed and a refill position illustrated in FIG. 14 at which the pour 140 is opened. The refill of the liquid storage body 125 with the liquid is performed by inserting the refill container 139 into the tubular portion 141 in a state in which the casing cover 131 is located at the opening position and the plug 142 is located at the refill position.

When color printing is possible with the liquid ejection apparatus 112, the plurality of liquid storage bodies 125 respectively store different types of liquids. For example, the four liquid storage bodies 125 respectively store liquids with corresponding colors such as black, cyan, magenta, and yellow.

Figure 15:
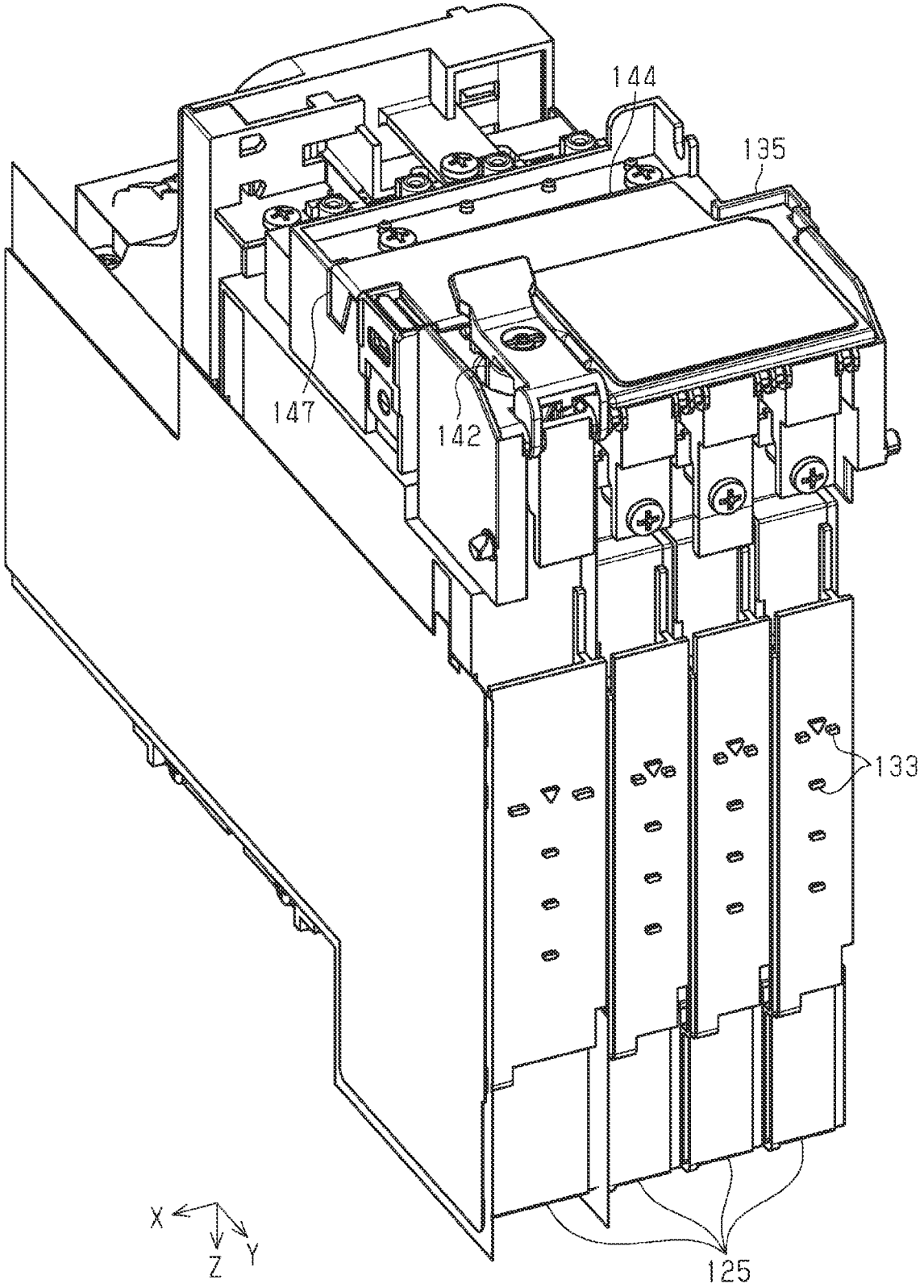
FIG. 15 is a perspective view of a plurality of liquid storage bodies.

As illustrated in FIG. 15, the liquid ejection apparatus 112 of the present embodiment includes a pour cover 144 that covers a plurality of pours 140, and performs monochromatic printing exclusively. The pour cover 144 covers the pours 140 of the liquid storage bodies 125 for colors corresponding to cyan, magenta, and yellow. One liquid storage body 125 having the pour 140 that is not covered with the pour cover 144 stores, for example, a black liquid.

Figure 16:
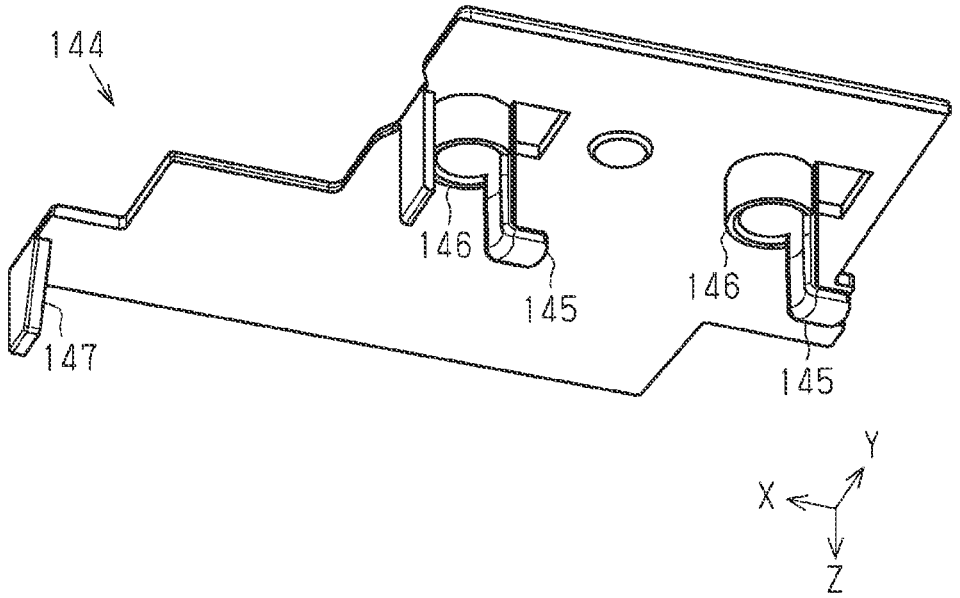
FIG. 16 is a perspective view of a pour cover.

As illustrated in FIG. 16, the pour cover 144 includes a hook 145 that is engaged with the holding portion 135, a cap 146 that is covered with the tubular portion 141, and a positioning portion 147 that positions the pour cover 144 with respect to the holding portion 135.

Figure 17:
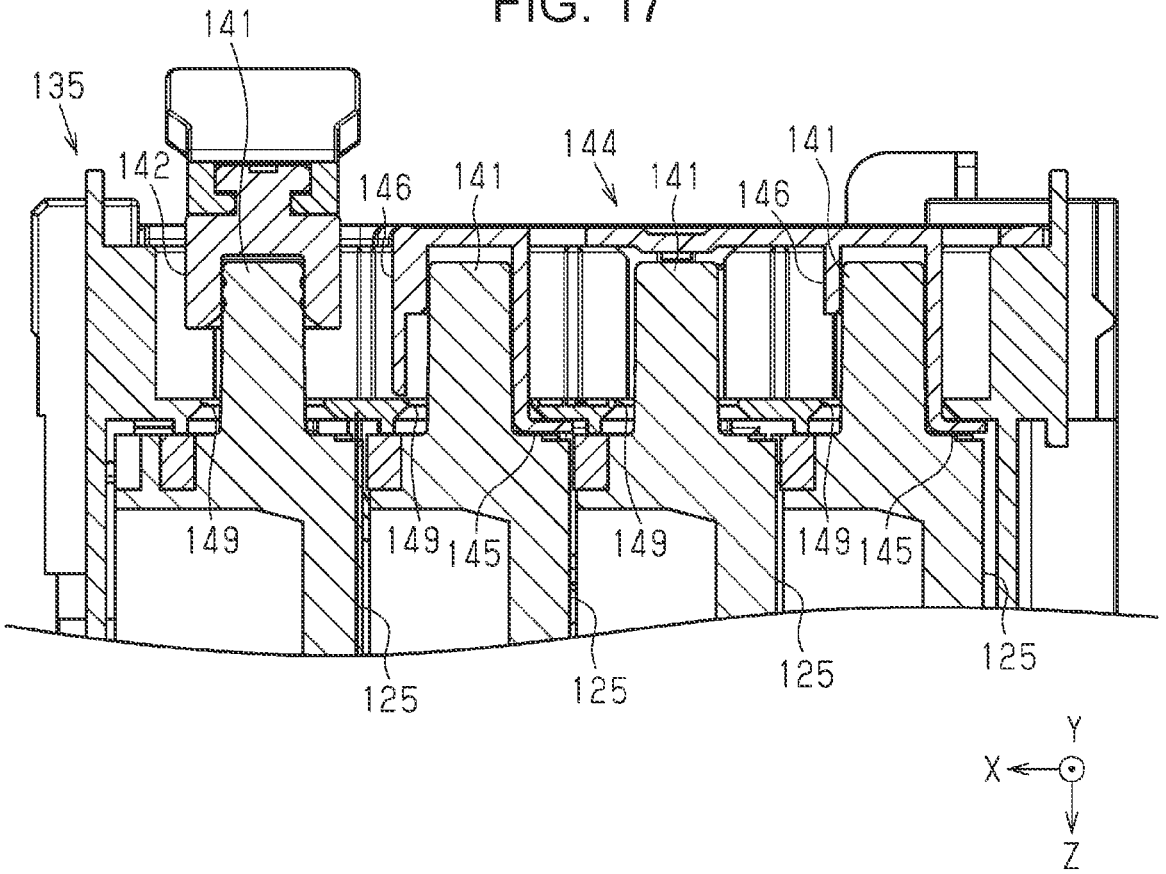
FIG. 17 is a sectional view of the pour cover and a holding portion.

As illustrated in FIG. 17, the holding portion 135 has a plurality of through-holes 149 through which the tubular portions 141 pass. The pour cover 144 is attached to the holding portion 135 by hooking the hook 145 to an edge of the through-hole 149. The holding portion 135 is fixed to the plurality of liquid storage bodies 125 in a state in which the pour cover 144 is attached, and the pour cover 144 is fitted to the cap 146 at the tip of the tubular portion 141 and thus movement thereof in the X axis direction and the Y axis direction is restricted.

Next, a description will be made of a refill routine executed by the control section 114 with reference to flowcharts of FIGS. 18 and 19. The control section 114 executes the refill routine at a timing at which power of the liquid ejection apparatus 112 is turned on.

Figure 18:
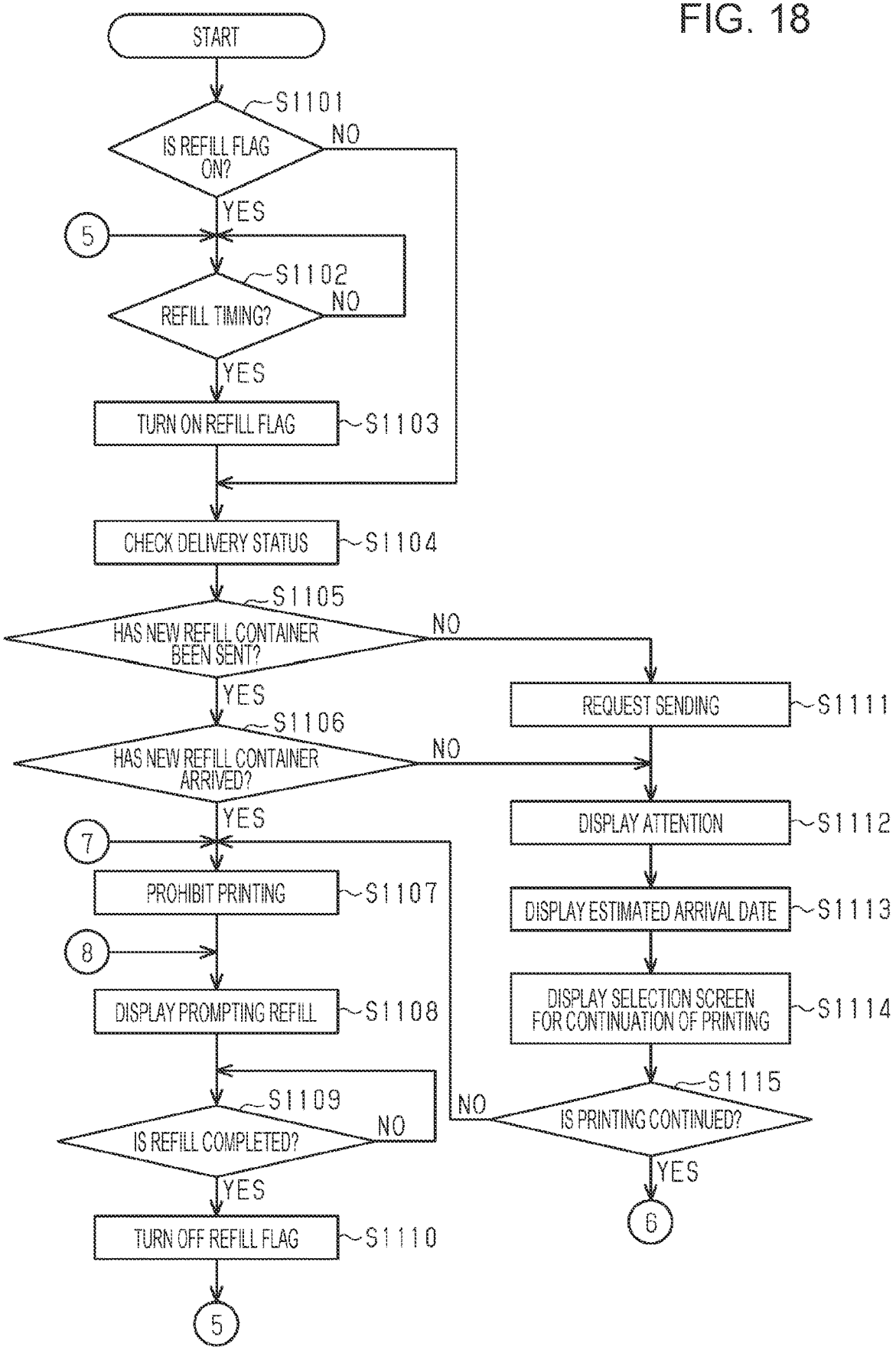
FIG. 18 is a flowchart illustrating a refill routine.

As illustrated in FIG. 18, in step S1101, the control section 114 determines whether or not a refill flag is on. When the refill flag is off, a determination result in step S1101 is NO, and the control section 114 causes the process to proceed to step S1104. When the refill flag is on, the determination result in step S1101 is YES, and the control section 114 causes the process to proceed to step S1102. In step S1102, the control section 114 determines whether or not a refill timing at which the liquid storage body 125 is required to be refilled with the liquid has come.

Based on a detection result from the residual amount detector 136, when a residual amount of the liquid stored in the liquid storage body 125 is more than a residual amount threshold value, the control section 114 determines that the refill timing of the liquid storage body 125 has not come, and a determination result in step S1102 is NO. The control section 114 waits until the refill timing comes.

When the residual amount is equal to or less than the residual amount threshold value, the control section 114 determines that the refill timing has come, and the determination result in step S1102 is YES. The control section 114 causes the process to proceed to step S1103. In step S1103, the control section 114 turns on the refill flag.

In step S1104, the control section 114 checks a delivery status of the new refill container 139 with the server 113. In step S1105, the control section 114 determines whether or not the new refill container 139 has been sent. When the new refill container 139 has already been sent, a determination result in step S1105 is YES, and the control section 114 causes the process to proceed to step S1106.

In step S1106, the control section 114 determines whether the new refill container 139 has arrived at the user. When the control section 114 has received a delivery completion notification transmitted from the server 113, the control section 114 determines that the new refill container 139 has arrived, and a determination result in step S1106 is YES. The control section 114 causes the process to proceed to step S1107.

In step S1107, the control section 114 prohibits printing. In step S1108, the control section 114 performs display for prompting refill with the liquid on the display section 122. In step S1109, the control section 114 determines whether or not the refill of the liquid storage body 125 is completed. When the refill is not completed, a determination result in step S1109 is NO, and the control section 114 waits until the refill is completed. When the refill is completed, the determination result in step S1109 is YES, and the control section 114 causes the process to proceed to step S1110. In step S1110, the control section 114 turns off the refill flag and causes the process to proceed to step S1102.

In step S1105, when the new refill container 139 has not been sent, a determination result in step S1105 is NO. The control section 114 causes the process to proceed to step S1111. In step S1111, the control section 114 requests the server 113 to send the new refill container 139, and causes the process to proceed to step S1112.

When the control section 114 has not received the delivery completion notification in step S1106, the control section 114 determines that the new refill container 139 has not arrived, and a determination result in the step S1106 is NO. The control section 114 causes the process to proceed to step S1112.

In step S1112, the control section 114 displays, on the display section 122, attention when printing is continued. In step S1113, the control section 114 displays the estimated arrival date of the new refill container 139 on the display section 122. In step S1114, the control section 114 displays a screen from which printing continuation can be selected on the display section 122.

In step S1115, the control section 114 determines whether or not to continue printing. When the user does not select to continue printing, a determination result in step S1115 is NO, and the control section 114 causes the process to proceed to step S1107. When the user selects to continue printing, the determination result in step S1115 is YES, and the control section 114 causes the process to proceed to step S1201.

Figure 19:
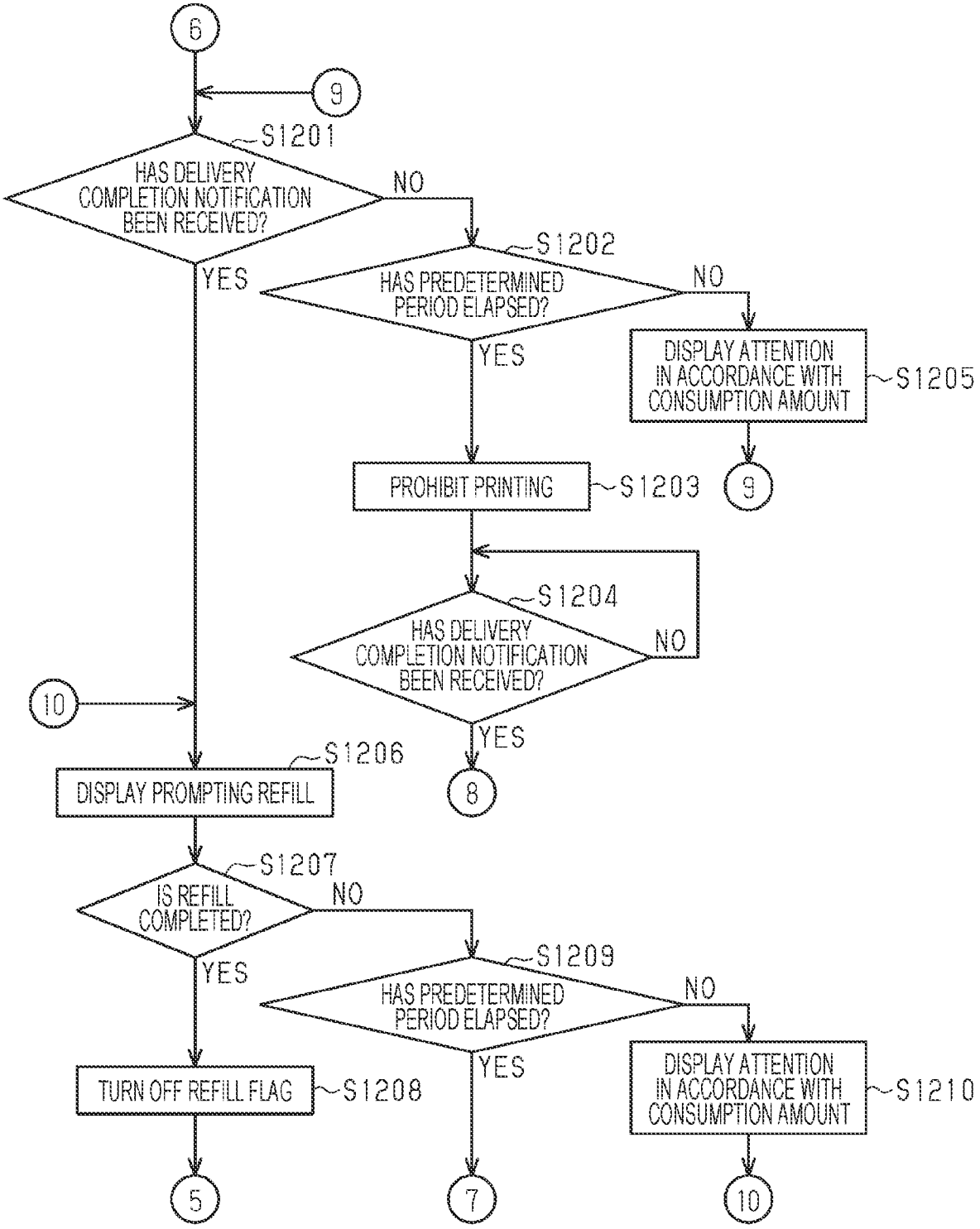
FIG. 19 is a flowchart illustrating the refill routine.

As illustrated in FIG. 19, in step S1201, the control section 114 determines whether or not the delivery completion notification transmitted from the server 113 has been received. When the delivery completion notification has not been received, a determination result in step S1201 is NO. The control section 114 causes the process to proceed to step S1202. In step S1202, the control section 114 determines whether or not a predetermined period has elapsed from the refill timing. When the predetermined period has elapsed, the determination result in step S1202 is YES, and the control section 114 causes the process to proceed to step S1203.

In step S1203, the control section 114 prohibits printing. In step S1204, the control section 114 determines whether or not the delivery completion notification transmitted from the server 113 has been received. When the delivery completion notification has not been received, a determination result in step S1204 is NO, and the control section 114 waits until the delivery completion notification is received. When the delivery completion notification has been received, the determination result in step S1204 is YES, and the control section 114 causes the process to proceed to step S1108.

When the predetermined period has not elapsed in step S1202, a determination result in step S1202 is NO, and the control section 114 causes the process to proceed to step S1205. In step S1205, the control section 114 displays attention on the display section 122 according to an amount of the consumed liquid, and causes the process to proceed to step S1201.

When the delivery completion notification has been received in step S1201, the determination result in step S1201 is YES, and the control section 114 causes the process to proceed to step S1206. In step S1206, the control section 114 performs display for prompting refill with the liquid on the display section 122.

In step S1207, the control section 114 determines whether or not the refill of the liquid to the liquid storage body 125 is completed. When the refill is completed, the determination result in step S1207 is YES, and the control section 114 causes the process to proceed to step S1208. In step S1208, the control section 114 turns off the refill flag and causes the process to proceed to step S1102.

When the refill is not completed in step S1207, a determination result in step S1207 is NO, and the control section 114 causes the process to proceed to step S1209. In step S1209, when the predetermined period has elapsed from the refill timing, a determination result in step S1209 is YES, and the control section 114 causes the process to proceed to step S1107. When the predetermined period has not elapsed from the refill timing, the determination result in step S1209 is NO, and the control section 114 causes the process to proceed to step S1210. In step S1210, the control section 114 displays attention on the display section 122 according to an amount of the consumed liquid, and causes the process to proceed to step S1206.

An operation of the present embodiment will be described.

The control section 114 checks a delivery status of the new refill container 139 with the server 113 at a refill timing at which the liquid storage body 125 needs to be refilled with the liquid.

Figure 20:
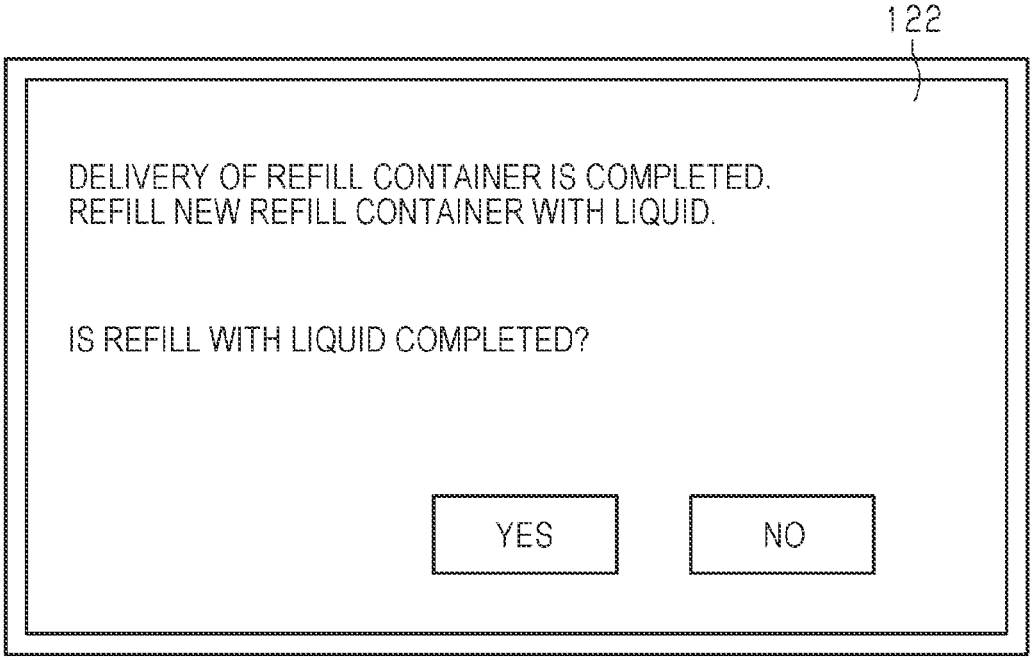
FIG. 20 is a schematic view of a display section displaying a refill prompting screen.

As illustrated in FIG. 20, when the new refill container 139 has been sent and has arrived at the refill timing, the control section 114 may prohibit printing and display a refill prompting screen for prompting refill with the liquid on the display section 122. When the operation section 121 is operated by the user and information indicating that the refill is completed is input, the control section 114 may determine that the refill with the liquid is completed. The control section 114 may determine that the refill is completed when a residual amount of the liquid stored in the liquid storage body 125 is more than the residual amount threshold value.

Figure 21:
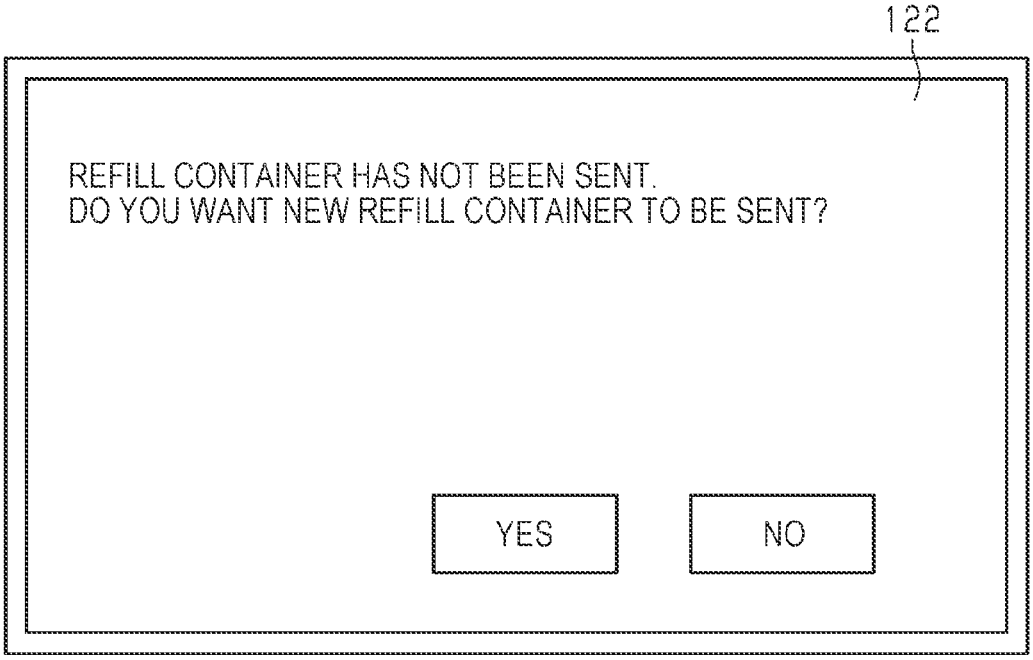
FIG. 21 is a schematic view of a display section that displays a sending check screen.

As illustrated in FIG. 21, when the new refill container 139 has not been sent at the refill timing, the display section 122 may display a sending check screen for checking sending of the new refill container 139 on the display section 122. When the operation section 121 is operated by the user and sending of the new refill container 139 is selected, the control section 114 makes a sending request to the server 113. When sending of the new refill container 139 is not selected, control 114 prohibits printing until the liquid storage body 125 is completely refilled with a liquid or sending of the new refill container 139 is selected.

Figure 22:
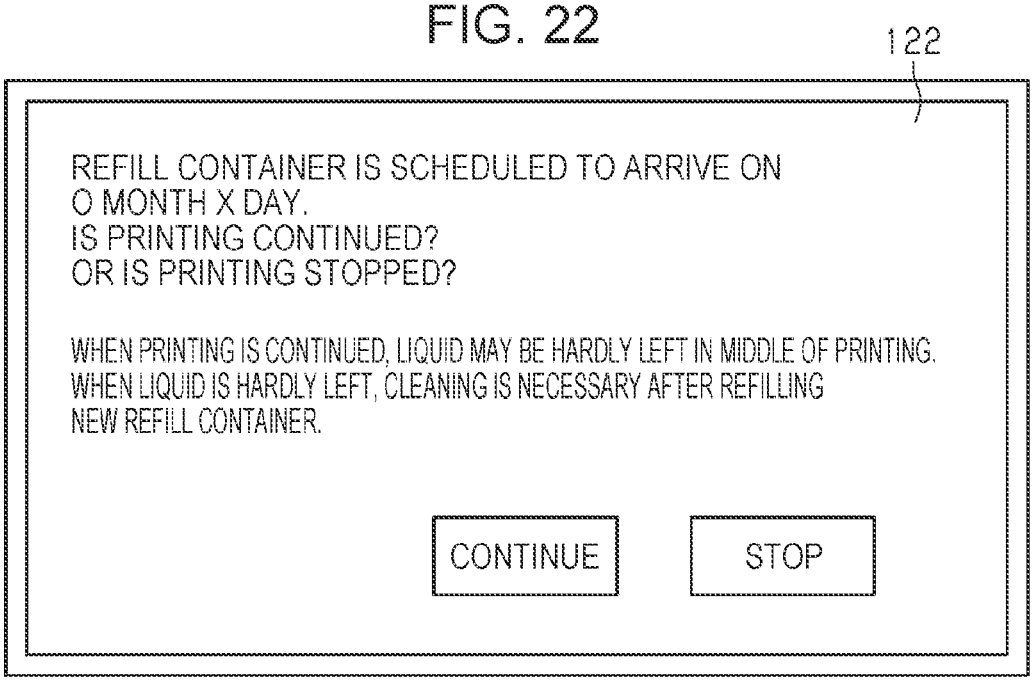
FIG. 22 is a schematic view of a display section displaying a continuation selection screen.

As illustrated in FIG. 22, the control section 114 that has made the sending request for the refill container 139 displays a continuation selection screen on the display section 122, so that the control section 114 brings a state in which continuation of temporary printing is selectable after calling attention. The continuation selection screen may include attention when continuation of printing is selected and the estimated arrival date of the new refill container 139. That is, the control section 114 may display the estimated arrival date of the new refill container 139 on the display section 122. The control section 114 temporarily continues printing when the user selects continuation. The control section 114 prohibits printing when the user selects stop.

As illustrated in FIG. 22, the control section 114 may display the continuation selection screen on the display section 122 even when the new refill container 139 has been sent but has not arrived at the refill timing. That is, the control section 114 brings a state in which continuation of temporary printing is selectable after calling attention.

As illustrated in FIG. 14, in the liquid storage body 125 at the refill timing, for example, a liquid level of the stored liquid is at the bottom scale 133, and thus the liquid remains. When the continuation of temporary printing is selected at the refill timing, the liquid ejection apparatus 112 performs printing with the liquid remaining in the liquid storage body 125.

In a state where printing can be temporarily continued, the control section 114 may change a content of attention in accordance with an amount of the liquid consumed after the refill timing. For example, the control section 114 may gradually increase the degree of attention by changing a color and wording of the attention as a consumption amount increases. Specifically, when there is concern that the liquid in the liquid storage body 125 is not left and thus air may enter the liquid supply flow path 126, the control section 114 may increase the degree of attention. When there is concern that the liquid in the liquid supply flow path 126 is not left and air may enter the liquid ejection head 124, the control section 114 may further increase the degree of attention. The control section 114 may increase the degree of attention each time a print job is executed.

When the new refill container 139 arrives at the user, the server 113 transmits a delivery completion notification to the liquid ejection apparatus 112. When the delivery completion notification of the new refill container 139 is received from the server 113 in a state in which printing can be temporarily continued, the control section 114 may perform display for prompting refill with the liquid on the display section 122 until the liquid storage body 125 is refilled with the liquid. Specifically, the control section 114 displays the refill prompting screen illustrated in FIG. 20 on the display section 122.

After receiving the delivery completion notification from the server 113, the control section 114 may prohibit printing when a period in which refill with the liquid is not performed exceeds a predetermined period. The predetermined period may be, for example, a period until execution of a print job is finished when a delivery completion notification is received while printing is being executed, or a period in which a predetermined amount of the liquid is consumed.

When continuation of printing is selected at the refill timing and printing is executed, the control section 114 fills the liquid supply flow path 126 and the liquid ejection head 124 with the liquid when the liquid storage body 125 is refilled with the liquid. The filling with the liquid may be performed by, for example, cleaning in which the liquid in the liquid ejection head 124 is subjected to negative pressure or pressurization and thus the liquid is forced to be discharged from a nozzle (not illustrated).

The effects of the present embodiment will be described.

(1) At a refill timing at which the liquid storage body 125 needs to be refilled with a liquid, a small amount of the liquid remains in the liquid storage body 125, the liquid supply flow path 126 coupling the liquid storage body 125 to the liquid ejection head 124, and the liquid ejection head 124. However, when printing is performed by using the liquid, there is concern that air may enter the liquid supply flow path 126 and the liquid ejection head 124, and thus it is necessary to perform work of filling the liquid supply flow path 126 and the liquid ejection head 124 with the liquid in the future. In relation to this fact, the control section 114 checks a delivery status of the new refill container 139 with the server 113 at the refill timing, and brings a state in which continuation of temporary printing is selectable after calling attention when the refill container 139 has been sent but has not arrived. Thus, the user can check the delivery status of the new refill container 139 at the refill timing, and can temporarily continue printing even when the new refill container 139 has not arrived. Thus, it is possible to reduce concern that a period in which printing is to be stopped may occur.

(2) At the refill timing, the control section 114 makes a sending request to the server 113 when the new refill container 139 has not been sent. Thus, it is possible to save the user's time and effort to prepare the new refill container 139.

(3) The control section 114 displays the estimated arrival date of the new refill container 139 on the display section 122. Thus, the user can use the estimated arrival date to determine whether to temporarily continue printing or wait for the arrival of the new refill container 139.

(4) For example, when printing is continued until the liquid in the liquid ejection head 124 is not left, there is concern that defective ejection may occur even after the liquid ejection head 124 is filled with the liquid. In relation to this fact, when the control section 114 receives a delivery completion notification of the new refill container 139 from the server 113, the control section 114 continues to perform display for prompting refill with the liquid on the display section 122 until the liquid storage body 125 is refilled with the liquid. Thus, it is possible to reduce concern that the liquid in the liquid ejection head 124 may not be left.

(5) The control section 114 prohibits printing when a period in which refill with the liquid is not performed exceeds a predetermined period after a delivery completion notification of the new refill container 139 is received. When the control section 114 receives the delivery completion notification from the server 113, the new refill container 139 is delivered to the user, and the user is ready to refill the liquid storage body 125 with the liquid from the refill container 139. Thus, it is possible to reduce concern that printing is continued without refill with the liquid even after the refill container 139 arrives.

(6) When continuation of temporary printing is selected at the refill timing, concern that the liquid in the liquid ejection head 124 may not be left increases as an amount of the consumed liquid increases. In relation to this fact, the control section 114 changes a content of attention according to an amount of the consumed liquid. Thus, the user can be informed of the high probability that the liquid in the liquid ejection head 124 may not be left.

(7) When the new refill container 139 has been sent and has arrived at the refill timing, the control section 114 prohibits printing and performs display for prompting refill with the liquid on the display section 122. Thus, it is possible to reduce concern that printing may be continued without refill with the liquid.

Fourth Embodiment

Hereinafter, a delivery system including a liquid ejection apparatus and a liquid ejection apparatus according to a fourth embodiment will be described with reference to the drawings. The fourth embodiment is different from the third embodiment in that the liquid storage body is attachable and detachable. The fourth embodiment is substantially the same as the third embodiment except for the above content, and thus an overlapping description will not be repeated by giving the same reference numeral to the same constituent.

Figure 23:
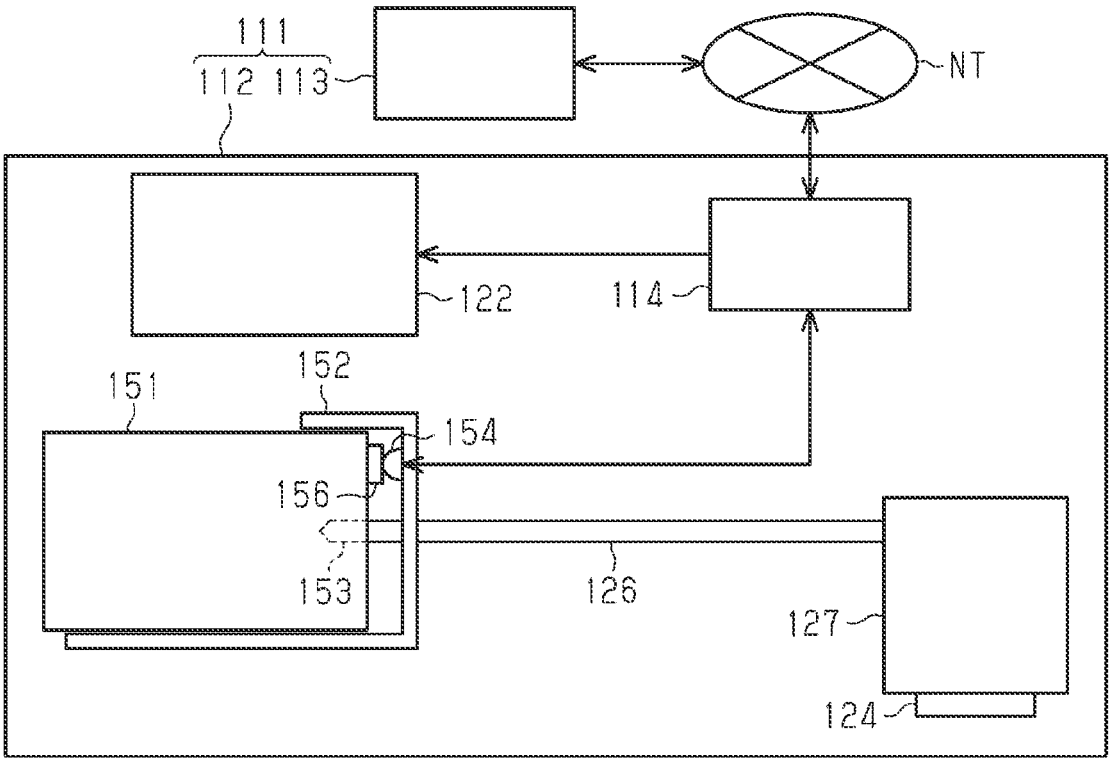
FIG. 23 is a schematic diagram illustrating a delivery system according to a fourth embodiment.

As illustrated in FIG. 23, a delivery system 111 includes a liquid ejection apparatus 112 and a server 113 that can communicate with the liquid ejection apparatus 112. The liquid ejection apparatus 112 includes a liquid ejection head 124 that ejects a liquid onto a medium 116 to perform printing, and a control section 114 that can communicate with the server 113 via a network NT. The liquid ejection apparatus 112 includes an attachment portion 152 to which a cartridge 151, which is an example of a liquid storage body storing a liquid to be supplied to the liquid ejection head 124, is detachably attached. The attachment portion 152 may include a supply needle 153 forming a part of the liquid supply flow path 126, and an electrical coupling portion 154 which is electrically coupled to the control section 114.

The cartridge 151 may include a storage medium 156 that stores information regarding the cartridge 151. The storage medium 156 is, for example, an IC chip. The storage medium 156 may store the type of liquid stored in the cartridge 151, an amount of the liquid stored in the cartridge 151, an identifier of the cartridge 151, and the like. The control section 114 may calculate an amount of the liquid stored in the cartridge 151 based on the information stored in the storage medium 156, and rewrite the information stored in the storage medium 156.

The storage medium 156 is electrically coupled to the electrical coupling portion 154, and the cartridge 151 attached to the attachment portion 152 can cause the stored liquid to flow out via the supply needle 153. The liquid stored in the cartridge 151 is supplied to the liquid ejection head 124 via the supply needle 153 and the liquid supply flow path 126.

The control section 114 can read information stored in the storage medium 156 or write information into the storage medium 156 when the electrical coupling portion 154 is electrically coupled to the storage medium 156. The electrical coupling portion 154 may be a connector that enables communication by contacting the storage medium 156, or may be a radio that wirelessly reads and writes information from and into the storage medium 156.

Next, a replacement routine executed by the control section 114 will be described with reference to flowcharts of FIGS. 24 and 25. The control section 114 executes the replacement routine at a timing at which power of the liquid ejection apparatus 112 is turned on.

Figure 24:
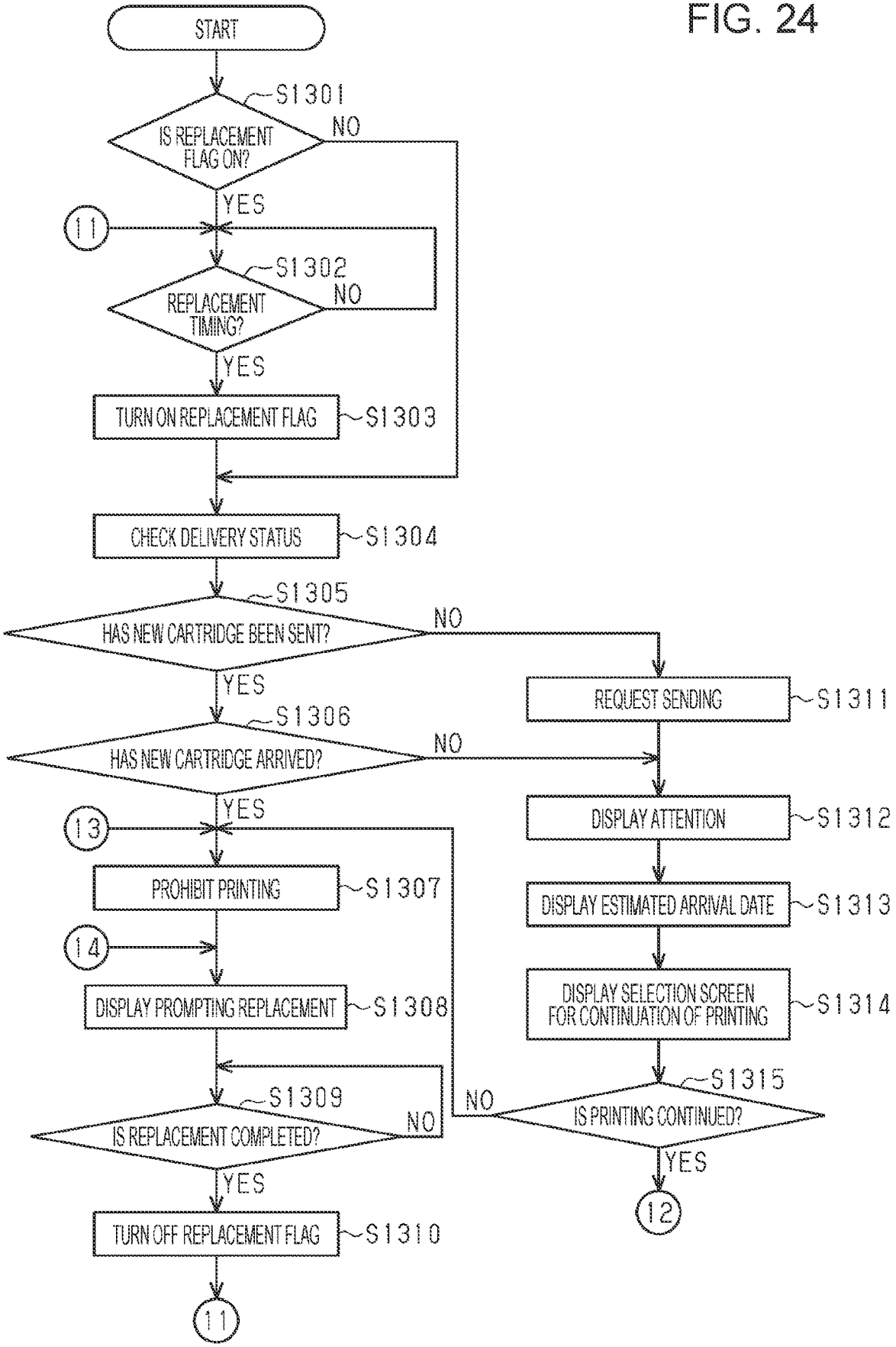
FIG. 24 is a flowchart illustrating a replacement routine.

As illustrated in FIG. 24, in step S1301, the control section 114 determines whether or not a replacement flag is on. When the replacement flag is off, a determination result in step S1301 is NO, and the control section 114 causes the process to proceed to step S1304. When the replacement flag is on, the determination result in step S1301 is YES, and the control section 114 causes the process to proceed to step S1302. In step S1302, the control section 114 determines whether or not a replacement timing at which the cartridge 151 is required to be replaced comes.

When a residual amount of the liquid stored in the cartridge 151 is more than a residual amount threshold value, the control section 114 determines that the replacement timing of the cartridge 151 has not come, and a determination result in step S1302 is NO. The control section 114 waits until the replacement timing comes.

When the residual amount is equal to or less than the residual amount threshold value, the control section 114 determines that the replacement timing has come, and the determination result in step S1302 is YES. The control section 114 causes the process to proceed to step S1303. In step S1303, the control section 114 turns on the replacement flag.

In step S1304, the control section 114 checks a delivery status of the new cartridge 151 with the server 113. In step S1305, the control section 114 determines whether the new cartridge 151 has been sent. When the new cartridge 151 has already been sent, a determination result in step S1305 is YES, and the control section 114 causes the process to proceed to step S1306.

In step S1306, the control section 114 determines whether the new cartridge 151 has arrived at the user. When the control section 114 has received a delivery completion notification transmitted from the server 113, the control section 114 determines that the new cartridge 151 has arrived, and a determination result in step S1306 is YES. The control section 114 causes the process to proceed to step S1307.

In step S1307, the control section 114 prohibits printing. In step S1308, the control section 114 performs display for prompting replacement of the cartridge 151 on the display section 122. In step S1309, the control section 114 determines whether or not the replacement of the cartridge 151 is completed. When the replacement is not completed, a determination result in step S1309 is NO, and the control section 114 waits until the replacement is completed. When the replacement is completed, the determination result in step S1309 is YES, and the control section 114 causes the process to proceed to step S1310. In step S1310, the control section 114 turns off the replacement flag and causes the process to proceed to step S1302.

In step S1305, when the new cartridge 151 has not been sent, the determination result in step S1305 is NO. The control section 114 causes the process to proceed to step S1311. In step S1311, the control section 114 requests the server 113 to send the new cartridge 151, and causes the process to proceed to step S1312.

When the control section 114 has not received the delivery completion notification in step S1306, the control section 114 determines that the new cartridge 151 has not arrived, and the determination result in step S1306 is NO. The control section 114 causes the process to proceed to step S1312.

In step S1312, the control section 114 displays, on the display section 122, attention when printing is continued. In step S1313, the control section 114 displays the estimated arrival date of the new cartridge 151 on the display section 122. In step S1314, the control section 114 displays a screen on the display section 122 on which printing continuation can be selected.

In step S1315, the control section 114 determines whether or not to continue printing. When the user does not select to continue printing, a determination result in step S1315 is NO, and the control section 114 causes the process to proceed to step S1307. When the user selects to continue printing, the determination result in step S1315 is YES, and the control section 114 causes the process to proceed to step S1401.

Figure 25:
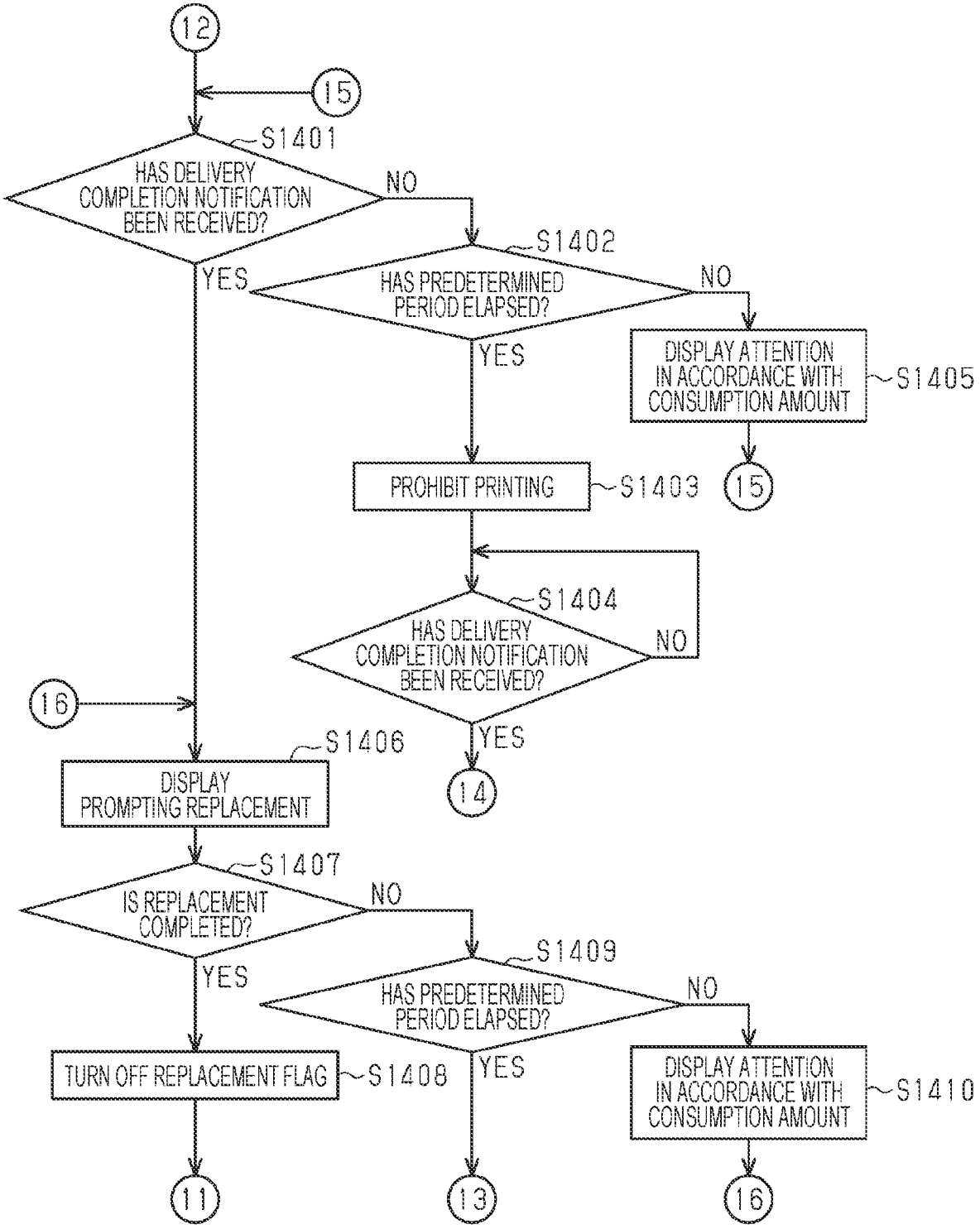
FIG. 25 is a flowchart illustrating the replacement routine.

As illustrated in FIG. 25, in step S1401, the control section 114 determines whether or not the delivery completion notification transmitted from the server 113 has been received. When the delivery completion notification has not been received, a determination result in step S1401 is NO. The control section 114 causes the process to proceed to step S1402. In step S1402, the control section 114 determines whether or not a predetermined period has elapsed from the replacement timing. When the predetermined period has elapsed, a determination result in step S1402 is YES, and the control section 114 causes the process to proceed to step S1403.

In step S1403, the control section 114 prohibits printing. In step S1404, the control section 114 determines whether or not a delivery completion notification transmitted from the server 113 has been received. When the delivery completion notification has not been received, a determination result in step S1404 is NO, and the control section 114 waits until the delivery completion notification is received. When the delivery completion notification has been received, the determination result in step S1404 is YES, and the control section 114 causes the process to proceed to step S1308.

When the predetermined period has not elapsed in step S1402, the determination result in step S1402 is NO, and the control section 114 causes the process to proceed to step S1405. In step S1405, the control section 114 displays attention on the display section 122 according to an amount of the consumed liquid, and causes the process to proceed to step S1401.

When the delivery completion notification is received in step S1401, the determination result in step S1401 is YES, and the control section 114 causes the process to proceed to step S1406. In step S1406, the control section 114 performs display for prompting replacement of the cartridge 151 on the display section 122.

In step S1407, the control section 114 determines whether or not the replacement of the cartridge 151 is completed. When the replacement is completed, a determination result in step S1407 is YES, and the control section 114 causes the process to proceed to step S1408. In step S1408, the control section 114 turns off the replacement flag and causes the process to proceed to step S1302.

When the replacement is not completed in step S1407, the determination result in step S1407 is NO, and the control section 114 causes the process to proceed to step S1409. In step S1409, when a predetermined period has elapsed from the replacement timing, a determination result in step S1409 is YES, and the control section 114 causes the process to proceed to step S1307. When the predetermined period has not elapsed from the replacement timing, the determination result in step S1409 is NO, and the control section 114 causes the process to proceed to step S1410. In step S1410, the control section 114 displays attention on the display section 122 according to an amount of the consumed liquid, and causes the process to proceed to step S1406.

An operation of the present embodiment will be described.

The control section 114 checks a delivery status of the new cartridge 151 with the server 113 at a replacement timing at which the cartridge 151 is required to be replaced.

Figure 26:
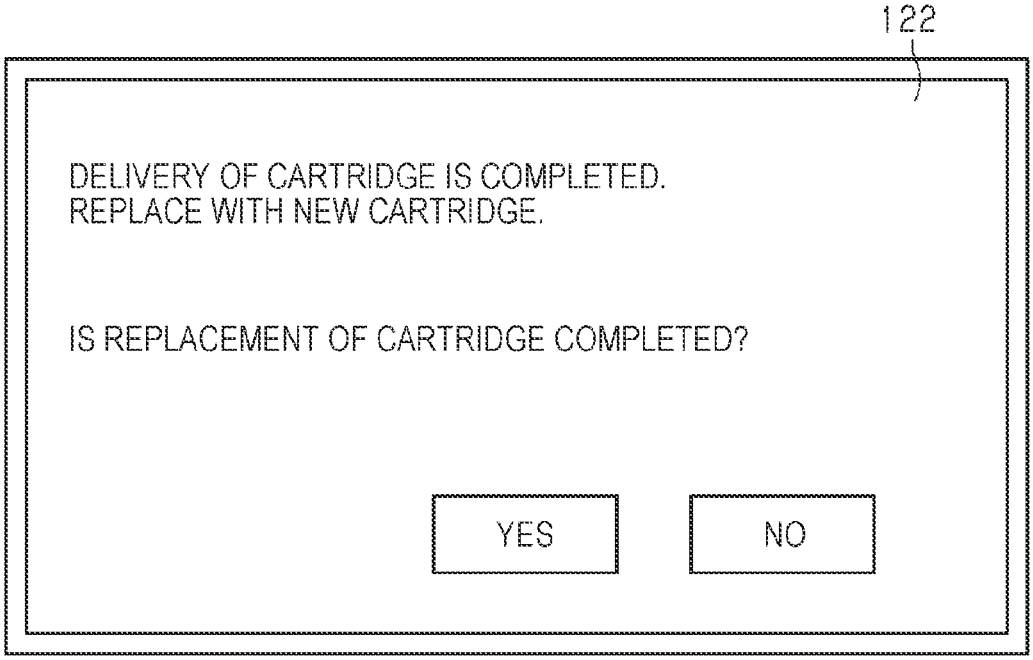
FIG. 26 is a schematic view of a display section displaying a replacement prompting screen.

As illustrated in FIG. 26, when the new cartridge 151 has been sent and has arrived at the replacement timing, the control section 114 may prohibit printing and display a replacement prompting screen for prompting replacement of the cartridge 151 on the display section 122. When the operation section 121 is operated by the user and information indicating that the replacement is completed is input, the control section 114 may determine that the replacement of the cartridge 151 is completed. The control section 114 may determine that the replacement is completed based on information stored in the storage medium 156.

Figure 27:
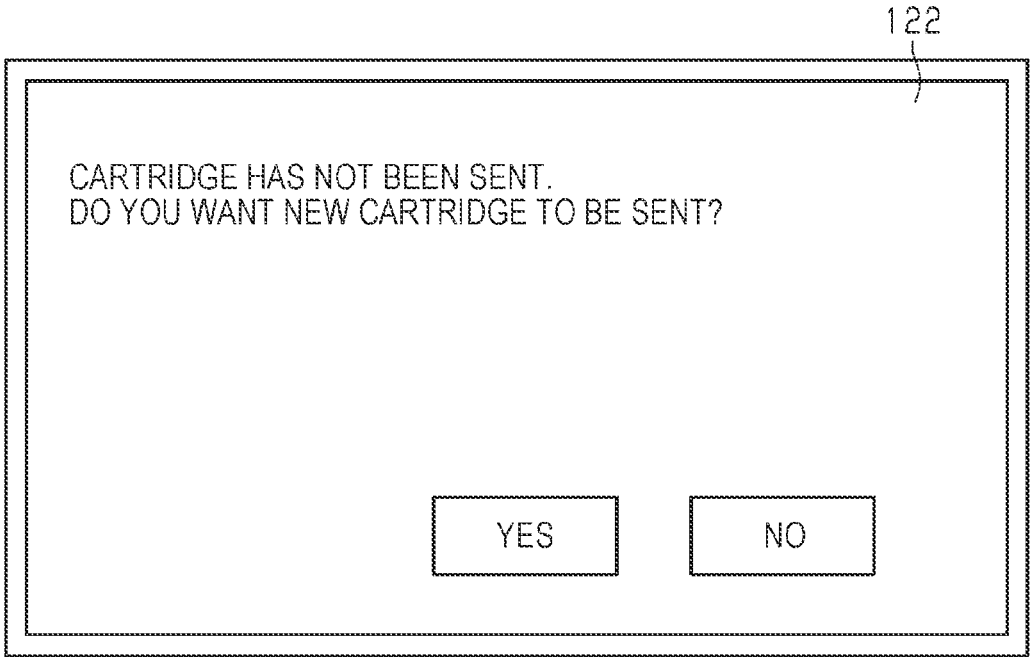
FIG. 27 is a schematic view of a display section that displays a sending check screen.

As illustrated in FIG. 27, when the new cartridge 151 has not been sent at the replacement timing, the display section 122 may display a sending check screen for checking sending of the new cartridge 151 on the display section 122. When the operation section 121 is operated by the user and sending of the new cartridge 151 is selected, the control section 114 makes a sending request to the server 113. When sending of the new cartridge 151 is not selected, the control section 114 prohibits printing until the replacement of the cartridge 151 is completed or sending of the new cartridge 151 is selected.

Figure 28:
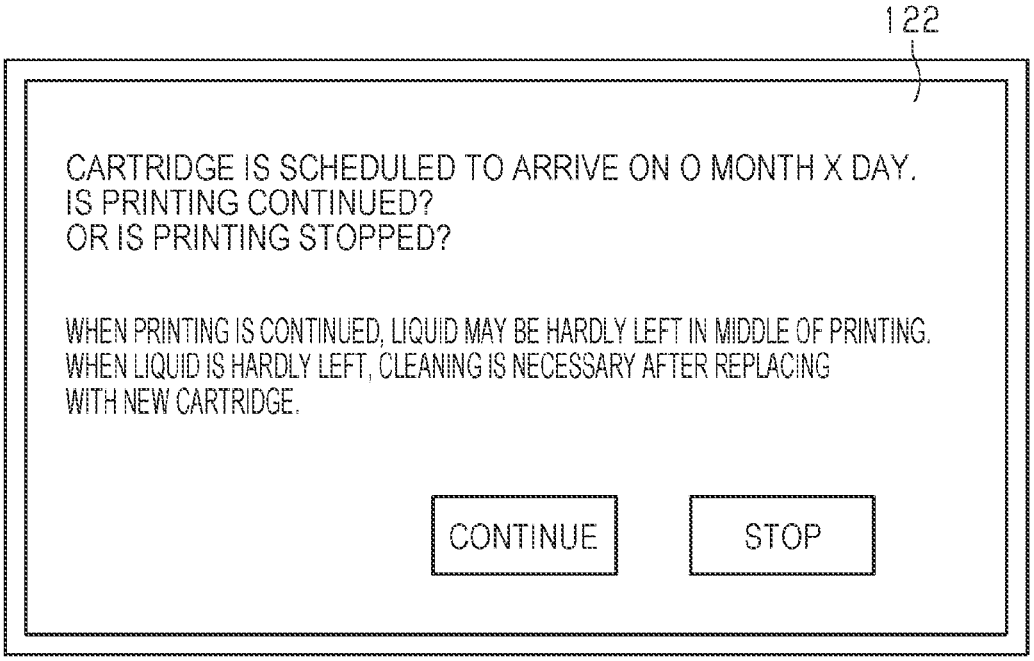
FIG. 28 is a schematic view of a display section displaying a continuation selection screen.

As illustrated in FIG. 28, the control section 114 that has made the sending request for the new cartridge 151 displays a continuation selection screen on the display section 122, so that the control section 114 brings a state in which continuation of temporary printing is selectable after calling attention. The continuation selection screen may include attention when continuation of printing is selected and the estimated arrival date of the new cartridge 151. That is, the control section 114 may display the estimated arrival date of the new cartridge 151 on the display section 122. The control section 114 temporarily continues printing when the user selects continuation. The control section 114 prohibits printing when the user selects stop.

As illustrated in FIG. 28, the control section 114 may display the continuation selection screen on the display section 122 even when the new cartridge 151 has been sent but has not arrived at the replacement timing. That is, the control section 114 brings a state in which continuation of temporary printing is selectable after calling attention. When continuation of temporary printing is selected at the replacement timing, the liquid ejection apparatus 112 performs printing with the liquid remaining in the cartridge 151.

In a state where printing can be temporarily continued, the control section 114 may change a content of attention in accordance with an amount of the liquid consumed after the replacement timing. For example, the control section 114 may gradually increase the degree of attention by changing a color and wording of the attention as a consumption amount increases.

For example, in the cartridge 151 in which a liquid level of the stored liquid is in contact with air, there is concern that air may enter the liquid supply flow path 126 and the liquid ejection head 124, similarly to the liquid storage body 125. Thus, the degree of attention may be increased as in the third embodiment.

The cartridge 151 may store a liquid in a flexible storage bag. The storage bag collapses as the liquid is supplied. As an amount of the liquid stored in the storage bag decreases, the storage bag becomes less likely to collapse and thus the liquid becomes less likely to be supplied. Thus, as a residual amount of the cartridge 151 decreases, a speed at which the liquid can be supplied may become slower. When a consumption rate of consuming the liquid in printing is higher than a supply rate of supplying the liquid from the cartridge 151, there is concern that air may enter the liquid supply flow path 126 and the liquid ejection head 124 from the nozzle (not illustrated) to cause defective ejection. Therefore, the control section 114 may increase the degree of attention so as to reduce the consumption rate as the consumption amount increases and the residual amount decreases.

When the new cartridge 151 arrives at the user, the server 113 transmits a delivery completion notification to the liquid ejection apparatus 112. When the delivery completion notification of the new cartridge 151 is received from the server 113 in a state where printing can be temporarily continued, the control section 114 may perform display for prompting replacement of the cartridge 151 on the display section 122 until the cartridge 151 is replaced. Specifically, the control section 114 displays the replacement prompting screen illustrated in FIG. 26 on the display section 122.

After receiving the delivery completion notification from the server 113, the control section 114 may prohibit printing when a period in which the cartridge 151 is not replaced exceeds a predetermined period. The predetermined period may be, for example, a period until execution of a print job is finished when a delivery completion notification is received while printing is being executed, or a period in which a predetermined amount of the liquid is consumed.

In a case where continuation of printing is selected and printing is executed at the replacement timing, the control section 114 cleans the liquid ejection head 124 and forces the liquid to be discharged from the nozzle when the cartridge 151 is replaced.

The effects of the present embodiment will be described.

(8) At a replacement timing at which the cartridge 151 is required to be replaced, a small amount of a liquid remains in the cartridge 151, the liquid supply flow path 126 coupling the cartridge 151 to the liquid ejection head 124, and the liquid ejection head 124. However, when printing is performed by using the liquid, there is concern that air may enter the liquid supply flow path 126 and the liquid ejection head 124, and thus it is necessary to perform work of filling the liquid supply flow path 126 and the liquid ejection head 124 with the liquid in the future. In relation to this fact, the control section 114 checks a delivery status of the new cartridge 151 with the server 113 at the replacement timing, and brings a state in which continuation of temporary printing is selectable after calling attention when the cartridge 151 has been sent but has not arrived. Thus, the user can check the delivery status of the new cartridge 151 at the replacement timing, and can temporarily continue printing even when the new cartridge 151 has not arrived. Thus, it is possible to reduce concern that a period in which printing is to be stopped may occur.

(9) At the replacement timing, the control section 114 makes a sending request to the server 113 when the new cartridge 151 has not been sent. Thus, it is possible to save the user's time and effort to prepare the new cartridge 151.

(10) The control section 114 displays the estimated arrival date of the new cartridge 151 on the display section 122. Thus, the user can use the estimated arrival date to determine whether to temporarily continue printing or wait for the arrival of the new cartridge 151.

(11) When the control section 114 receives a delivery completion notification of the new cartridge 151 from the server 113, the control section 114 continues to perform display for prompting replacement on the display section 122 until the cartridge 151 is replaced. Thus, it is possible to reduce concern that the liquid in the liquid ejection head 124 may not be left.

(12) The control section 114 prohibits printing when a period in which replacement with the new cartridge 151 is not performed exceeds a predetermined period after receiving a delivery completion notification of the new cartridge 151. When the control section 114 receives the delivery completion notification from the server 113, the new cartridge 151 is delivered to the user, and the user is ready to replace the cartridge 151. Thus, it is possible to reduce concern that printing is continued without replacing the cartridge 151 even after the new cartridge 151 arrives.

(13) When continuation of temporary printing is selected at the replacement timing, concern that the liquid in the liquid ejection head 124 may not be left increases as an amount of the consumed liquid increases. In relation to this fact, the control section 114 changes a content of attention according to an amount of the consumed liquid. Thus, the user can be informed of the high probability that the liquid in the liquid ejection head 124 may not be left.

(14) When the new cartridge 151 has been sent and has arrived at the replacement timing, the control section 114 prohibits printing and performs display for prompting replacement on the display section 122. Thus, it is possible to reduce concern that printing may be continued without replacement with the new cartridge 151.

The present embodiment may be modified and implemented as follows. The present embodiment and the following modification examples may be implemented in combination with each other within a technically consistent scope.

Figure 29:
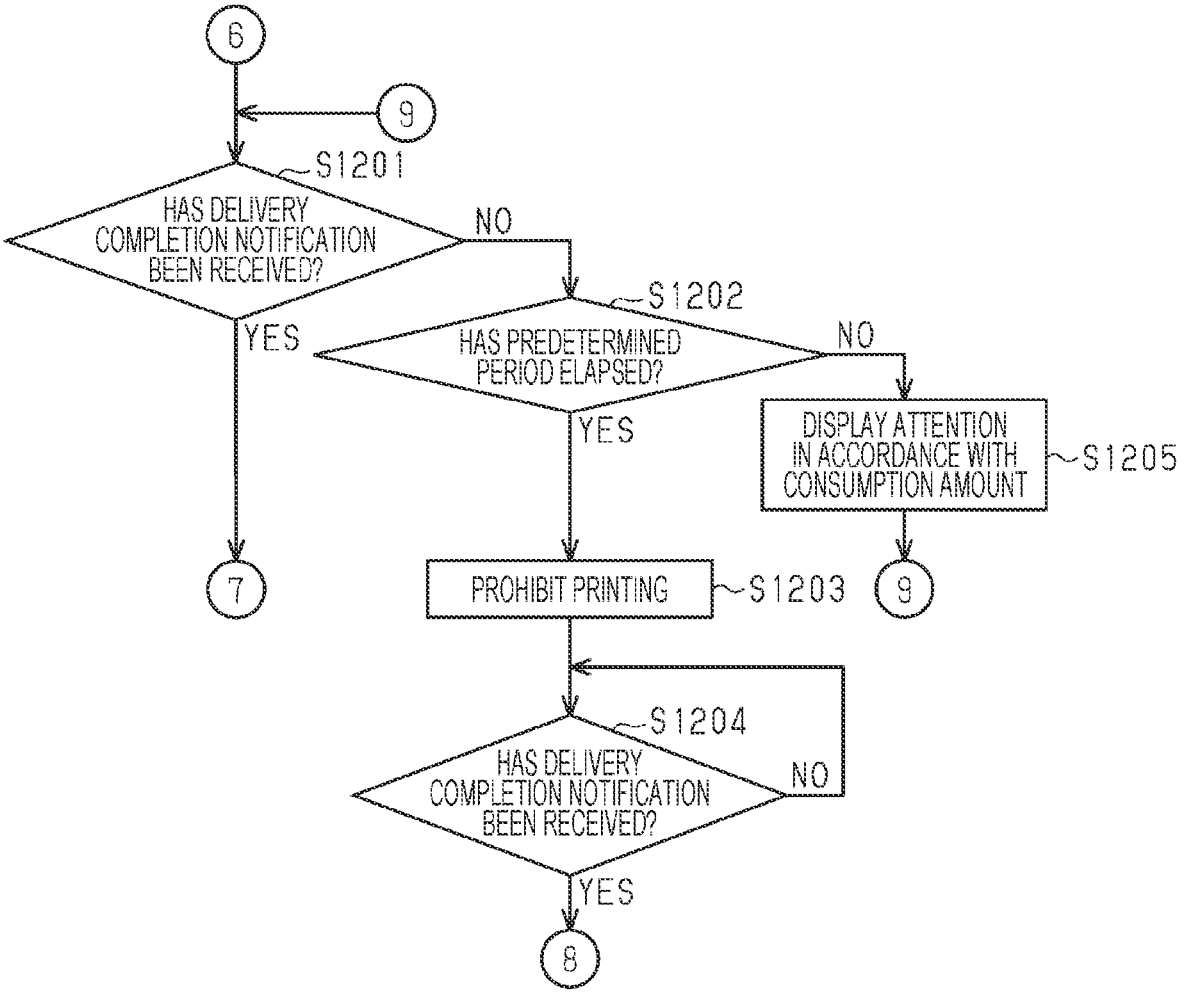
FIG. 29 is a flowchart illustrating a refill routine related to a modified example.

In the refill routine illustrated in FIGS. 18 and 19, as in the flowchart of FIG. 29, steps S1206 to S1210 may be omitted. That is, in step S1201, when the delivery completion notification has been received, the determination result in step S1201 is YES, and the control section 114 may cause the process to proceed to step S1107. When the delivery completion notification of the new refill container 139 is received from the server 113 in a state where printing can be temporarily continued, the control section 114 may immediately prohibit printing and perform display for prompting refill on the display section 122 until the liquid storage body 125 is refilled with the liquid. Consequently, it is possible to reduce concern that the liquid in the liquid ejection head 124 may not be left.

Figure 30:
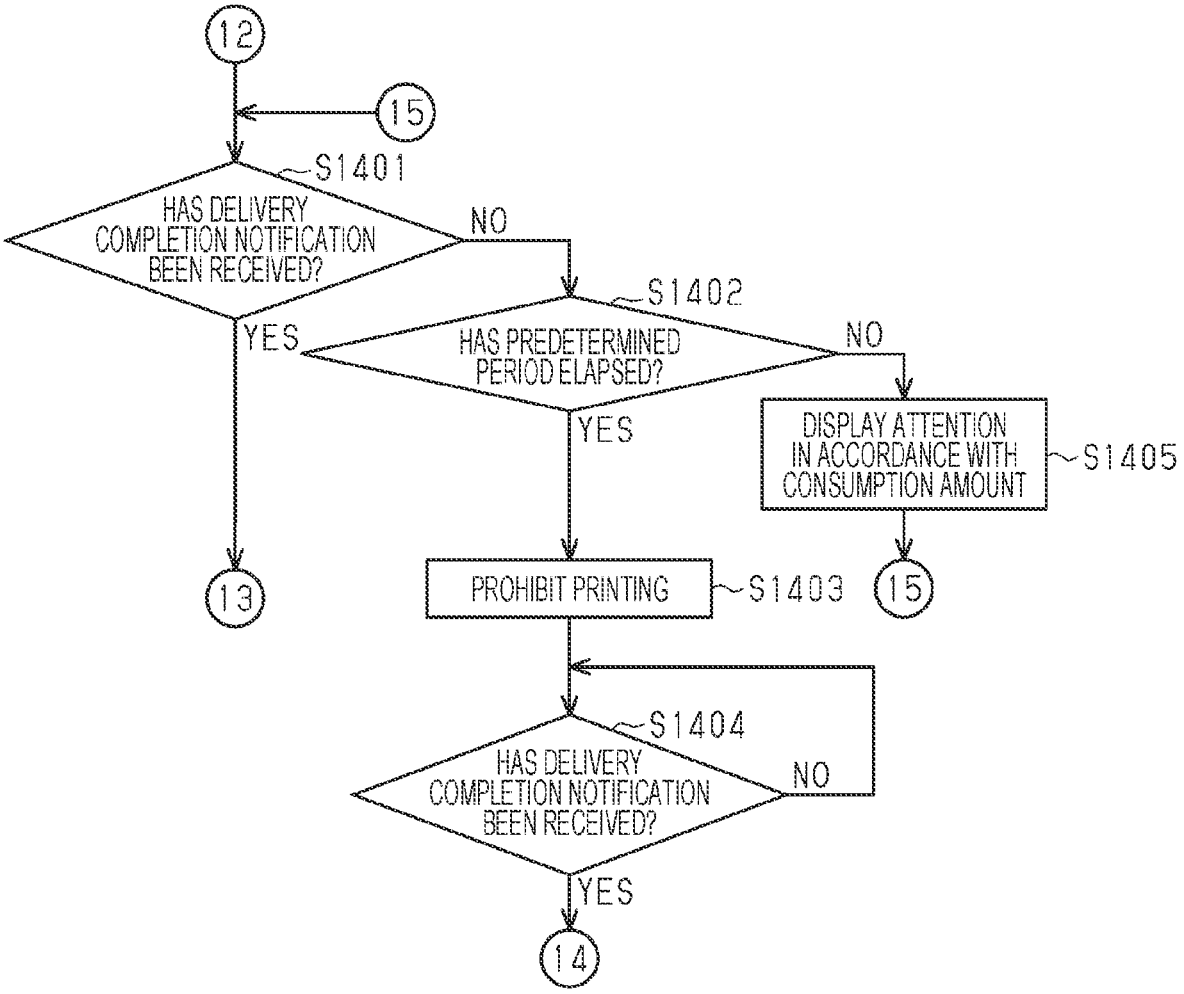
FIG. 30 is a flowchart illustrating a replacement routine related to a modified example.

In the replacement routine illustrated in FIGS. 24 and 25 as in the flowchart of FIG. 30, steps S1406 to S1410 may be omitted. That is, in step S1401, when the delivery completion notification is received, the determination result in step S1401 is YES, and the control section 114 may cause the process to proceed to step S1307. When the delivery completion notification of the new cartridge 151 is received from the server 113 in a state where printing can be temporarily continued, the control section 114 may immediately prohibit printing and perform display for prompting replacement on the display section 122 until replacement with the new cartridge 151 is performed. Consequently, it is possible to reduce concern that the liquid in the liquid ejection head 124 may not be left.

The holding portion 135 may be provided with a label indicating the type of stored liquid. The label may be provided to correspond to each liquid storage body 125. The pour cover 144 may cover a label corresponding to the unused liquid storage body 125 together with the pour 140 of the unused liquid storage body 125.

The liquid ejection apparatus 112 may store different types of liquids in the plurality of liquid storage bodies 125, respectively. In this case, the control section 114 may bring a state in which continuation of temporary printing is selectable after calling attention at a refill timing of any one of the liquid storage bodies 125.

A plurality of cartridges 151 may be attached to the attachment portion 152. In this case, the control section 114 may bring a state in which continuation of temporary printing is selectable after calling attention at a replacement timing of any one of the cartridges 151.

The liquid ejection apparatus 112 may include an attachment detector detecting that the cartridge 151 is attached to the attachment portion 152. The control section 114 may determine whether or not the cartridge 151 has been replaced based on a detection result from the attachment detector.

The control section 114 may set a printing speed when a temporarily printable state is selected to be lower than that during normal printing at the refill timing or the replacement timing. For example, the control section 114 may set a movement speed of the carriage 127 when a temporarily printable state is selected to be lower than that during normal printing. In a case of a line head in which the liquid ejection head 124 is provided over a width direction of the medium 116, a transport speed of the medium 116 when a temporarily printable state is selected may be set to be lower than that during normal printing. The control section 114 may reduce an amount of a liquid ejected by the liquid ejection head 124 per unit time.

The control section 114 may change a content of attention when a temporarily printable state is selected according to data to be printed at the refill timing or the replacement timing. For example, the control section 114 may call more attention when a printing rate is high than when the printing rate is low. The control section 114 may call more attention when a size of the printing medium 116 is large than when the size of the printing medium 116 is small. The control section 114 may call more attention when the number of media 116 to be printed is large than when the number of media 116 to be printed is small.

When the refill timing is earlier than arrival of the refill container 139, or the replacement timing is earlier than arrival of the cartridge 151, the server 113 may store an earlier period. In the case of the subscription type liquid ejection apparatus 112 in which a charge is generated according to a period of use, each of a period from the refill timing to arrival of the refill container 139 and a period from the replacement timing to arrival of the cartridge 151 is a period during which printing cannot be performed in a correct state. Thus, the delivery system 111 may return, to the user, services such as refunds, gifts, and plan content changes according to the period stored in the server 113.

The liquid ejection apparatus 112 may include an estimation section that estimates a refill timing based on an amount of a liquid consumed per predetermined period and an amount of a liquid filling the refill container 139. The liquid ejection apparatus 112 may include a sending request section that requests the server 113 to send the refill container 139 before only a delivery period required for delivery of the refill container 139 based on the refill timing estimated by the estimation section. When the new refill container 139 has not arrived at the refill timing, the estimation section may correct the next refill timing to be earlier and advance the sending request.

The liquid ejection apparatus 112 may include an estimation section that estimates the replacement timing based on an amount of liquid consumed per predetermined period and an amount of liquid stored in the new cartridge 151. The liquid ejection apparatus 112 may include a sending request section that requests the server 113 to send the cartridge 151 only the delivery period required for delivering the cartridge 151 before the replacement timing estimated by the estimation section. When the new refill container 139 has not arrived at the replacement timing, the estimation section may correct the next replacement timing to be earlier and advance the sending request.

The control section 114 may display attention regardless of an amount of a liquid consumed in a state in which printing can be temporarily continued.

The control section 114 may bring a state in which continuation of temporary printing is selectable even when a period in which refill or replacement is not performed exceeds a predetermined period after a delivery completion notification is received.

When the delivery completion notification is received from the server 113 in a state where printing can be temporarily continued, the control section 114 may continuously, intermittently, or temporarily perform display for prompting refill or replacement.

The control section 114 does not need to display the estimated arrival date of the new refill container 139 or the new cartridge 151 on the display section 122. The control section 114 may perform a notification of the estimated arrival date with voice, for example.

When the refill container 139 or the cartridge 151 has not been sent at the refill timing or the replacement timing, the control section 114 may automatically request the refill container 139 or the cartridge 151 to be sent regardless of the user's operation. The control section 114 may request the refill container 139 or the cartridge 151 to be sent at a timing different from the refill timing or the replacement timing. The control section 114 may check a delivery status of the refill container 139 or the cartridge 151 regardless of the refill timing or the replacement timing.

The liquid ejection apparatus 112 may be a liquid ejection apparatus that jets or ejects a liquid other than ink. A state of a liquid ejected as a minute amount of liquid droplets from the liquid ejection apparatus includes granular, tear-like, or thread-like tail. The liquid mentioned here may be any material that can be ejected from the liquid ejection apparatus. For example, the liquid may be in a state when a substance is in a liquid phase, and includes fluids such as high-viscosity or low-viscosity liquids, sol, gel water, other inorganic solvents, organic solvents, solutions, liquid resins, liquid metals, and metal melts. The liquid includes not only a liquid as a state of a substance but also a liquid in which particles of a functional material made of a solid substance such as a pigment or a metal particle are dissolved, dispersed or mixed in a solvent. Typical examples of the liquid include ink as described in the above embodiment and liquid crystal. Here, the ink includes general water-based ink, oil-based ink, and gel ink, and various liquid compositions such as hot melt ink. Specific examples of the liquid ejection apparatus include a liquid crystal display, an electroluminescence display, a surface light emitting display, and an apparatus that ejects a liquid containing a material such as an electrode material or a coloring material used for manufacturing a color filter or the like in a dispersed or dissolved form. The liquid ejection apparatus may be an apparatus ejecting a bioorganic substance used for producing a biochip, an apparatus ejecting a liquid as a sample used as a precision pipette, a textile printer, a micro dispenser, or the like. The liquid ejection apparatus may be an apparatus ejecting a lubricating oil to a precision machine such as a timepiece or a camera in a pinpoint manner, or an apparatus ejecting, onto a substrate, a transparent resin liquid such as an ultraviolet curable resin in order to form a micro hemispherical lens or an optical lens, or the like used for an optical communication element or the like. The liquid ejection apparatus may be an apparatus that ejects an acid or alkali etching solution in order to etch a substrate or the like.

The technical spirit and its operations and effects understood from the above-described embodiments and modifications are described below.

(A) A liquid ejection apparatus includes a liquid ejection head that is detachably attached and ejects a liquid, and a control section that is configured to transmit a delivery request for a new liquid ejection head to a server apparatus via a network.

According to this configuration, delivery of a new replacement liquid ejection head can be requested when needed. Consequently, it is possible to reduce downtime caused by the absence of a new replacement liquid ejection head at a user's hand when a problem occurs in the liquid ejection head in the liquid ejection apparatus.

(B) The liquid ejection apparatus may further include a detector that detects a problem related to the ejection, and the control section may be configured to transmit the delivery request for the new liquid ejection head when the detector detects the problem.

According to this configuration, it is possible to request delivery of a new replacement liquid ejection head when a problem related to ejection occurs. Consequently, it is possible to reduce downtime caused by the absence of a new replacement liquid ejection head at a user's hand when a problem occurs in the liquid ejection head in the liquid ejection apparatus.

(C) In the liquid ejection apparatus, the control section may start a check flow including the delivery request for the new liquid ejection head when the detector detects the problem.

According to this configuration, when a problem occurs in the liquid ejection head, it is possible to request delivery of a new replacement liquid ejection head depending on a state of the problem of the liquid ejection head. Consequently, it is possible to reduce downtime caused by the absence of a new replacement liquid ejection head at a user's hand when a problem occurs in the liquid ejection head in the liquid ejection apparatus.

(D) The liquid ejection apparatus may further include a maintenance section that performs maintenance on the liquid ejection head, the detector may have a function of detecting defective ejection of the liquid ejection head, the control section may perform automatic maintenance of causing the maintenance section to automatically execute the maintenance when the detector detects the defective ejection, and the detector may detect that the automatic maintenance was repeatedly executed a predetermined number of times or more as the problem.

According to this configuration, in a case where there is defective ejection that is not solved even when the automatic maintenance was repeatedly executed a predetermined number of times or more, it is possible to request delivery of a new replacement liquid ejection head. Consequently, it is possible to reduce downtime caused by the absence of a new replacement liquid ejection head at a user's hand when a problem occurs in the liquid ejection head in the liquid ejection apparatus.

(E) The liquid ejection apparatus may further include a maintenance section that performs maintenance on the liquid ejection head, and the detector may detect that the maintenance was repeatedly executed by a user a predetermined number of times or more as the problem.

According to this configuration, in a case where a problem that is not solved occurs even when maintenance was repeatedly executed by the user a predetermined number of times or more, it is possible to request delivery of a new replacement liquid ejection head. Consequently, it is possible to reduce downtime caused by the absence of a new replacement liquid ejection head at a user's hand when a problem occurs in the liquid ejection head in the liquid ejection apparatus.

(F) The liquid ejection apparatus may further include an input section that is configured for the user to input occurrence of the problem.

According to this configuration, when the user determines that the liquid ejection head has a problem, appropriate measures can be taken. Consequently, it is possible to reduce downtime caused by the absence of a new replacement liquid ejection head at a user's hand when a problem occurs in the liquid ejection head in the liquid ejection apparatus.

(G) In the liquid ejection apparatus, when the user inputs the occurrence of the problem to the input section, the control section may start a check flow including the delivery request for the new liquid ejection head.

According to this configuration, when the user inputs the occurrence of a problem related to ejection, it is possible to take measures according to a status at that time. Consequently, it is possible to reduce downtime caused by the absence of a new replacement liquid ejection head at a user's hand when a problem occurs in the liquid ejection head in the liquid ejection apparatus.

(H) The liquid ejection apparatus may further include a maintenance section that performs maintenance on the liquid ejection head, and the control section may start the check flow according to an execution status of the maintenance before the occurrence of the problem is input to the input section.

According to this configuration, when the user inputs the occurrence of the problem related to ejection, it is possible to take measures according to an execution status of the maintenance before the input. Consequently, it is possible to reduce downtime caused by the absence of a new replacement liquid ejection head at a user's hand when a problem occurs in the liquid ejection head in the liquid ejection apparatus.

(I) In the liquid ejection apparatus, the control section may prohibit use of the liquid ejection apparatus when the delivery request for the new liquid ejection head is transmitted.

According to this configuration, in the liquid ejection apparatus, it is possible to prevent printing from being continued in the liquid ejection head having a problem related to ejection.

(J) In the liquid ejection apparatus, the control section may cancel the prohibition of use of the liquid ejection apparatus after transmitting the delivery request for the new liquid ejection head on condition of a request from the user.

According to this configuration, even when there is a problem with the liquid ejection head, printing can be continued until a new liquid ejection head arrives, depending on the user's request. Consequently, it is possible to reduce downtime caused by the absence of a new replacement liquid ejection head at a user's hand when a problem occurs in the liquid ejection head in the liquid ejection apparatus.

(K) In the liquid ejection apparatus, when the delivery request for the new liquid ejection head is made, in a case where there is a liquid storage body of which a residual amount is less than a predetermined threshold value among a plurality of liquid storage bodies storing liquids to be supplied to the liquid ejection head, the control section may transmit a delivery request for a new liquid storage body in addition to the delivery request for the new liquid ejection head.

According to this configuration, in the liquid ejection apparatus, it is also possible to request delivery of a new liquid storage body corresponding to a liquid storage body having a small residual amount in accordance with a delivery timing of the liquid ejection head.

(L) In the liquid ejection apparatus, a plurality of liquid storage bodies storing liquids to be supplied to the liquid ejection head may be accommodated, each of the liquid storage bodies has a supply port used for replenishment with a liquid stored in a refill container, and, when the delivery request for the new liquid ejection head is made, in a case where there is a liquid storage body of which a residual amount is less than a predetermined threshold value among the plurality of liquid storage bodies storing the liquids to be supplied to the liquid ejection head, the control section may transmit a delivery request for a new refill container in addition to the delivery request for the new liquid ejection head.

According to this configuration, in the liquid ejection apparatus, it is also possible to request delivery of the refill container for replenishing the liquid storage body having a small residual amount with a liquid in accordance with a delivery timing of the liquid ejection head.

(M) The liquid ejection apparatus may further include a liquid storage body that stores the liquid to be supplied to the liquid ejection head, the liquid storage body may have a storage chamber storing the liquid and a pour through which the storage chamber is refilled with the liquid from a refill container, and the control section may check a delivery status of the new refill container with the server apparatus at a refill timing at which the liquid storage body is required to be refilled with the liquid, and bring a state in which continuation of temporary printing is selectable after calling attention when the new refill container was sent but was not arrived.

According to this configuration, the control section checks a delivery status of the new refill container with the server at the refill timing, and brings a state in which continuation of temporary printing is selectable after calling attention when the refill container was sent but was not arrived. Thus, the user can check a delivery status of the new refill container at the refill timing, and can temporarily continue printing even when the new refill container was not arrived. Thus, it is possible to reduce concern that a period in which printing is to be stopped may occur.

(N) A delivery system for a liquid ejection head includes the liquid ejection apparatus including a liquid ejection head that is detachably attached and ejects a liquid, and a control section that is configured to transmit a delivery request for a new liquid ejection head to a server apparatus via a network; and the server apparatus including a reception section that receives the delivery request for the new liquid ejection head transmitted from the control section.

According to this configuration, when a problem occurs in the liquid ejection head, the liquid ejection head can be replaced with a new head. Consequently, it is possible to reduce downtime caused by the absence of a new replacement liquid ejection head at a user's hand when a problem occurs in the liquid ejection head in the liquid ejection apparatus.

What is claimed is:

1. A liquid ejection apparatus comprising:

a liquid ejection head that is detachably attached and ejects a liquid; and a control section that is configured to transmit a delivery request for a new liquid ejection head to a server apparatus via a network; and wherein the control section prohibits use of the liquid ejection apparatus when the delivery request for the new liquid ejection head is transmitted.

2. The liquid ejection apparatus according to claim 1, further comprising:

a detector that detects a problem related to the ejection, wherein the control section is configured to transmit the delivery request for the new liquid ejection head when the detector detects the problem.

3. The liquid ejection apparatus according to claim 2, wherein the control section starts a check flow including the delivery request for the new liquid ejection head when the detector detects the problem.

4. A liquid ejection apparatus comprising:

a liquid ejection head that is detachably attached and ejects a liquid;

a control section that is configured to transmit a delivery request for a new liquid ejection head to a server apparatus via a network;

a detector that detects a problem related to the ejection, wherein the control section is configured to transmit the delivery request for the new liquid ejection head when the detector detects the problem;

a maintenance section that performs maintenance on the liquid ejection head, wherein the detector has a function of detecting defective ejection of the liquid ejection head, the control section performs automatic maintenance of causing the maintenance section to automatically execute the maintenance when the detector detects the defective ejection, and the detector detects that the automatic maintenance was repeatedly executed a predetermined number of times or more as the problem.

5. A liquid ejection apparatus comprising:

a liquid ejection head that is detachably attached and ejects a liquid;

a control section that is configured to transmit a delivery request for a new liquid ejection head to a server apparatus via a network;

a detector that detects a problem related to the ejection, wherein the control section is configured to transmit the delivery request for the new liquid ejection head when the detector detects the problem;

a maintenance section that performs maintenance on the liquid ejection head, wherein the detector detects that the maintenance was repeatedly executed by a user a predetermined number of times or more as the problem.

6. The liquid ejection apparatus according to claim 2, further comprising:

an input section that is configured for a user to input occurrence of the problem.

7. The liquid ejection apparatus according to claim 6, wherein, when the user inputs the occurrence of the problem to the input section, the control section starts a check flow including the delivery request for the new liquid ejection head.

8. The liquid ejection apparatus according to claim 7, further comprising:

a maintenance section that performs maintenance on the liquid ejection head, wherein the control section starts the check flow according to an execution status of the maintenance before the occurrence of the problem is input to the input section.

9. The liquid ejection apparatus according to claim 1, wherein the control section cancels the prohibition of use of the liquid ejection apparatus after transmitting the delivery request for the new liquid ejection head on a condition of a request from a user.

10. The liquid ejection apparatus according to claim 1, wherein, when the delivery request for the new liquid ejection head is made, in a case where there is a liquid storage body of which a residual amount is less than a predetermined threshold value among a plurality of liquid storage bodies storing liquids to be supplied to the liquid ejection head, the control section transmits a delivery request for a new liquid storage body in addition to the delivery request for the new liquid ejection head.

11. The liquid ejection apparatus according to claim 1, wherein a plurality of liquid storage bodies storing liquids to be supplied to the liquid ejection head are accommodated, the liquid storage body has a supply port used for replenishment with a liquid stored in a refill container, and when the delivery request for the new liquid ejection head is made, in a case where there is a liquid storage body of which a residual amount is less than a predetermined threshold value among the plurality of liquid storage bodies storing the liquids to be supplied to the liquid ejection head, the control section transmits a delivery request for a new refill container in addition to the delivery request for the new liquid ejection head.

12. The liquid ejection apparatus according to claim 1, further comprising:

a liquid storage body that stores the liquid to be supplied to the liquid ejection head, wherein the liquid storage body includes a storage chamber that stores the liquid, and a pour through which the storage chamber is refilled with the liquid from a refill container, and the control section checks a delivery status of a new refill container with the server apparatus at a refill timing at which the liquid storage body is required to be refilled with the liquid, and brings a state in which continuation of temporary printing is selectable after calling attention when the new refill container was sent but was not arrived.

13. A delivery system for a liquid ejection head comprising:

the liquid ejection apparatus according to claim 1; and the server apparatus including a reception section that receives the delivery request for the new liquid ejection head transmitted from the control section.

* * * * *